US011624247B2

(12) United States Patent
Biggerstaff et al.

(10) Patent No.: US 11,624,247 B2
(45) Date of Patent: Apr. 11, 2023

(54) ELEVATOR GRIP LIFTING AND ROTARY SLIP HOLDING SYSTEM AND METHODS THEREOF

(71) Applicant: Black Diamond Oilfield Rentals LLC, Houston, TX (US)

(72) Inventors: Christopher M. Biggerstaff, Houston, TX (US); Charles G. Kibbe, New Iberia, LA (US); Ross J. Robin, New Iberia, LA (US)

(73) Assignee: Black Diamond Oilfield Rentals LLC, Houston, TX (US)

( * ) Notice: Subject to any disclaimer, the term of this patent is extended or adjusted under 35 U.S.C. 154(b) by 344 days.

(21) Appl. No.: 16/849,578

(22) Filed: Apr. 15, 2020

(65) Prior Publication Data

US 2020/0332608 A1 Oct. 22, 2020

Related U.S. Application Data

(60) Provisional application No. 62/835,422, filed on Apr. 17, 2019.

(51) Int. Cl.
*E21B 19/10* (2006.01)
*E21B 19/07* (2006.01)

(52) U.S. Cl.
CPC ..... *E21B 19/07* (2013.01); *E21B 19/10* (2013.01)

(58) Field of Classification Search
CPC ..... E21B 19/07; E21B 19/10; E21B 33/068; B66C 13/06; F16F 15/023
USPC ..... 294/102.2
See application file for complete search history.

(56) References Cited

U.S. PATENT DOCUMENTS 3,832,918 A * 9/1974 Lang ..... E21B 19/16 81/57.33
5,335,756 A * 8/1994 Penisson ..... E21B 19/10 188/67
5,653,297 A * 8/1997 Whisenhunt ..... E21B 19/163 175/162
5,845,549 A * 12/1998 Bouligny ..... E21B 19/164 81/57.33
6,070,500 A * 6/2000 Dlask ..... E21B 19/161 81/57.33
6,298,926 B1 * 10/2001 Dalkert ..... E21B 19/167 175/85
6,938,519 B2 * 9/2005 Boyd ..... E21B 19/163 81/57.33
7,748,297 B2 * 7/2010 Belik ..... B25B 13/5016 81/57.33
7,992,909 B2 * 8/2011 Bouligny, Jr. ..... E21B 19/12 294/102.1
8,267,448 B2 * 9/2012 Dagenais ..... E21B 19/163 294/102.2

(Continued)

*Primary Examiner* — Paul T Chin
(74) *Attorney, Agent, or Firm* — Foley & Lardner LLP

(57) ABSTRACT

An elevator grip or rotary slip grip system, comprising a cage spacer adaptably mountable to an upper surface of an elevator or slip body, a dog cage having a plurality of openings, a plurality of locking dogs adaptably mountable to a plurality of seats in the elevator or slip body, wherein each of the plurality of locking dogs has a front surface to engage an object and wherein the front surface of each of the plurality of locking dogs is disposed through each of the plurality of openings in the dog cage is disclosed. A method of using the elevator grip or rotary slip grip system is also disclosed.

57 Claims, 33 Drawing Sheets

(56) References Cited

U.S. PATENT DOCUMENTS 8,979,150 B1 * 3/2015 McKissack ..... E21B 19/06
294/90

* cited by examiner

ELEVATOR GRIP LIFTING AND ROTARY SLIP HOLDING SYSTEM AND METHODS THEREOF

PRIOR RELATED APPLICATIONS

This application claims benefit of U.S. Provisional Patent Application Ser. No. 62/835,422 entitled "ELEVATOR GRIP LIFTING SYSTEM AND METHODS THEREOF," filed on Apr. 17, 2019.

FEDERALLY SPONSORED RESEARCH STATEMENT

Not Applicable (N/A)

REFERENCE TO MICROFICHE APPENDIX

N/A

FIELD OF INVENTION

The present invention relates generally to an improved elevator system, an improved rotary slip system and methods thereof and, more particularly, to an improved elevator grip lifting system with locking dogs, an improved rotary slip holding system with locking dogs, and methods thereof.

BACKGROUND

Standard elevator assemblies may be used to lift objects such as pipe that have a defined shoulder. The standard elevator assembly cannot be used to objects that have little to no shoulder and/or a variable exterior surface.

Standard rotary slip assemblies may be used to hold objects such as pipe that have a uniform exterior surface. The standard rotary slip cannot be used to hold objects that have a variable exterior surface.

Thus, an improved elevator grip system with locking dogs and an improved rotary slip system with locking dogs are needed to eliminate these problems.

SUMMARY OF THE INVENTION

The present invention relates generally to an improved elevator system and methods thereof and, more particularly, to an improved elevator grip system with locking dogs and methods thereof.

The improved elevator grip system introduces a new way of securing enclosed objects. The elevator grip system is capable of griping objects that have little to no shoulder and/or a variable exterior surface. Typically, the opposite of one or all of these conditions is required for a standard elevator system.

The elevator grip system may be integrated into existing technology such as standard lifting elevator assemblies and rotary slips.

In an embodiment, an elevator grip system comprises a cage spacer adaptably mountable to an upper surface of an elevator body, a dog cage having a plurality of openings, wherein the dog cage is movably attached to the elevator body and vertically positioned by the cage spacer, a linking means having a first end and a second end, wherein the first end of the linking means is movably attached to the cage spacer and wherein the second end of the linking means is movably attached to the cage spacer, and a plurality of locking dogs adaptably mountable to a plurality of seats in the elevator body, wherein each of the locking dogs has a front surface to engage an object and wherein the front surface of each of the plurality of locking dogs is disposed through each of the plurality of openings in the dog cage.

In another embodiment, an elevator grip system comprises a cage spacer fixedly attached to an elevator body, a dog cage having a plurality of openings, wherein the dog cage is movably attached to the elevator body and vertically positioned by the cage spacer, a push rod having a first end and a second end, wherein the first end of the push rod is movably attached to the cage spacer, a lever arm having a first end and a second end shaped to extend over the dog cage when the elevator grip system is in the closed position, wherein the second end of the push rod is movably attached to the first end of the lever arm and the second end of the lever arm is movably attached to the cage spacer and adapted to force the dog cage downward when the elevator grip system is in a closed position and a plurality of locking dogs adaptably mountable to a plurality of seats in the elevator body, wherein each of the locking dogs has a front surface to engage an object and wherein the front surface of each of the plurality of locking dogs is disposed through each of the plurality of openings in the dog cage.

In an embodiment, the second end of the linking means is adapted to force the dog cage downward when the elevator grip system is in the closed position and the second end of the linking means is shaped to extend over the dog cage when the elevator grip system is in the closed position.

In an embodiment, the cage spacer comprises a central, upper lip to prevent accumulation of debris. In an embodiment, the cage spacer comprises two half-rings adaptable mountable to the upper surface of the elevator body, wherein the two half-rings come together to form a ring shape when the elevator grip system is in a closed position. In an embodiment, each half-ring of the cage spacer comprises a central, upper lip to retain an upper lip of the dog cage when the elevator grip system is in the closed position.

In an embodiment, the dog cage comprises an upper lip. In an embodiment, the dog cage comprises two half-cylinders, wherein the two half-cylinders come together to form an open cylinder shape when the elevator grip system is in a closed position. In an embodiment, each half-cylinder of the dog cage comprises an upper lip.

In an embodiment, each of the plurality of openings in the dog cage are an inverted "T" shape, a rectangle shape, a square shape, a "T" shape or a combination thereof. In an embodiment, each of the plurality of openings are a "T" shape.

In an embodiment, each of the plurality of locking dogs are a cubic shape, a cuboid shape, a cylinder shape, a square pyramid shape, a trapezoidal prism shape, a triangle prism shape or combinations thereof. In an embodiment, each of the plurality of locking dogs are a cubic shape, a cuboid shape, a cylinder shape, a square pyramid shape, a trapezoidal prism shape, a triangle prism shape or variations thereof. In an embodiment, each of the plurality of locking dogs are a cuboid shape.

In an embodiment, each of the plurality of locking dogs comprise an extension on each side. In an embodiment, each of the plurality of locking dogs comprise a cylindrical extension on each side.

In an embodiment, the elevator grip system further comprises a plurality of cage return springs disposed between the cage spacer and the dog cage.

In an embodiment, the elevator grip system further comprises an actuation means to force the locking dogs to engage an object and to hold tension on the object to be lifted. In an embodiment, the actuation means is hydraulic actuation, manual actuation, mechanical actuation, pneumatic actuation, or combinations thereof. In an embodiment, the actuation means is mechanical actuation.

In an embodiment, the elevator grip system further comprises a compression spring disposed between each of the plurality of locking dogs and each of the plurality of seats in the elevator body.

In an embodiment, each of the plurality of locking dogs comprises a compression spring having a first end and a second end and wherein the first end of the compression spring is attached to the back surface of the locking dog.

In an embodiment, the second end of the compression spring is attached to a surface in the seat of the elevator body.

In an embodiment, one or more of the cage spacer, the dog cage, the linking means and the plurality of locking dogs are constructed of an alloy steel. In an embodiment, one or more of the cage spacer, the dog cage, the linking means and the plurality of locking dogs are constructed of an American Iron and Steel (AISI) 4000 Series alloy steel or equivalent material.

In an embodiment, the plurality of locking dogs is constructed of a carburizing alloy steel. In an embodiment, the plurality of locking dogs is constructed of an American Iron and Steel (AISI) 8620 carburizing alloy steel or equivalent material. In an embodiment, the plurality of locking dogs has a Carbide coating or equivalent coating. In an embodiment, the plurality of locking dogs has a Carbide coating with about 6% Cobalt binder or equivalent material.

In an embodiment, the elevator grip system is capable of griping objects that have little to no shoulder and/or a variable exterior surface. In an embodiment, the elevator grip system is capable of griping pipe having an outer diameter from about 2⅞ inches to about 6⅝ inches.

The elevator grip system is capable of lifting up to about 175 tons.

In an embodiment, a method of using an elevator grip system comprises (a) providing the elevator grip system as discussed herein; (b) opening the elevator grip system; (c) positioning the open elevator grip system around an object to be lifted; and (d) closing the elevator grip system and allowing the plurality of locking dogs to engage the object.

In an embodiment, step (b) comprises: unlatching an external lock and opening the elevator grip system.

In an embodiment, step (c) comprises: closing the elevator grip system, latching the external lock and allowing the plurality of locking dogs to engage the object.

In an embodiment, the method further comprises (e) lifting the object.

In an embodiment, the method further comprises (f) suspending the object.

In an embodiment, step (f) comprises suspending the object by inserting a rotary slip.

In an embodiment, the method further comprises (g) un-wedging the plurality of locking dogs.

In an embodiment, step (g) comprises un-wedging the plurality of locking dogs by letting the elevator grip system down slightly.

In an embodiment, the method further comprises (h) opening the elevator grip system and allowing the plurality of locking dogs to disengage the object to a retracted position.

In an embodiment, the method further comprises (e) lifting the object, (f) suspending the object, (g) un-wedging the plurality of locking dogs, and (h) unlatching the external lock, opening the elevator grip system and allowing the plurality of locking dogs to disengage the object.

The improved rotary slip grip system introduces a new way of securing enclosed objects. The rotary slip grip system is capable of griping objects that have a variable exterior surface. Typically, the opposite of this condition is required for a standard slip system.

The rotary slip grip system may be integrated into existing technology such as standard lifting elevator assemblies and rotary slips.

In an embodiment, a rotary slip grip system, comprises a cage spacer adaptably mountable to an upper surface of a slip body, a dog cage having a plurality of openings, wherein the dog cage is movably attached to the slip body and vertically positioned by the cage spacer, and a plurality of locking dogs adaptably mountable to a plurality of seats in the slip body, wherein each of the plurality of locking dogs has a front surface to engage an object and wherein the front surface of each of the plurality of locking dogs is disposed through each of the plurality of openings in the dog cage.

In another embodiment, a rotary slip grip system, comprises a cage spacer fixedly attached to a slip body, a dog cage having a plurality of openings, wherein the dog cage is movably attached to the slip body and vertically positioned by the cage spacer, and a plurality of locking dogs adaptably mountable to a plurality of seats in the slip body, wherein each of the locking dogs has a front surface to engage an object and wherein the front surface of each of the plurality of locking dogs is disposed through each of the plurality of openings in the dog cage.

In an embodiment, the cage spacer comprises a central, upper lip to prevent accumulation of debris. In an embodiment, the cage spacer comprises two half-rings adaptable mountable to the upper surface of the slip body, wherein the two half-rings come together to form a ring shape when the rotary slip grip system is in a closed position. In an embodiment, each half-ring of the cage spacer comprises a central, upper lip to retain an upper lip of the dog cage when the rotary slip grip system is in the closed position.

In an embodiment, the dog cage comprises an upper lip. In an embodiment, the dog cage comprises two half-cylinders, wherein the two half-cylinders come together to form an open cylinder shape when the rotary slip grip system is in a closed position. In an embodiment, each half-cylinder of the dog cage comprises an upper lip.

In an embodiment, each of the plurality of openings in the dog cage are an inverted "T" shape, a rectangle shape, a square shape, a "T" shape or a combination thereof. In an embodiment, each of the plurality of openings are a "T" shape.

In an embodiment, each of the plurality of locking dogs are a cubic shape, a cuboid shape, a cylinder shape, a square pyramid shape, a trapezoidal prism shape, a triangle prism shape or combinations thereof. In an embodiment, each of the plurality of locking dogs are a cubic shape, a cuboid shape, a cylinder shape, a square pyramid shape, a trapezoidal prism shape, a triangle prism shape or variations thereof. In an embodiment, each of the plurality of locking dogs are a cuboid shape.

In an embodiment, each of the plurality of locking dogs comprise an extension on each side. In an embodiment, each of the plurality of locking dogs comprise a cylindrical extension on each side.

In an embodiment, the rotary slip grip system further comprises an actuation means to force the locking dogs to engage an object and to hold tension on the object to be lifted or suspended. In an embodiment, the actuation means is hydraulic actuation, manual actuation, mechanical actuation, pneumatic actuation, or combinations thereof. In an embodiment, the actuation means is mechanical actuation.

In an embodiment, the rotary slip grip system further comprises a compression spring disposed between each of the plurality of locking dogs and the slip body.

In an embodiment, each of the plurality of locking dogs comprises a compression spring having a first end and a second end and wherein the first end of the compression spring is attached to the back surface of the locking dog.

In an embodiment, the second end of the compression spring is attached to a surface in the seat of the slip body.

In an embodiment, one or more of the cage spacer, the dog cage and the locking dogs are constructed of an alloy steel. In an embodiment, one or more of the cage spacer, the dog cage and the plurality of locking dogs are constructed of an American Iron and Steel (AISI) 4000 Series alloy steel or equivalent material.

In an embodiment, the plurality of locking dogs is constructed of a carburizing alloy steel. In an embodiment, the plurality of locking dogs is constructed of an American Iron and Steel (AISI) 8620 carburizing alloy steel or equivalent material. In an embodiment, the plurality of locking dogs has a Carbide coating or equivalent coating. In an embodiment, the plurality of locking dogs has a Carbide coating with about 6% Cobalt binder or equivalent material.

In an embodiment, the rotary slip grip system is capable of griping objects that have a variable exterior surface. In an embodiment, the rotary slip grip system is capable of griping pipe having an outer diameter from about 2⅞ inches to about 6⅝ inches.

In an embodiment, the rotary slip grip system is capable of lifting or suspending about 175 tons.

In an embodiment, a method of using a rotary slip grip system, the method comprises (a) providing the rotary slip grip system as discussed herein; (b) opening the rotary slip grip system; (c) positioning the open the rotary slip grip system around an object to be suspended; and (d) closing the rotary slip grip system and allowing the plurality of locking dogs to engage the object.

In an embodiment, step (b) comprises: unlatching an external lock and opening the rotary slip grip system.

In an embodiment, step (c) comprises: closing the rotary slip grip system, latching the external lock and allowing the plurality of locking dogs to engage the object.

In an embodiment, the method further comprises (e) suspending the object.

In an embodiment, the method further comprises (f) lifting the object.

In an embodiment, step (f) comprises lifting the object by using an elevator.

In an embodiment, the method further comprises (g) un-wedging the plurality of locking dogs.

In an embodiment, step (g) comprises un-wedging the plurality of locking dogs by lifting the object up slightly using an elevator.

In an embodiment, the method further comprises (h) opening the rotary slip grip system and allowing the locking dogs to disengage the object.

In an embodiment, the method further comprises (e) suspending the object, (f) lifting the object, (g) un-wedging the plurality of locking dogs, and (h) unlatching the external lock, opening the rotary slip grip system and allowing the plurality of locking dogs to disengage the object.

In an embodiment, a rotary slip grip system, comprises a cage spacer adaptably mountable to an upper surface of a slip body; a dog cage having a plurality of openings, wherein the dog cage is movably attached to the slip body and vertically positioned by the cage spacer; and a plurality of locking dogs adaptably mountable to a plurality of seats in the slip body, wherein each of the plurality of locking dogs has a front surface to engage an object and wherein the front surface of each of the plurality of locking dogs is disposed through each of the plurality of openings in the dog cage.

In another embodiment, a rotary slip grip system, comprises a cage spacer fixedly attached to a slip body; a dog cage having a plurality of openings, wherein the dog cage is movably attached to the slip body and vertically positioned by the cage spacer; and a plurality of locking dogs adaptably mountable to a plurality of seats in the slip body, wherein each of the locking dogs has a front surface to engage an object and wherein the front surface of each of the plurality of locking dogs is disposed through each of the plurality of openings in the dog cage.

In an embodiment, the slip body comprises a first slip body and a second slip body.

In an embodiment, the cage spacer comprises a central, upper lip to prevent accumulation of debris. In an embodiment, the cage spacer comprises two half-rings adaptable mountable to the upper surface of the slip body, wherein the two half-rings come together to form a ring shape when the rotary slip grip system is in a closed position.

In an embodiment, each half-ring of the cage spacer comprises a central, upper lip to retain an upper lip of the dog cage when the rotary slip grip system is in the closed position. In an embodiment, the dog cage comprises two half-cylinders, wherein the two half-cylinders come together to form an open cylinder shape when the rotary slip grip system is in a closed position.

In an embodiment, each of the plurality of openings are an inverted "T" shape, a rectangle shape, a square shape, a "T" shape or a combination thereof. In an embodiment, each of the plurality of openings are a "T" shape.

In an embodiment, each of the plurality of locking dogs are a cubic shape, a cuboid shape, a cylinder shape, a square pyramid shape, a trapezoidal prism shape, a triangle prism shape or combinations thereof. In an embodiment, each of the plurality of locking dogs are a cuboid shape.

In an embodiment, each of the plurality of locking dogs comprise an extension on each side. In an embodiment, each of the plurality of locking dogs comprise a cylindrical extension on each side.

In an embodiment, the rotary slip grip system further comprises a compression spring disposed between each of the plurality of locking dogs and the slip body.

In an embodiment, one or more of the cage spacer, the dog cage and the locking dogs are constructed of an alloy steel. In an embodiment, one or more of the cage spacer, the dog cage and the plurality of locking dogs are constructed of an American Iron and Steel (AISI) 4000 Series alloy steel or equivalent material.

In an embodiment, the plurality of locking dogs is constructed of a carburizing alloy steel. In an embodiment, the plurality of locking dogs is constructed of an American Iron and Steel (AISI) 8620 carburizing alloy steel or equivalent material. In an embodiment, the plurality of locking dogs has a Carbide coating or equivalent coating. In an embodiment, the plurality of locking dogs has a Carbide coating with about 6% Cobalt binder or equivalent material.

In an embodiment, the rotary slip grip system is capable of griping objects that have a variable exterior surface. In an embodiment, the rotary slip grip system is capable of griping pipe having an outer diameter from about 2⅞ inches to about 6⅝ inches. In an embodiment, the rotary slip grip system is capable of suspending about 175 tons.

In an embodiment, the rotary slip grip system further comprises a first actuation means to force the plurality of locking dogs to engage an object and to hold tension on the object to be lifted or suspended. In an embodiment, the first actuation means is hydraulic actuation, manual actuation, mechanical actuation or pneumatic actuation.

In an embodiment, the rotary slip grip system further comprises a second actuation means to force to lift the rotary slip grip system from a bore of the drilling rig floor. In an embodiment, the second actuation means is hydraulic actuation, mechanical actuation or pneumatic actuation.

In an embodiment, the second actuation means comprises an actuation system. In an embodiment, the actuation system comprises a first actuation body; a second actuation body; a first lift arm having a first end and a second end, wherein the first actuation body is movably attached to the first end of the first actuation lift arm and the second end of the first lift arm is movably attached to the first slip body; a second lift arm having a first end and a second end, wherein the second actuation body is movably attached to the first end of the second lift arm and the second end of the second lift arm is movably attached to the second slip body; a first cam shaft having a first end and a second end, wherein the first end of the first cam shaft is movably attached to the first end of the first lift arm; a second cam shaft having a first end and a second end, wherein the first end of the second cam shaft is moveably attached to the first end of the second lift arm; a first drive arm having a first end and a second end, wherein the first end of the drive arm is movably attached to the second end of the first cam shaft and the second end of the first drive arm is attached to the second end of the second cam shaft; a second drive arm having a first end and a second end, wherein the second end of the second cam shaft is movably attached to the first end of the second drive arm; and a cylinder having a cylinder rod, wherein and the second end of the second drive arm is movably attached to the cylinder rod.

In an embodiment, a method of using a rotary slip grip system comprises (a) providing the rotary slip grip system as discussed herein; (b) opening the rotary slip grip system; (c) positioning the rotary slip grip system around an object to be suspended; and (d) closing the rotary slip grip system and allowing the plurality of locking dogs to engage the object.

In an embodiment, step (a) comprises: lowering an object to be suspended into a bore of a drilling rig floor and providing the rotary slip grip system.

In an embodiment, step (b) comprises: unlatching an external lock and opening the rotary slip grip system.

In an embodiment, step (c) comprises: positioning the rotary slip grip system around the object and lowering the rotary slip grip system into the bore of the drilling rig floor.

In an embodiment, step (d) comprises lowering the object and allowing the plurality of locking dogs to engage the object, comprises closing the rotary slip grip system, and latching the external lock.

In an embodiment, the method further comprises (e) suspending the object. In an embodiment, step (e) comprises suspending the object using an elevator.

In an embodiment, the method further comprises (f) lifting the object. In an embodiment, step (f) comprises lifting the object by using an elevator.

In an embodiment, the method further comprises (g) un-wedging the plurality of locking dogs. In an embodiment, step (g) comprises un-wedging the plurality of locking dogs by lifting the object up slightly using an elevator.

In an embodiment, the method further comprises (h) lifting the rotary slip grip system and allowing the plurality of locking dogs to disengage the object. In an embodiment, step (h) comprises lifting the rotary slip grip system from the bore of the drilling rig floor using an elevator and allowing the plurality of locking dogs to disengage the object.

In an embodiment, the method further comprises (h) lifting the rotary slip grip system from the bore of the drilling rig floor using an actuation system and allowing the plurality of locking dogs to disengage the object.

In an embodiment, the method further comprises (i) opening the rotary slip grip system. In an embodiment, step (i) comprises unlatching the external lock and opening the rotary slip grip system.

In an embodiment, the method further comprises (e) suspending the object; (f) lifting the object; (g) un-wedging the plurality of locking dogs by lifting the object slightly using an elevator; (h) lifting the rotary slip grip system and allowing the plurality of locking dogs to disengage the object; and (i) unlatching the external lock and opening the rotary slip grip system.

These and other objects, features and advantages will become apparent as reference is made to the following detailed description, preferred embodiments, and examples, given for the purpose of disclosure, and taken in conjunction with the accompanying drawings and appended claims.

BRIEF DESCRIPTION OF THE DRAWINGS

For a further understanding of the nature and objects of the present invention, reference should be made to the following detailed disclosure, taken in conjunction with the accompanying drawings, in which like parts are given like reference numerals, and wherein.

DETAILED DESCRIPTION

The following detailed description of various embodiments of the present invention references the accompanying drawings, which illustrate specific embodiments in which the invention can be practiced. While the illustrative embodiments of the invention have been described with particularity, it will be understood that various other modifications will be apparent to and can be readily made by those skilled in the art without departing from the spirit and scope of the invention. Accordingly, it is not intended that the scope of the claims appended hereto be limited to the examples and descriptions set forth herein but rather that the claims be construed as encompassing all the features of patentable novelty which reside in the present invention, including all features which would be treated as equivalents thereof by those skilled in the art to which the invention pertains. Therefore, the scope of the present invention is defined only by the appended claims, along with the full scope of equivalents to which such claims are entitled.

The improved elevator grip system introduces a new way of securing enclosed objects. The elevator grip system is capable of griping objects that have little to no shoulder and/or a variable exterior surface. Typically, the opposite of one or all of these conditions is required for a standard elevator assembly.

The elevator grip system is designed to be integrated into a standard elevator assembly and standard rotary slip. In an embodiment, the standard elevator assembly may have a custom bore cut to carry the elevator grip system, as described below.

Standard Elevator Assembly and Standard Rotary Slip

Figure 1:
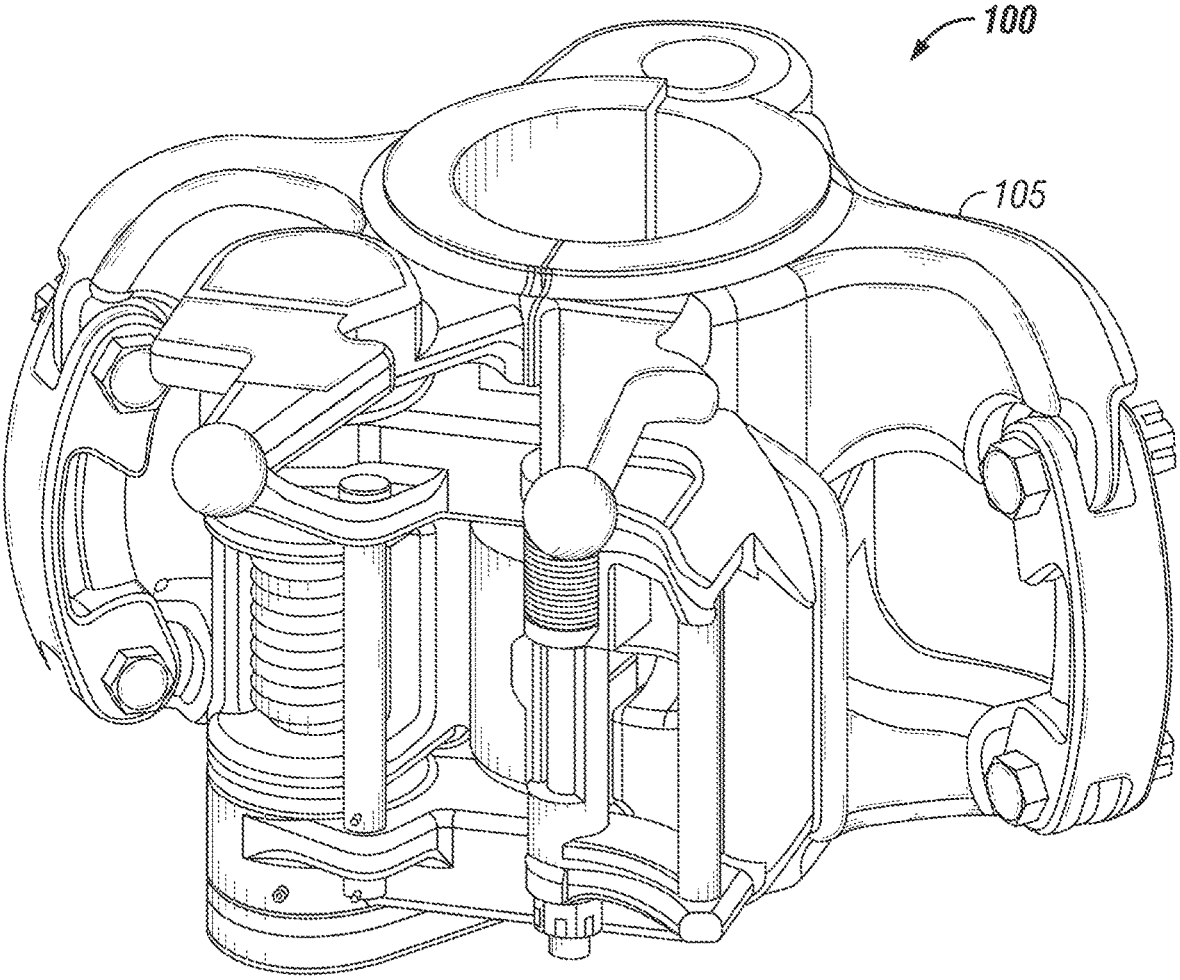
FIG. 1 PRIOR ART
FIG. 1 illustrates an upper, right perspective view of a standard elevator assembly, showing the standard elevator assembly in the closed position.
Figure 2:
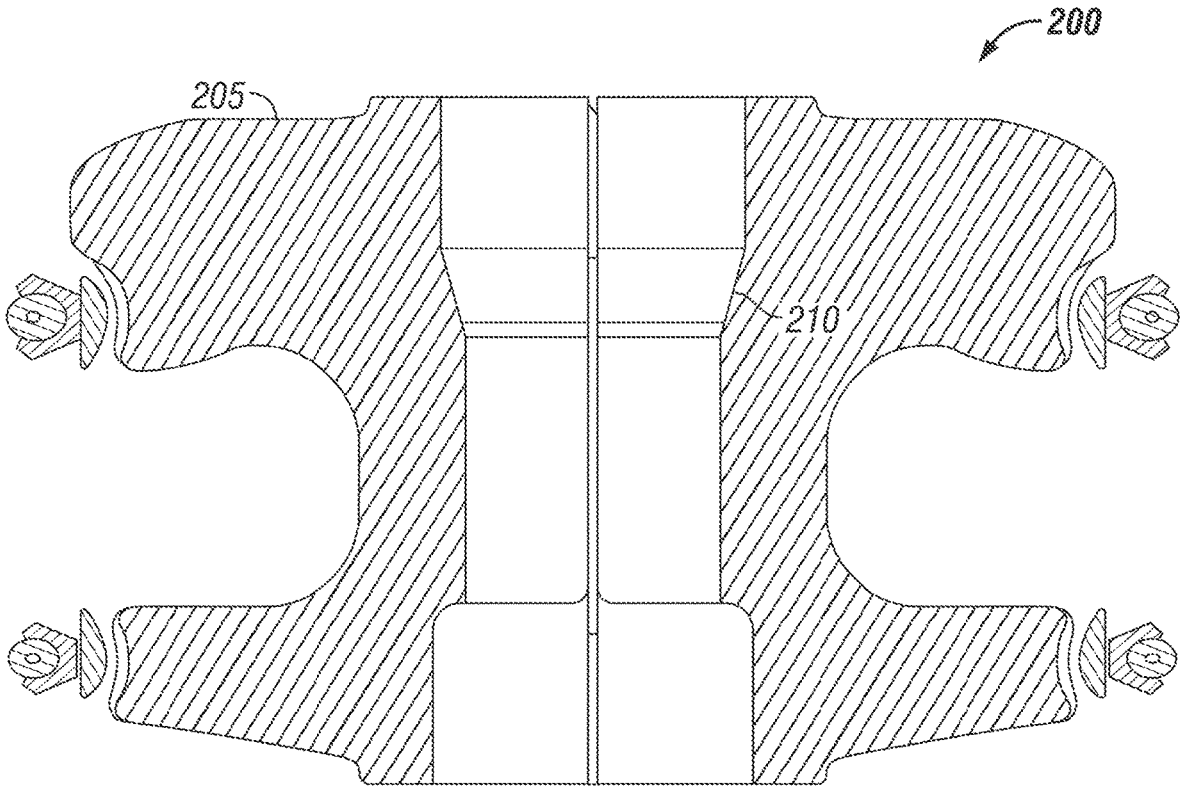
FIG. 2 PRIOR ART
FIG. 2 illustrates a cross-sectional view of a standard elevator assembly, showing a simple lifting face for the standard elevator assembly.
Figure 3:
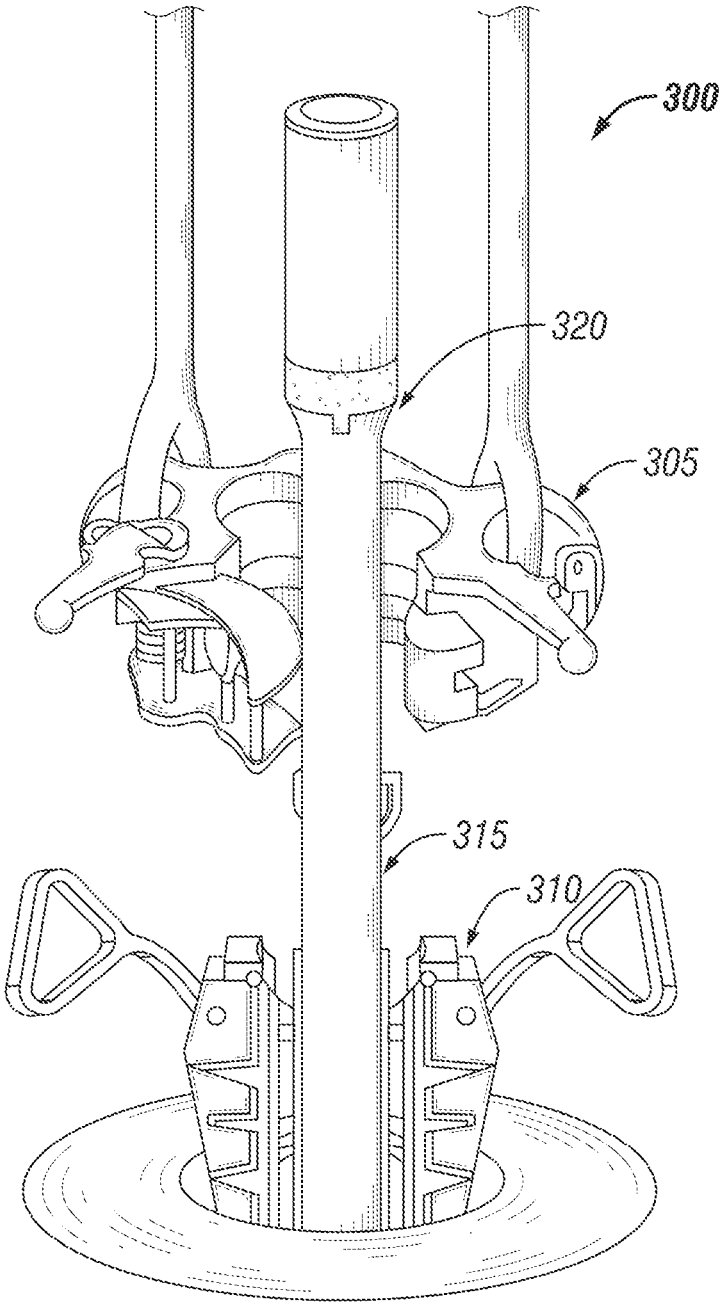
FIG. 3 PRIOR ART
FIG. 3 illustrates a front view of a standard elevator assembly and a standard rotary slip as used on a drilling rig floor, showing the standard elevator system in the open position.

FIG. 1 illustrates an upper, right perspective view of a standard elevator assembly 100, showing the standard elevator assembly 100 in the closed position; FIG. 2 illustrates a cross-sectional view of a standard elevator system 200, showing a simple lifting face 210 in the standard elevator system 200; and FIG. 3 illustrates a front view of a standard elevator assembly and a standard rotary slip as used on a drilling rig floor, showing the standard elevator system in the open position.

As shown in FIGS. 1-2, the standard elevator assembly 100, 200 has an elevator body 105, 205 and a lifting face 210. The elevator body 205 has a lifting face 210 bored to support a drill pipe shoulder 320 on a drill pipe 315. See e.g., FIG. 3.

As shown in FIG. 2, the standard elevator assembly 100, 200 would not be capable of griping objects that have little to no shoulder and/or a variable exterior surface due to the simple design of the lifting face 210.

The elevator grip system may be integrated into existing technology such as standard elevator assemblies and standard rotary slips. FIG. 3 illustrates a front view of a standard elevator assembly 305 and a standard rotary slip assembly 310 as used on a drilling rig floor 300, showing the standard elevator assembly 305 in the open position away from the drill pipe shoulder 320 and the standard rotary slip assembly 310 griping the drill pipe 315.

In an embodiment, the standard elevator assembly 100, 200, 305 may be any suitable lifting assembly. For example, a suitable standard elevator assembly 100, 200, 305 includes, but is not limited to, a drill pipe elevator assembly. In an embodiment, the standard elevator assembly 100, 200, 305 may be a Model RG-175 drill pipe elevator assembly from Forum Energy Technologies, Inc.

In an embodiment, the standard elevator assembly 100, 200, 305 may have any suitable lifting capacity. In an embodiment, the standard elevator assembly 100, 200, 305 may have a lifting capacity of about 175 tons.

In an embodiment, the standard elevator assembly 100, 200, 305 may have any suitable size. In an embodiment, the standard elevator assembly 100, 200, 305 may have a size capable of handling from about 2⅞ inch to about 6⅝ inch drill pipe, and any range or value there between.

For a standard elevator assembly 100, 200, 305 to retain its standard capacity rating (e.g., 175 tons), it cannot exceed a maximum allowable bore size for the elevator design and size.

In an embodiment, the standard rotary slip 310 may be any suitable slip.

In an embodiment, the standard rotary slip 310 may comprise an actuation means. In an embodiment, the actuation means may be any suitable actuation means to force the standard rotary slip 310 to engage the object 615 such as a pipe. For example, a suitable actuation means includes, but is not limited to, hydraulic actuation, manual actuation, mechanical actuation, pneumatic actuation, or combinations thereof.

Figure 12:
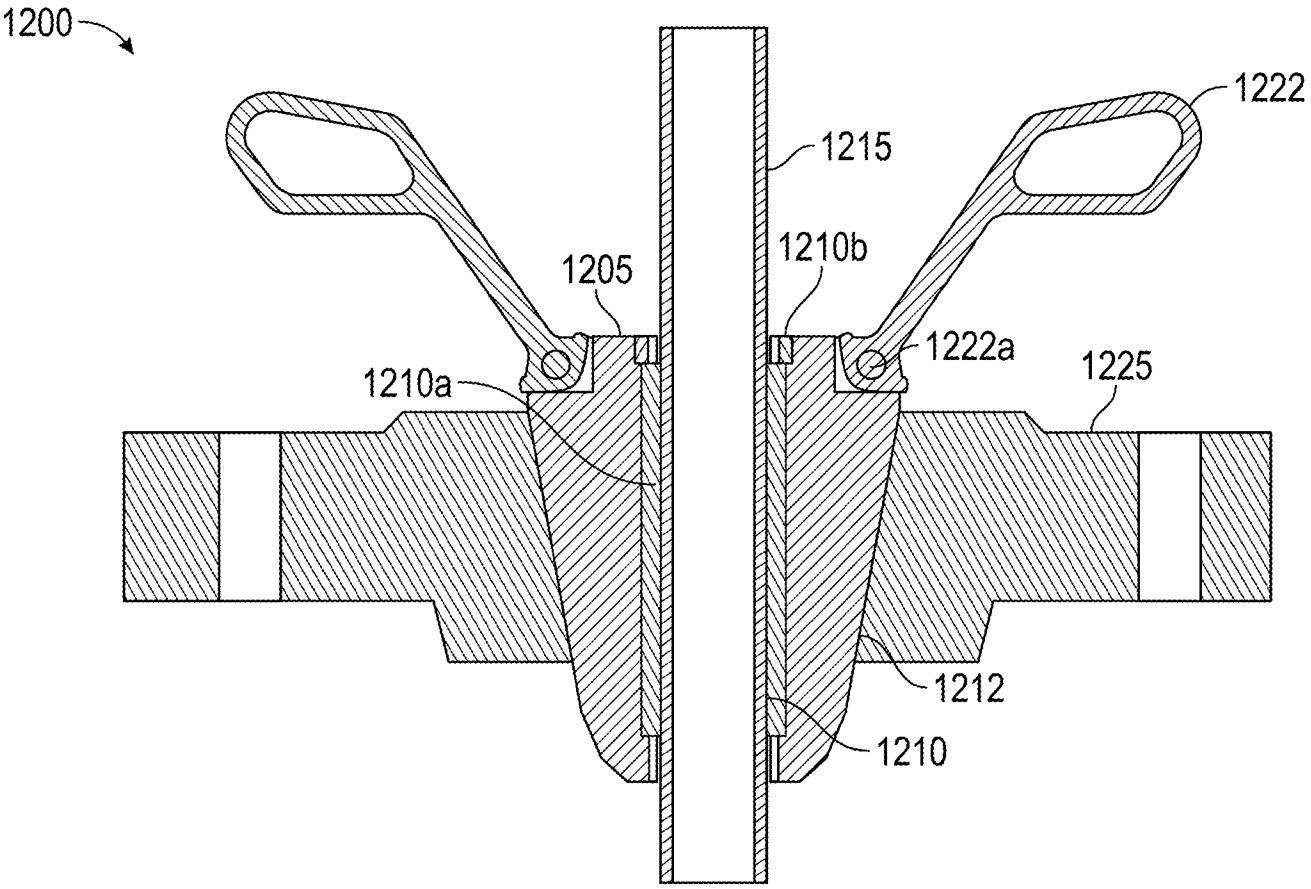
FIG. 12 illustrates a cross-sectional view of a standard rotary slip, showing the standard rotary slip in the closed position around a pipe.

FIG. 12 illustrates a cross-sectional view of a standard rotary slip 1200, showing the standard rotary slip 1200 in the closed position around a pipe 1215.

In an embodiment, the standard slip assembly 310, 1200 may be any suitable holding assembly. For example, a suitable standard rotary slip assembly 310, 1200 includes, but is not limited to, a drill pipe rotary slip assembly.

In an embodiment, the standard rotary slip assembly 310, 1200 may have any suitable holding capacity. In an embodiment, the standard rotary slip assembly 310, 1200 may have a holding capacity of about 175 tons.

In an embodiment, the standard rotary slip assembly 310, 1200 may have any suitable size. In an embodiment, the standard rotary slip assembly 310, 1200 may have a size capable of handling from about 2⅞ inch to about 6⅝ inch pipe, and any range or value there between.

For a standard rotary slip assembly 310, 1200 to retain its standard capacity rating (e.g., 175 tons), it cannot exceed a maximum allowable bore size for the rotary slip design and size.

In an embodiment, the standard rotary slip assembly 310, 1200, may have any number of body segments. For example, a suitable standard rotary slip assembly 310, 1200 may have two body segments, three body segments, four body segments or more. In an embodiment, the standard rotary slip assembly 310, 1200 has two body segments. See e.g., FIGS. 3 & 12: 1205*a* & 1205*b*.

As shown in FIG. 12, the standard rotary slip assembly 1200 has a slip body 1205 having a first holding face 1210 and a handle 1222. See e.g., FIGS. 13: 1322 & 1322*a* & 14: 1422 & 1422*a*, 15: 1522 & 1522*a*.

The slip body 1205 has a first holding face 1210 machined to support a pipe 315, 1215. See e.g., FIG. 3. In an embodiment, the first holding face 1210 may have a textured insert 1210*a*. In an embodiment, the textured insert 1210*a* may be abrasive. The textured inset 1210*a* may be held in place via a retaining ring 1210*b*.

The slip body 1205 has a second holding face 1212 machined to rest on a bore of the drilling rig floor 1225. In an embodiment, the slip body 1205 has a second holding face 1212 machined to match a bore of the drilling rig flor 1225 or vice versa.

The slip body 1205 has a handle 1222 attached via a fastener 1222*a* to allow operators to easily handle the slip tool. See e.g., FIGS. 13: 1322 & 1322*a* & 14: 1422 & 1422*a*, 15: 1522 & 1522*a*. The slip body 1205 may have a pivoting handle 1222 attached via a fastener 1222*a* to allow operators to more easily handle the slip tool. Id.

The rotary slip grip system 1300, 1400, 1500 may be integrated into existing technology such as standard elevator assemblies and standard rotary slips. See e.g., FIGS. 13-15. FIG. 3 illustrates a front view of a standard elevator assembly 305 and a standard rotary slip assembly 310 as used on a drilling rig floor 300, showing the standard elevator assembly 305 in the open position away from the drill pipe shoulder 320 and the standard rotary slip assembly 310 griping the drill pipe 315.

In an embodiment, the standard elevator assembly 305 may be any suitable elevator.

In an embodiment, the standard rotary slip assembly 310, 1200 may comprise an actuation means. In an embodiment, the actuation means may be any suitable actuation means to force the standard rotary slip assembly 310, 1200 to engage the object 615 such as a pipe. For example, a suitable actuation means includes, but is not limited to, hydraulic actuation, manual actuation, mechanical actuation, pneumatic actuation, or combinations thereof.

Exemplary Elevator Grip System

Figure 4A:
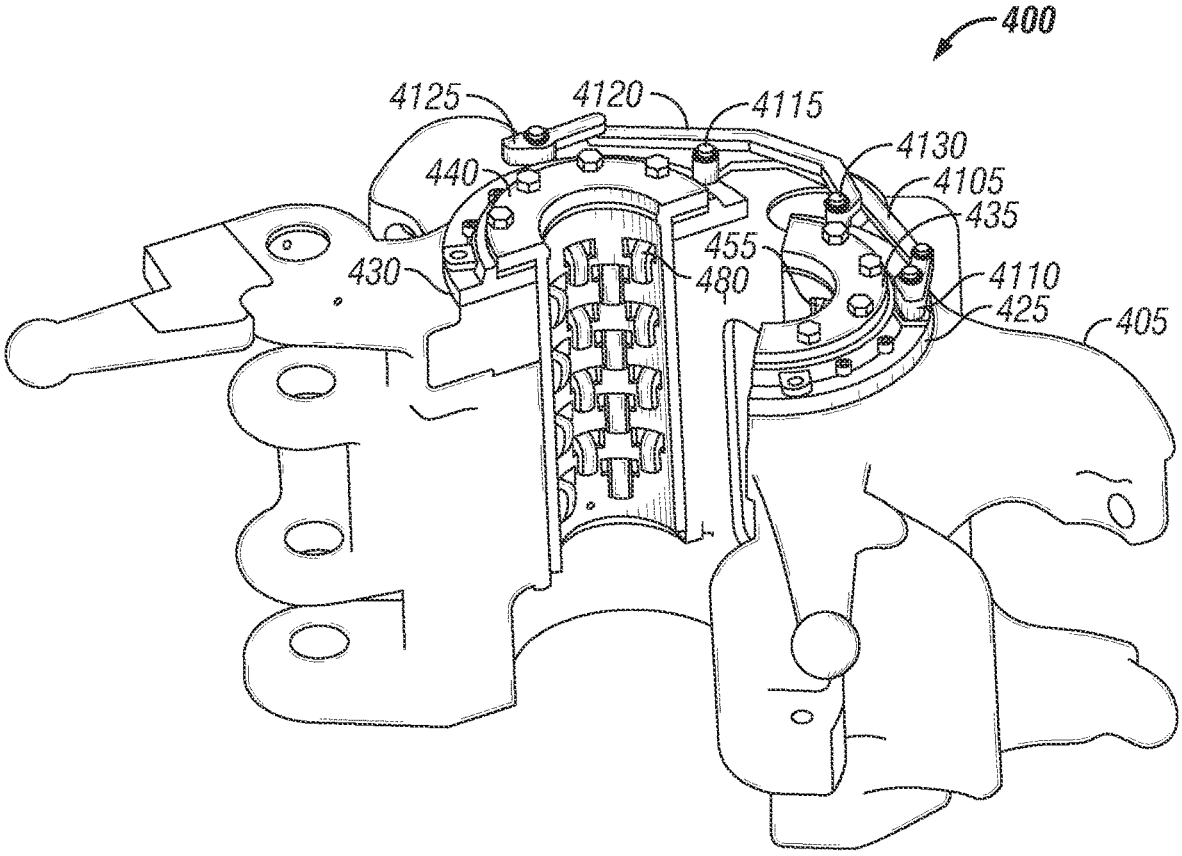
FIG. 4A illustrates an upper, front perspective view of an elevator grip system, showing the elevator grip system in the open position.
Figure 4B:
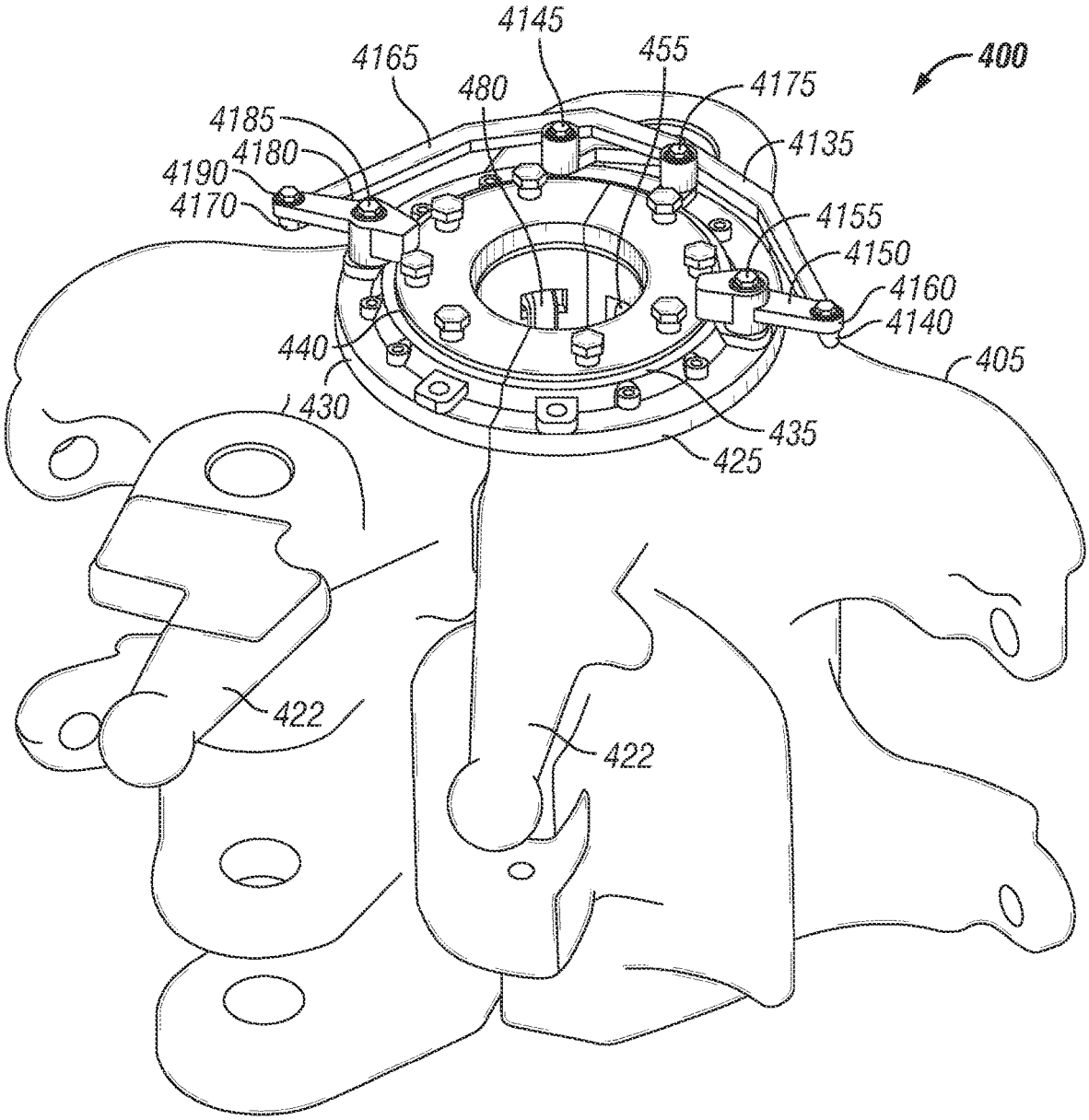
FIG. 4B illustrates an upper, front perspective view of the elevator grip system of FIG. 4A, showing the elevator grip system in the closed position.
Figure 4C:
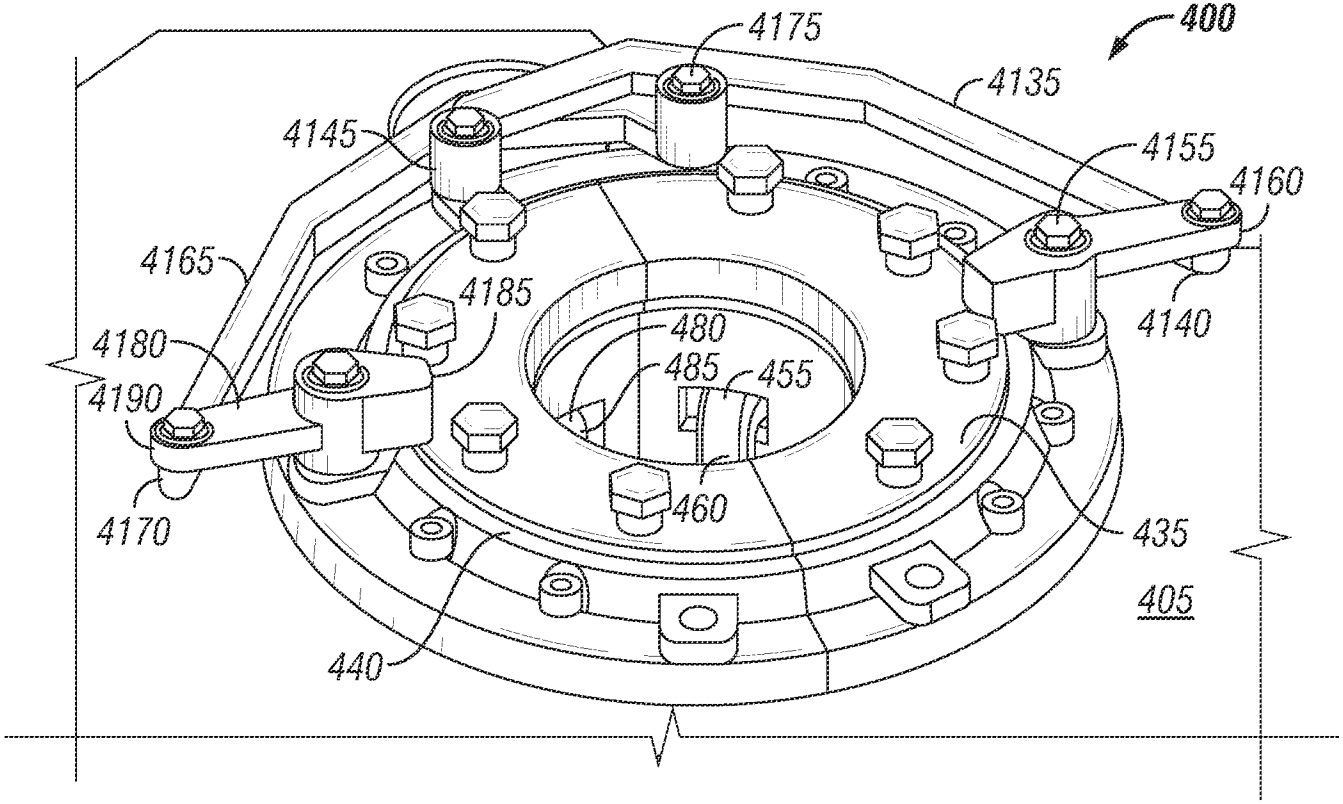
FIG. 4C illustrates a detailed view of the elevator grip system of FIG. 4B, showing a cage in the closed position.

FIG. 4A illustrates an upper, front perspective view of an elevator grip system 400, showing the elevator grip system 400 in the open position; FIG. 4B illustrates an upper, front perspective view of the elevator grip system 400 of FIG. 4A, showing the elevator grip system 400 in the closed position; and FIG. 4C illustrates a detailed view of the elevator grip system 400 of FIG. 4C, showing a dog cage 435, 440 in the closed position.

Figure 5A:
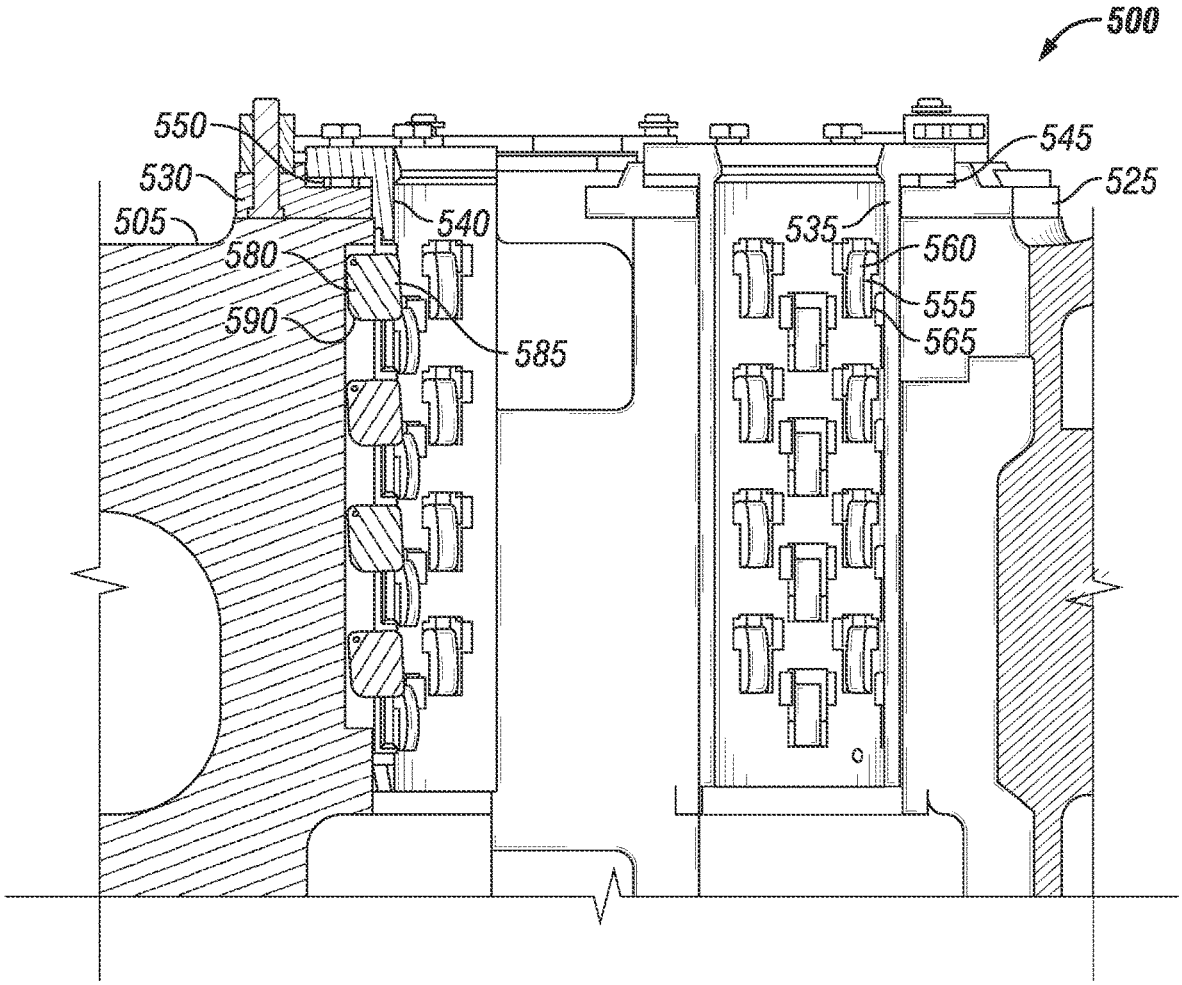
FIG. 5A illustrates a cross-sectional view of an elevator grip system, showing the elevator grip system in the open position.
Figure 5B:
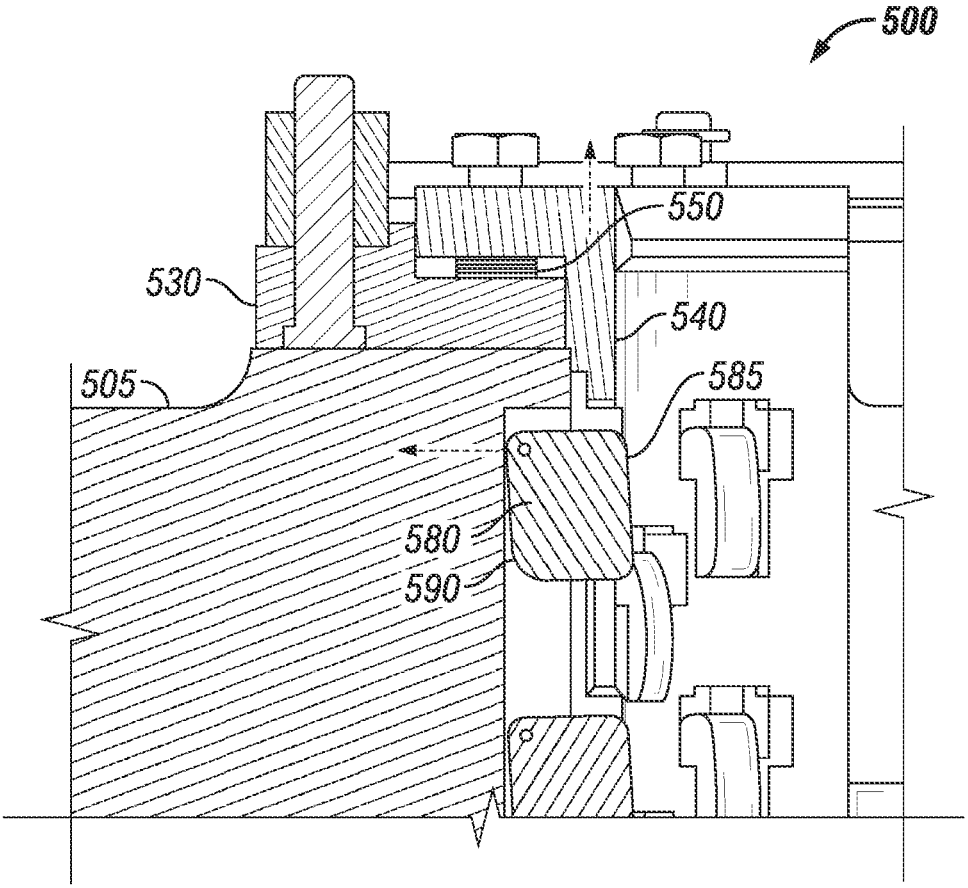
FIG. 5B illustrates a detailed view of the elevator grip system in FIG. 5A, showing the elevator grip system with locking dogs in a mechanically retracted position.

FIG. 5A illustrates a cross-sectional view of an elevator grip system 500, showing the elevator grip system 500 in the open position; and FIG. 5B illustrates a detailed view of the elevator grip system 500 in FIG. 5A, showing the elevator grip system 500 with a plurality of locking dogs 555, 580 in a mechanically retracted position.

Figure 6A:
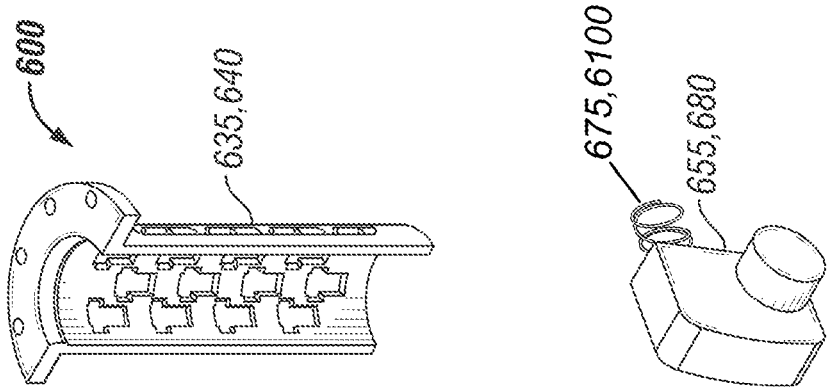
FIG. 6A illustrates an upper, front view of an elevator grip system, showing the elevator grip system in the open position around a pipe.
Figure 6A:
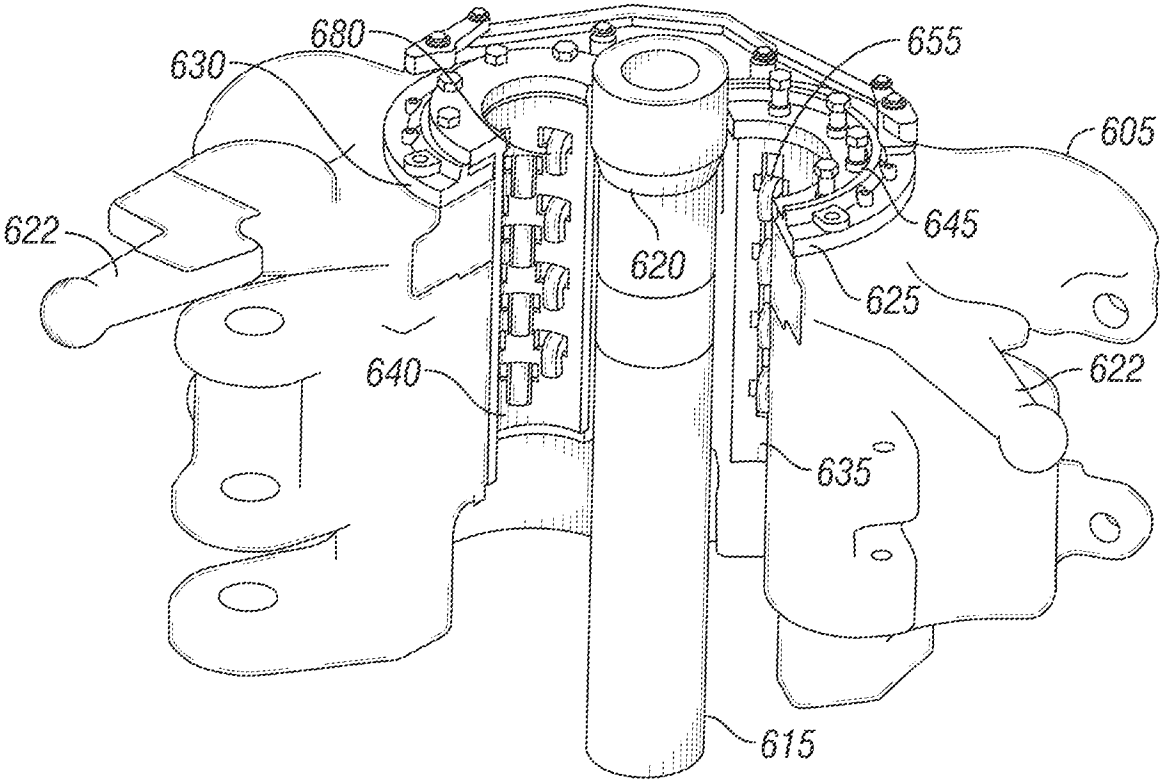
Figure 6B:
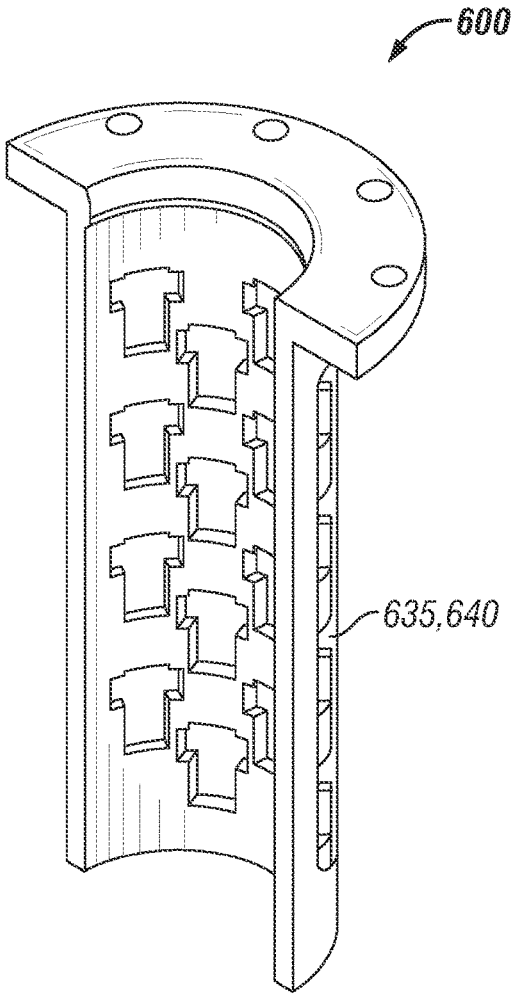
FIG. 6B illustrates a detailed view of the elevator grip system of FIG. 6A, showing a dog cage.
Figure 6C:
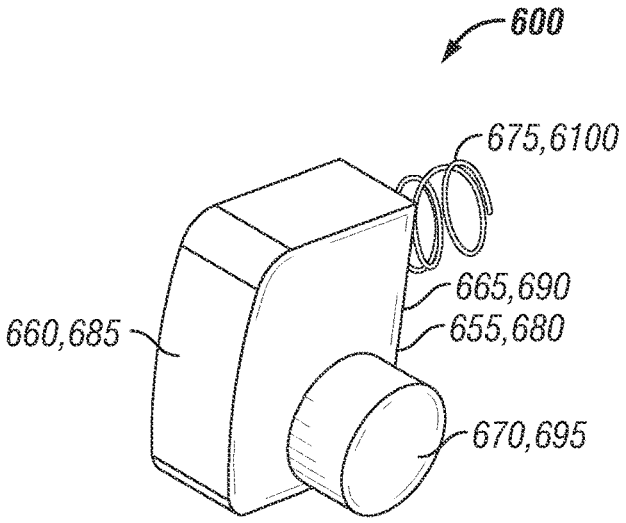
FIG. 6C illustrates a detailed view of the elevator grip system of FIG. 6A, showing a locking dog with a compression spring.

FIG. 6A illustrates an upper, front view of an elevator grip system 600, showing the elevator grip system 600 in the open position around an object such as a pipe 615; FIG. 6B illustrates a detailed view of the elevator grip system 600 of FIG. 6A, showing a dog cage 635, 640; and FIG. 6C illustrates a detailed view of the elevator grip system 600 of FIG. 6A, showing one of the plurality of locking dogs 655, 680 with a compression spring 675, 6100.

As shown in FIGS. 4A-6C, the elevator grip system 400, 500, 600 is designed to be integrated into a standard elevator assembly 100, 200. In an embodiment, the standard elevator assembly 100, 200 may have a custom bore cut to carry and mount the elevator grip system 400, 500, 600.

In an embodiment, the elevator grip system 400, 500, 600 comprises a cage spacer 425, 430, 525, 530, 625, 630, a dog cage 435, 440, 535, 540, 635, 640 movably attached to the elevator body 425, 430, 525, 530, 625, 630 and vertically positioned by the cage spacer 425, 430, 525, 530, 625, 630, a locking dog 455, 480, 555, 580, 655, 680 and a linking means 4105, 4120.

In an embodiment, the elevator grip system 400, 500, 600 comprises a first cage spacer 425, a second cage spacer 430, a first dog cage 435 movably attached to the elevator body 400 and vertically positioned by the first cage spacer 425, a second dog cage 440 movably attached to the elevator body 400 and vertically positioned by the second cage spacer 430, a first locking dog 455, a second locking dog 480, a first linking means 4105 having a first end 4110 and a second end 4115, and a second linking means 4120 having a first end 4125 and a second end 4130.

In an embodiment, the elevator grip system 400, 500, 600 comprises a first cage spacer 425, a second cage spacer 430, a first dog cage 435 movably attached to the elevator body 400 and vertically positioned by the first cage spacer 425, a second dog cage 440 movably attached to the elevator body 400 and vertically positioned by the second cage spacer 430, a first locking dog 455, a second locking dog 480, a first push rod 4135, a first lever arm 4150, a second push rod 4165 and a second lever arm 4180.

Cage Spacer

In an embodiment, the cage spacer 425, 430, 525, 530, 625, 630 elevates the dog cage 435, 440, 535, 540, 635, 640 from an assembly position to an operational position.

In an embodiment, the cage spacer 425, 430, 525, 530, 625, 630 may be fixedly attached to the slip body 405, 505, 605 via a fastener.

In an embodiment, the cage spacer 425, 430, 525, 530, 625, 630 may be any suitable shape. For example, a suitable shape includes, but is not limited to, a half-ring shape, a ring shape, or combinations or variations thereof.

In an embodiment, the cage spacer 425, 430, 525, 530, 625, 630 may have a half-ring or ring shape. In an embodiment, the half-ring or ring shape may have a central, upper lip to retain, for example the dog cage 435, 440, 535, 540, 635, 640. See e.g., FIG. 6A.

In an embodiment, the cage spacer 425, 430, 525, 530, 625, 630 may be constructed of any suitable material. For example, a suitable material includes, but is not limited to, any alloy steel. In an embodiment, the cage spacer 425, 430, 525, 530, 625, 630 may be constructed of an alloy steel. In an embodiment, the cage spacer 425, 430, 525, 530, 625, 630 may be constructed of an American Iron and Steel Institute (AISI) 4000 Series alloy steel or equivalent material.

Dog Cage

In an embodiment, the dog cage 435, 440, 535, 540, 635, 640 may be movably attached to the elevator body 405, 505, 605 via a first fastener and a spacer on top and via a second fastener through a vertical slotted port on a lower interior bore of the elevator body 405, 505, 605. In an embodiment, the first fasteners and the second fasteners act as slide shafts. In an embodiment, the dog cage 435, 440, 535, 540, 635, 640 may be affixed to the elevator body 405, 505, 605 by tightening the each of first fasteners to the elevator body 405, 505, 605 against its respective spacer.

In an embodiment, the dog cage 435, 440, 535, 540, 635, 640 may be a means of containing and properly seating each of the plurality of locking dogs 455, 480, 555, 580, 655, 680, retracting each of the plurality of locking dogs 455, 480, 555, 580, 655, 680 from engagement, as well as allowing each of the plurality of locking dogs 455, 480, 555, 580, 655, 680 to be inserted and removed from the elevator body 405, 505, 605.

In an embodiment, the dog cage 435, 440, 535, 540, 635, 640 may have two primary positions which are dictated by the cage spacer 425, 430, 525, 530, 625, 630. Without the cage spacer 425, 430, 525, 530, 625, 630 installed, the dog cage 435, 440, 535, 540, 635, 640 may be inserted vertically into the elevator body 405, 505, 605, aligning the plurality of openings in the dog cage 435, 440, 535, 540, 635, 640 with the plurality of seats in the elevator body 400, 500, 600 so that the plurality of locking dogs 455, 480, 555, 580, 655, 680 may be inserted into their seats. When the cage spacer 425, 430, 525, 530, 625, 630 is installed, the plurality of openings in the dog cage 435, 440, 535, 540, 635, 640 cannot be aligned with the plurality of seats in the elevator body 405, 505, 605, containing each of the plurality of locking dogs 455, 480, 555, 580, 655, 680 in its seat.

In an embodiment, the dog cage 435, 440, 535, 540, 635, 640 holds each of the plurality of locking dogs 455, 480, 555, 580, 655, 680 in each of their plurality of seats in the elevator body 405, 505, 605.

In an embodiment, the dog cage 435, 440, 535, 540, 635, 640 guides the plurality of locking dogs 455, 480, 555, 580 655, 680 to engage an object 615 such as a pipe when the elevator grip system 400, 500, 600 is in a closed position. In an embodiment, the dog cage 435, 440, 535, 540, 635, 640 guides the plurality of locking dogs 455, 480, 555, 580, 655, 680 to disengage the object 615 such as the pipe when the elevator grip system 400, 500, 600 is in the open position.

In an embodiment, the object 615 may be any suitable object to be lifted. For example, a suitable object 615, includes, but is not limited to an object with a shoulder, an object having little to no shoulder, an object having an irregular exterior surface, or combinations thereof. In an embodiment, the object 615 may be a pipe having a shoulder. In an embodiment, the object 615 may be a pipe having little to no shoulder. In an embodiment, the object 615 may have an irregular exterior surface.

In an embodiment, the dog cage 435, 440, 535, 540, 635, 640 may be any suitable shape. For example, a suitable shape includes, but is not limited to, a half-cylinder shape, a cylinder shape, or combinations or variations thereof.

In an embodiment, the dog cage 435, 440, 535, 540, 635, 640 may have a half-cylinder or cylinder shape. In an embodiment, the half-cylinder or cylinder shape may have an upper lip to mount the dog cage 435, 440, 535, 540, 635, 640 to, for example, the elevator body 405, 505, 605.

In an embodiment, the dog cage 435, 440, 535, 540, 635, 640 may have a plurality of openings shaped so that the plurality of locking dogs 455, 480, 555, 580, 655, 680 may engage an object 615 such as a pipe through the plurality of openings in the dog cage 435, 440, 535, 540, 635, 640 and may disengage the object 615 by retracting through the plurality of openings.

In an embodiment, each of the plurality of openings may be any suitable shape. For example, a suitable shape includes, but is not limited to, an inverted "T" shape, a "T" shape or any other shape such that a front surface 460, 485, 560, 585, 660, 685 of each of the plurality of locking dogs 455, 480, 555, 580, 655, 680 or a portion of each of the plurality of locking dogs 455, 480, 555, 580, 655, 680 may be disposed through each of the plurality of openings to engage an object 615 such as a pipe.

In an embodiment, the dog cage 435, 440, 535, 540, 635, 640 may be made of any suitable material. For example, a suitable material includes, but is not limited to, any alloy steel. In an embodiment, the dog cage 435, 440, 535, 540, 635, 640 may be constructed of an alloy steel. In an embodiment, the dog cage 435, 440, 535, 540, 635, 640 may be constructed of an AISI 4000 Series alloy steel or equivalent material.

Cage Return Springs

In an embodiment, the elevator grip system 400, 500, 600 further comprises a plurality of cage return springs 445, 450, 545, 550, 645, 650 disposed between the cage spacer 425, 430, 525, 530, 625, 630 and the dog cage 435, 440, 535, 540, 635, 640.

In an embodiment, the plurality of cage return springs 445, 450, 545, 550, 645, 650 force the dog cage 435, 440, 535, 540, 635, 640 upwards when the elevator grip system 400, 500, 600 is in the open position. In an embodiment, the plurality of cage return springs 445, 450, 545, 550, 645, 650 force the dog cage 435, 440, 535, 540, 635, 640 upwards when the linking means 4105, 4120 or lever arms 4150, 4180 rotate away from the dog cage 435, 440, 535, 540, 635, 640 in the open position.

In an embodiment, each of the plurality of cage return springs 445, 450, 545, 550, 645, 650 may be constructed of any suitable material. For example, a suitable material includes, but is not limited to, any spring steel.

Locking Dogs

In an embodiment, the locking dogs 455, 480, 555, 580, 655, 680 engage an object 615 such as a pipe, and wedge and hold the object 615 to be lifted.

In an embodiment, the locking dogs 455, 480, 555, 580, 655, 680 may be any suitable shape. For example, a suitable shape includes, but is not limited to, a cubic shape, a cuboid shape, a cylinder shape, a square pyramid shape, a trapezoidal prism shape, a triangular prism shape, or combinations or variations thereof. In an embodiment, the locking dogs 455, 480, 555, 580, 655, 680 may have a cuboid shape. See e.g., FIGS. 6A & 6C.

In an embodiment, each of the plurality of locking dogs 455, 480, 555, 580, 655, 680 may have a front surface 460, 485, 560, 585, 660, 685 and a back surface 465, 490, 565, 590, 665, 690. In an embodiment, the front surface 460, 485, 560, 585, 660, 685 may be abrasive.

In an embodiment, each of the plurality of locking dogs 455, 480, 555, 580, 655, 680 may have an extension 470, 495, 670, 695 on each side. Id. In an embodiment, each of the plurality of locking dogs 455, 480, 555, 580, 655, 680 may have a cylindrical extension 470, 495, 670, 695 on each side. Id.

In an embodiment, each of the plurality of locking dogs 455, 480, 555, 580, 655, 680 may be made of any suitable material. For example, a suitable material includes, but is not limited to, any alloy steel, carburizing alloy steel or tool steel. In an embodiment, each of the plurality of locking dogs 455, 480, 555, 580, 655, 680 may be constructed of an alloy steel. In an embodiment, each of the plurality of locking dogs 455, 480, 555, 580, 655, 680 may be constructed of a carburizing alloy steel. In an embodiment, each of the plurality of locking dogs 455, 480, 555, 580, 655, 680 may be constructed of an AISI 8620 carburizing alloy steel material or equivalent.

In an embodiment, each of the plurality of locking dogs 455, 480, 555, 580, 655, 680 may have a hardened coating to reduce wear of the lifting surfaces. For example, a suitable hardened coating includes, but is not limited to, any Carbide coating or equivalent coating. In an embodiment, each of the plurality of locking dogs 455, 480, 555, 580, 655, 680 may have a Carbide coating with about 6% Cobalt binder or equivalent material.

Actuation Means for Locking Dogs

In an embodiment, the elevator grip system 400, 500, 600 further comprises an actuation means to force the locking dogs 455, 480, 555, 580, 655, 680 to engage an object 615 and to hold tension on the object 615 to be lifted.

In an embodiment, the actuation means may be any suitable actuation means to force the locking dogs 455, 480, 555, 580, 655, 680 to engage an object 615 such as a pipe. For example, a suitable actuation means includes, but is not limited to, hydraulic actuation, manual actuation, mechanical actuation, pneumatic actuation, or combinations thereof.

In an embodiment, the actuation means may be manual actuation to force the locking dogs 455, 480, 555, 580, 655, 680 to engage an object 615 and to hold tension on the object 615 to be lifted.

In an embodiment, the actuation means may be mechanical actuation (e.g., compression spring) to force the locking dogs 455, 480, 555, 580, 655, 680 to engage an object 615 and to hold tension on the object 615 to be lifted.

In an embodiment, the actuation means may be pneumatic actuation (e.g., compressed gas) to force the locking dogs 455, 480, 555, 580, 655, 680 to engage an object 615 and to hold tension on the object 615 to be lifted.

In an embodiment, the actuation means may be hydraulic actuation (e.g., hydraulic fluid) to force the locking dogs 455, 480, 555, 580, 655, 680 to engage an object 615 and to hold tension on the object 615 to be lifted.

Compression Springs for Locking Dogs

In an embodiment, the elevator grip system 400, 500, 600 further comprises a compression spring 675, 6100 disposed between each of the plurality of locking dogs 455, 480, 555, 580, 655, 680 and the elevator body 405, 505, 605. In an embodiment, the elevator grip system 400, 500, 600 further comprises a compression spring 675, 6100 disposed between each of the plurality of locking dogs 455, 480, 555, 580, 655, 680 and each of the plurality of seats in the elevator body 405, 505, 605.

In an embodiment, each of the plurality of locking dogs 455, 480, 555, 580, 655, 680 comprises a compression spring 675, 6100 having a first end and a second end. In an embodiment, each of the plurality of locking dogs 455, 480, 555, 580, 655, 680 comprises a compression spring 675, 6100 having a first end and a second end, wherein the first end of the compression spring 675, 6100 is attached to the back surface 465, 490, 665, 690 of the locking dogs 455, 480, 555, 580, 655, 680.

In an embodiment, the compression springs 675, 6100 force the locking dogs 455, 480, 555, 580, 655, 680 to engage an object 615 and to hold tension on the object 615 to be lifted.

In an embodiment, the compression spring 675, 6100 may be any suitable spring.

In an embodiment, the compression spring 675, 6100 may be constructed of any suitable material. For example, a suitable material includes, but is not limited to, any spring steel.

Linking Means

In an embodiment, the linking means 4105, 4120 pivots as the elevator grip system 400, 500, 600 transitions from the open position to the closed position to compress and close the dog cage 435, 440, 535, 540, 635, 640 around an object 615 to be lifted.

In an embodiment, the linking means 4105, 4120 pivots as the elevator grip system 400, 500, 600 transitions from the closed position to the open position to decompress and open the dog cage 435, 440, 535, 540, 635, 640.

In an embodiment, the first linking means 4105 has a first end 4110 and a second end 4115.

In an embodiment, the first end 4110 of the first linking means 4105 may be movably attached to the first cage spacer 425, 525, 626. In an embodiment, the second end 4115 of the linking means 4105 may be movably attached to the second cage spacer 430, 530, 630.

In an embodiment, the second end 4115 of the first linking means 4105 may be adapted to force the dog cage 435, 440, 535, 540, 635, 640 downward when the elevator grip system 400, 500, 600 is in a closed position.

In an embodiment, the second linking means 4120 has a first end 4125 and a second end 4130.

In an embodiment, the first end 4125 of the second linking means 4120 may be movably attached to the second cage spacer 430, 530, 630. In an embodiment, the second end 4130 of the second linking means 4120 may be movably attached the first cage spacer 425, 525, 625.

In an embodiment, the second end 4125 of the second linking means 4120 may be adapted to force the dog cage 435, 440, 535, 540, 625, 640 downward when the elevator grip system 400, 500, 600 is in a closed position.

In an embodiment, the linking means 4105, 4120 may be made of any suitable material. For example, a suitable material includes, but is not limited to, any alloy steel. In an embodiment, the linking means 4105, 4120 may be constructed of an alloy steel. In an embodiment, the linking means 4105, 4120 may be constructed of an AISI 4000 Series alloy steel or equivalent material.

Lever Arms and Push Rods

In an embodiment, the first push rod 4135 has a first end 4140 and a second end 4145. In an embodiment, the first lever arm 4150 has a first end 4155 and a second end 4160.

In an embodiment, the first end 4140 of the first push rod 4135 may be movably attached to the first cage spacer 425, 525, 625. In an embodiment, the second end 4160 of the first push rod 4135 may be movably attached to the first end 4155 of the first lever arm 4150.

In an embodiment, the second end 4160 of the first lever arm 4150 may be movably attached to the second cage spacer 430, 530, 630.

In an embodiment, the second end 4160 of the first lever arm 4150 may be adapted to force the dog cage 435, 440, 535, 540, 635, 640 downward when the elevator grip system 400, 500, 600 is in a closed position.

In an embodiment, the second push rod 4165 has a first end 4170 and a second end 4175. In an embodiment, the second lever arm 4180 has a first end 4185 and a second end 4190.

In an embodiment, the first end 4175 of the second push rod 4165 may be movably attached to the second cage spacer 430, 530, 630. In an embodiment, the second end 4175 of the second push rod 4165 may be movably attached to the first end 4185 of the second lever arm 4180.

In an embodiment, the second end 4190 of the second lever arm 4180 may be movably attached to the first cage spacer 425. 525, 625.

In an embodiment, the second end 4190 of the second lever arm 4180 may be adapted to force the dog cage 435, 440, 535, 540, 635, 640 downward when the elevator grip system 400, 500 is in a closed position.

In an embodiment, the push rods 4135, 4165 and lever arms 4150, 4180 may be made of any suitable material. For example, a suitable material includes, but is not limited to, any alloy steel. In an embodiment, the push rods 4135, 4165 and/or lever arms 4150, 4180 may be constructed of an alloy steel. In an embodiment, the push rods 4135, 4165 and/or lever arms 4150, 4180 may be constructed of an AISI 4000 Series alloy steel or equivalent material.

Figure 7A:
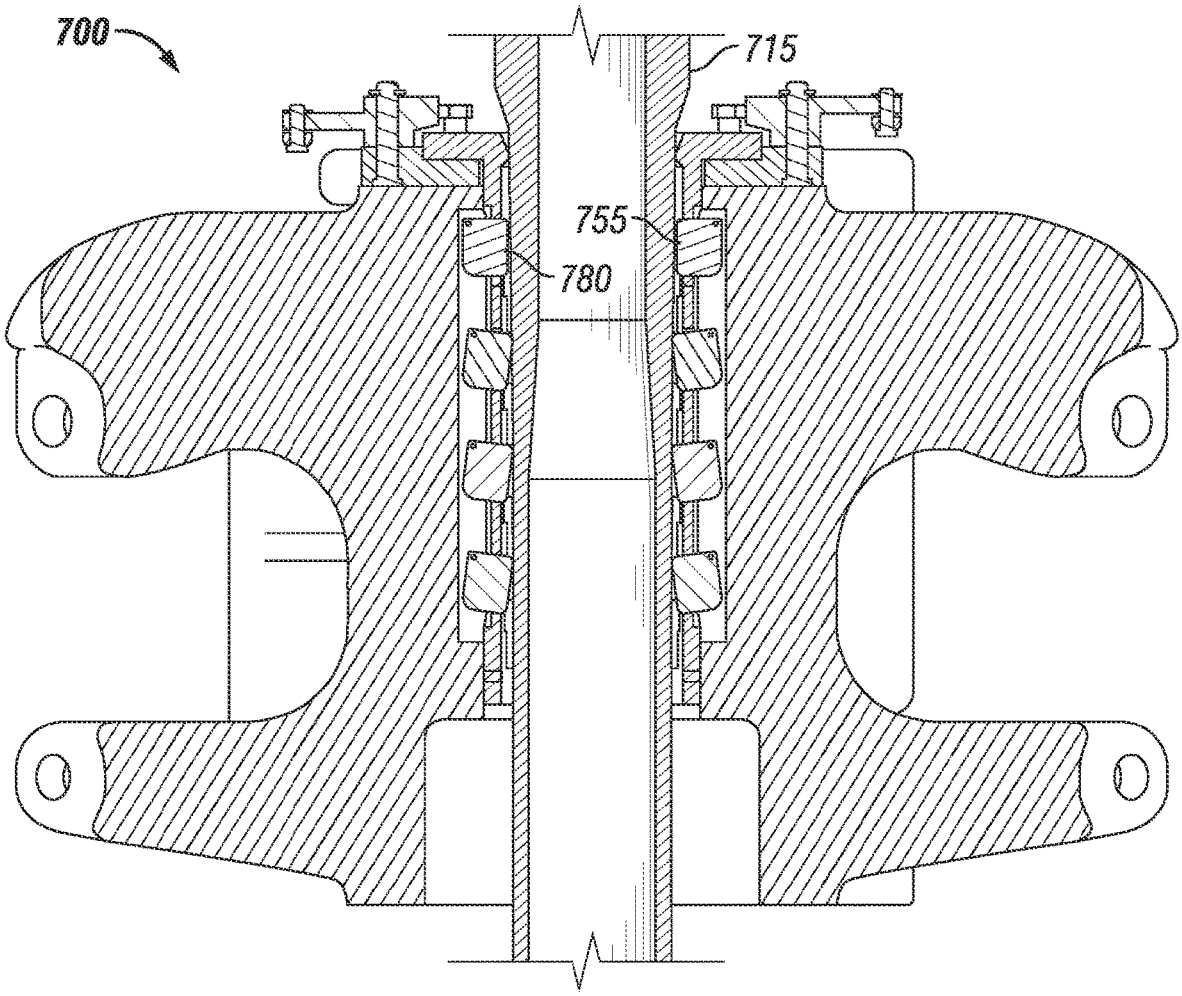
FIG. 7A illustrates a cross-sectional view of an elevator grip system, showing the elevator grip system in a closed position.
Figure 7B:
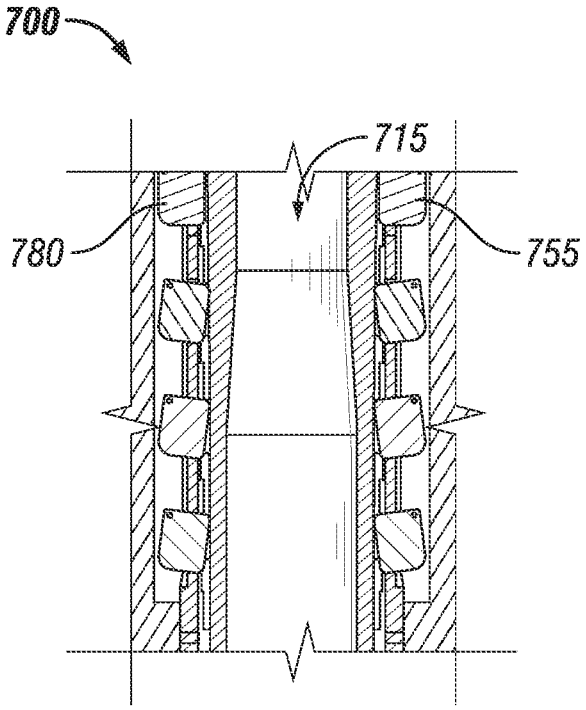
FIG. 7B illustrates a detailed view of the elevator grip system of FIG. 7A, showing the elevator grip system in the closed position with locking dogs in a mechanically engaged position around a non-uniform pipe.

FIG. 7A illustrates a cross-sectional view of an elevator grip system 700, showing the elevator grip system 700 in a closed position; and FIG. 7B illustrates a detailed view of the elevator grip system 700 of FIG. 7A, showing the elevator grip system 700 in the closed position with locking dogs 755, 780 in a mechanically engaged position around a non-uniform pipe 715.

Figure 8A:
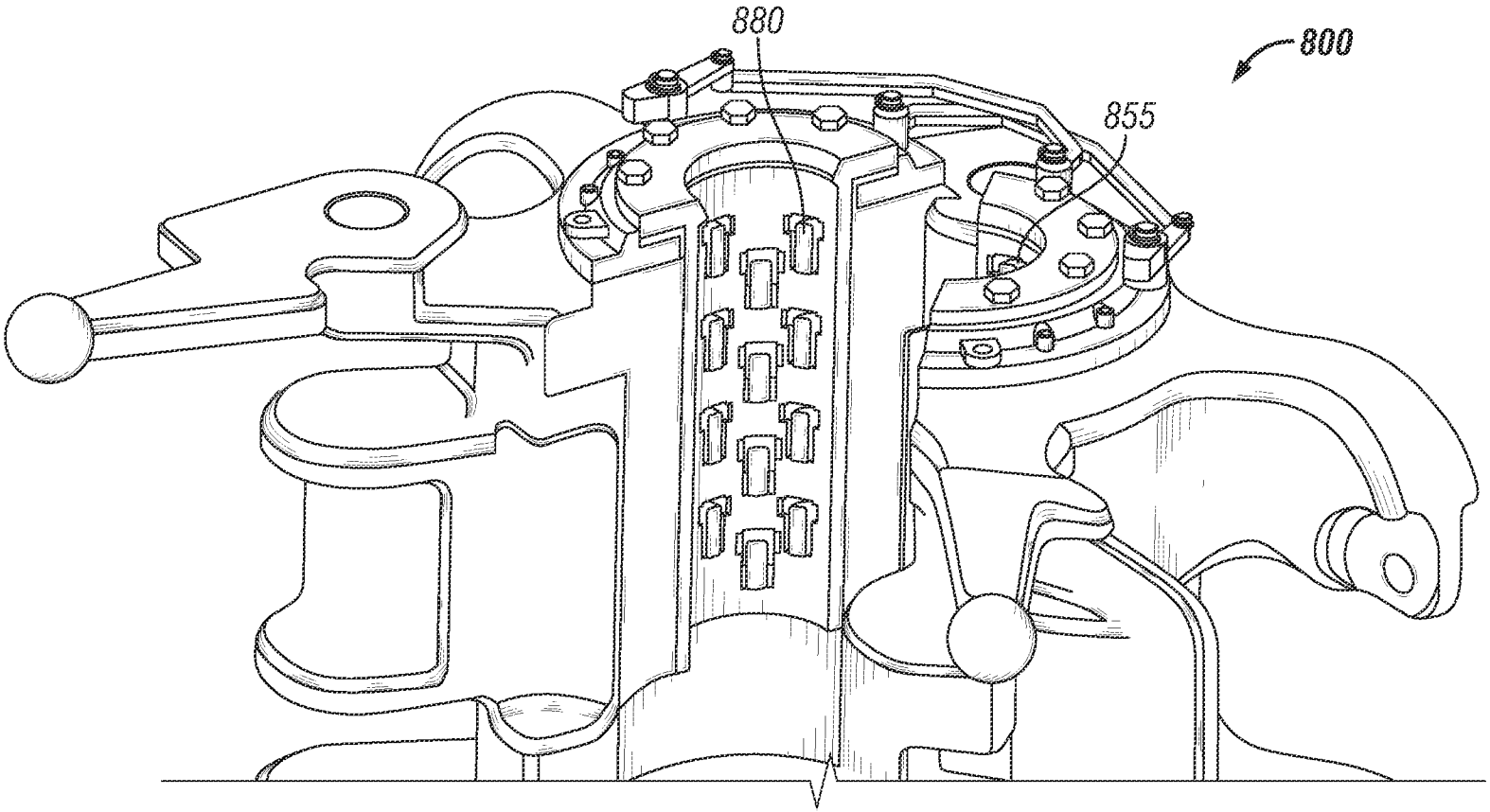
FIG. 8A illustrates an upper, front perspective view of an elevator grip system, showing the elevator grip system in an open position with locking dogs in a mechanically retracted position.
Figure 8B:
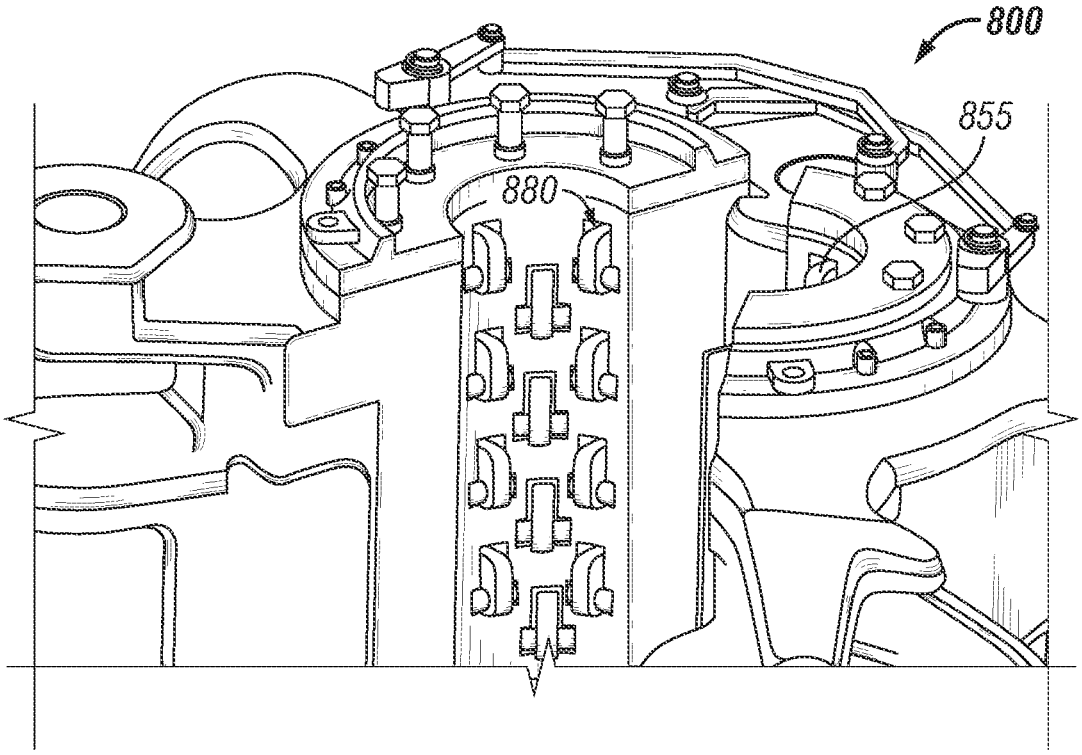
FIG. 8B illustrates an upper, front, perspective view the elevator grip system of FIG. 8A, showing the elevator grip system in the open position with the locking dogs in a mechanically retracted position.
Figure 8C:
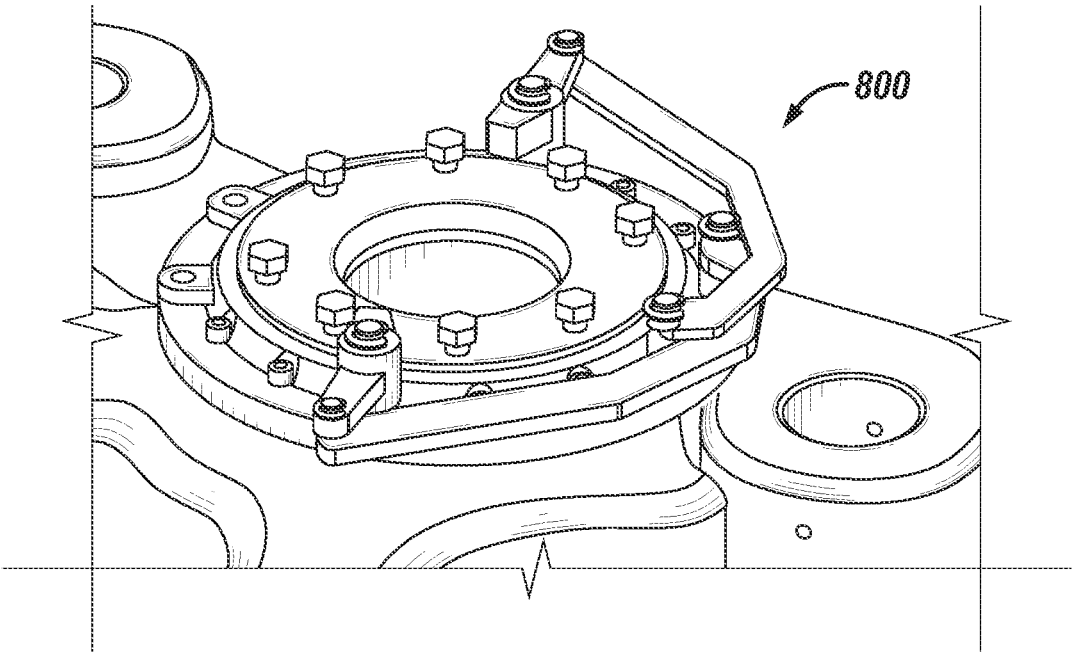
FIG. 8C illustrates an upper, rear perspective view of the elevator grip system of FIGS. 8A-8B, showing the elevator grip system in a closed position.

FIG. 8A illustrates an upper, front perspective view of an elevator grip system 800, showing the elevator grip system 800 in an open position with locking dogs 855, 880 in a mechanically retracted position; FIG. 8B illustrates an upper, front perspective view the elevator grip system of FIG. 8A, showing the elevator grip system 800 in the open position with the locking dogs 855, 880 in a mechanically engaged position; and FIG. 8C illustrates an upper, rear isometric view of the elevator grip system 800 of FIGS. 8A-8B, showing the elevator grip system 800 in a closed position. In FIG. 8B, the dog cage 435, 440, 535, 540, 635, 640 has been removed to show the locking dogs 855, 880 in their seats.

In an embodiment, the elevator grip system 800 may have a plurality of locking dogs 855, 880. In an embodiment, the elevator grip system 800 may have from about 30 to 100 locking dogs 855, 880, and any range or value there between. In an embodiment, the elevator grip system 800 may have 40 locking dogs 855, 880.

Figure 9A:
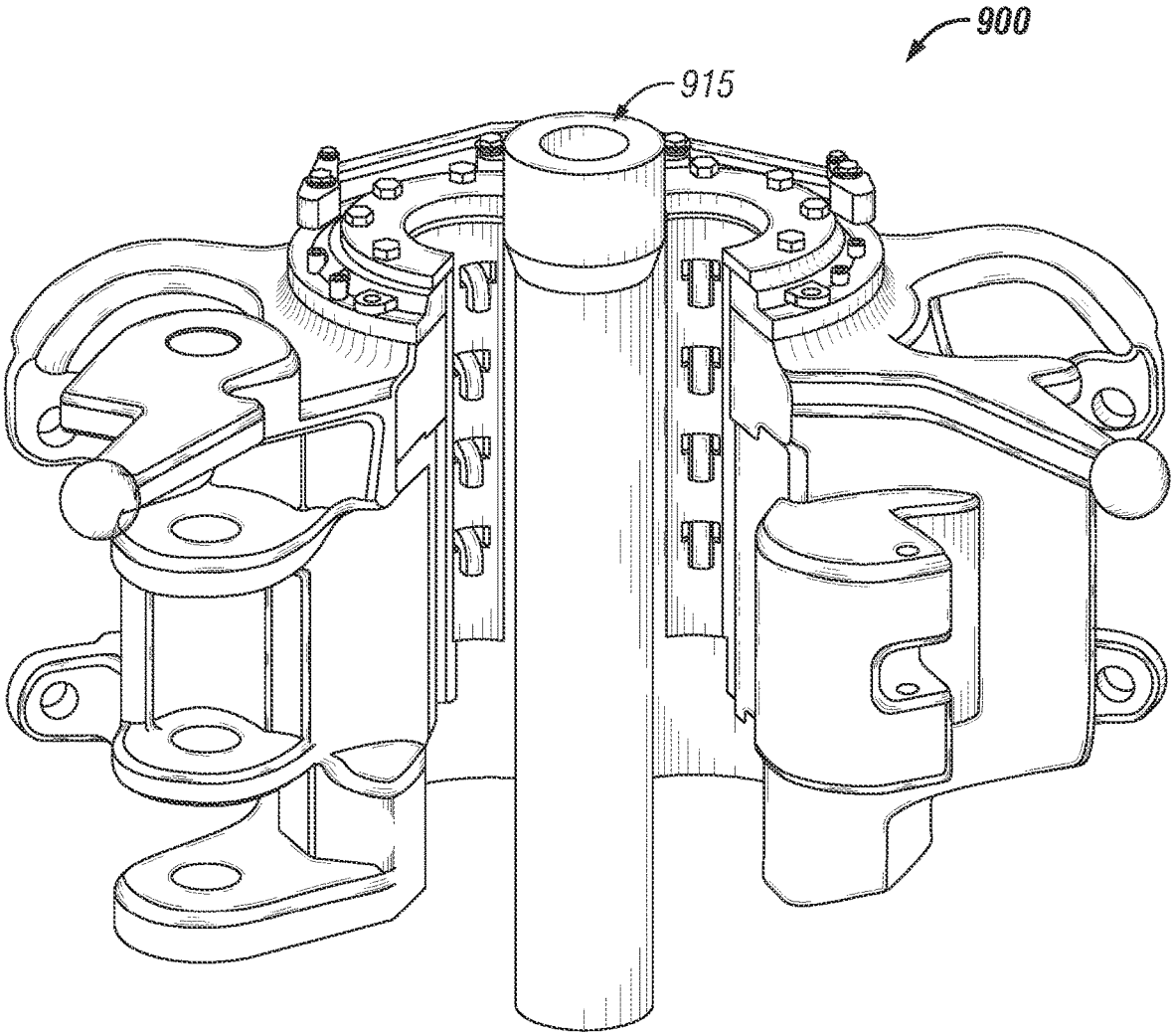
FIG. 9A illustrates a front view of an elevator grip system, showing the elevator grip system in an open position around a pipe.
Figure 9B:
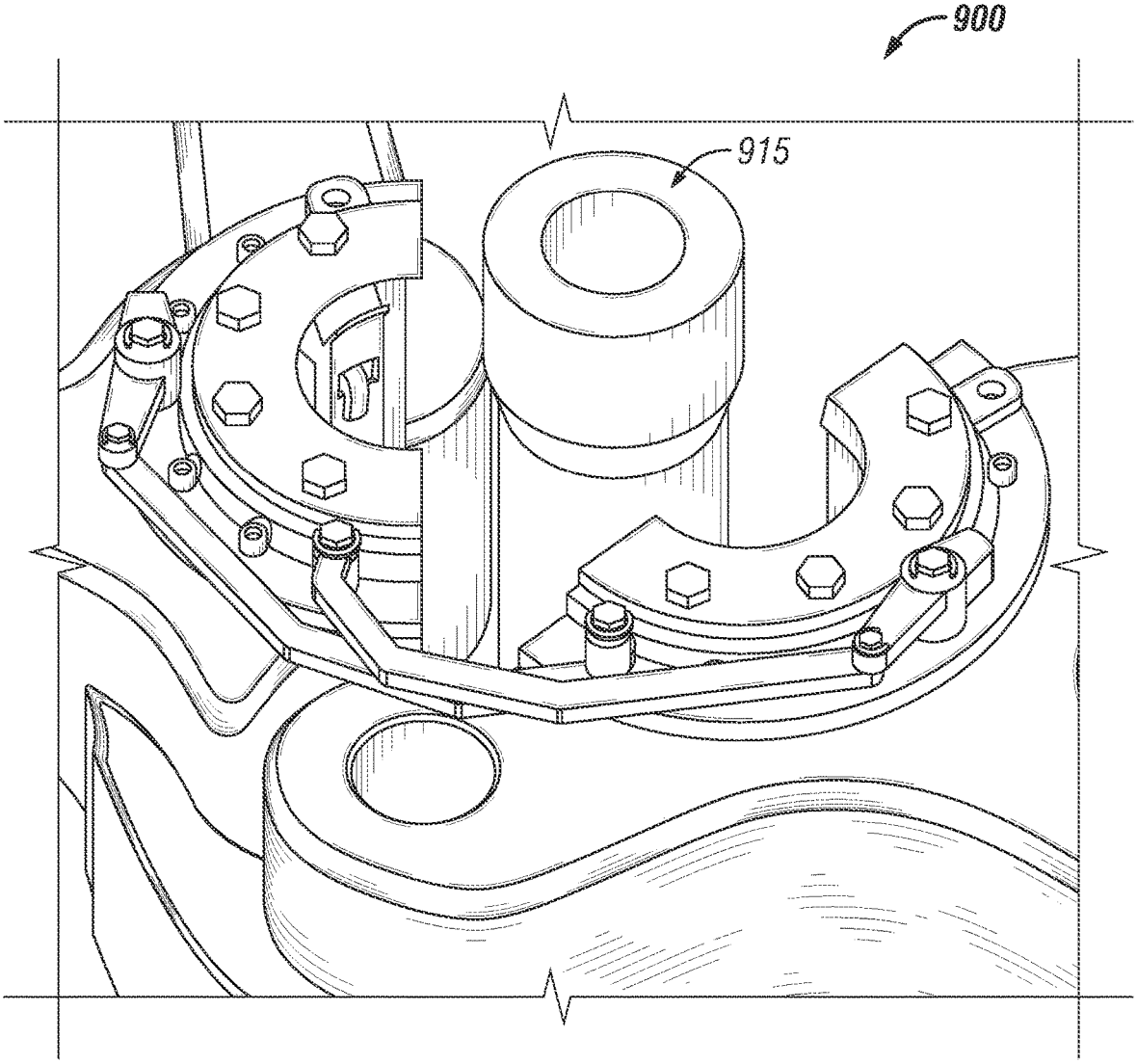
FIG. 9B illustrates an upper, rear perspective view of the elevator grip system of FIG. 9A, showing the elevator grip system in the open position around the pipe.
Figure 9C:
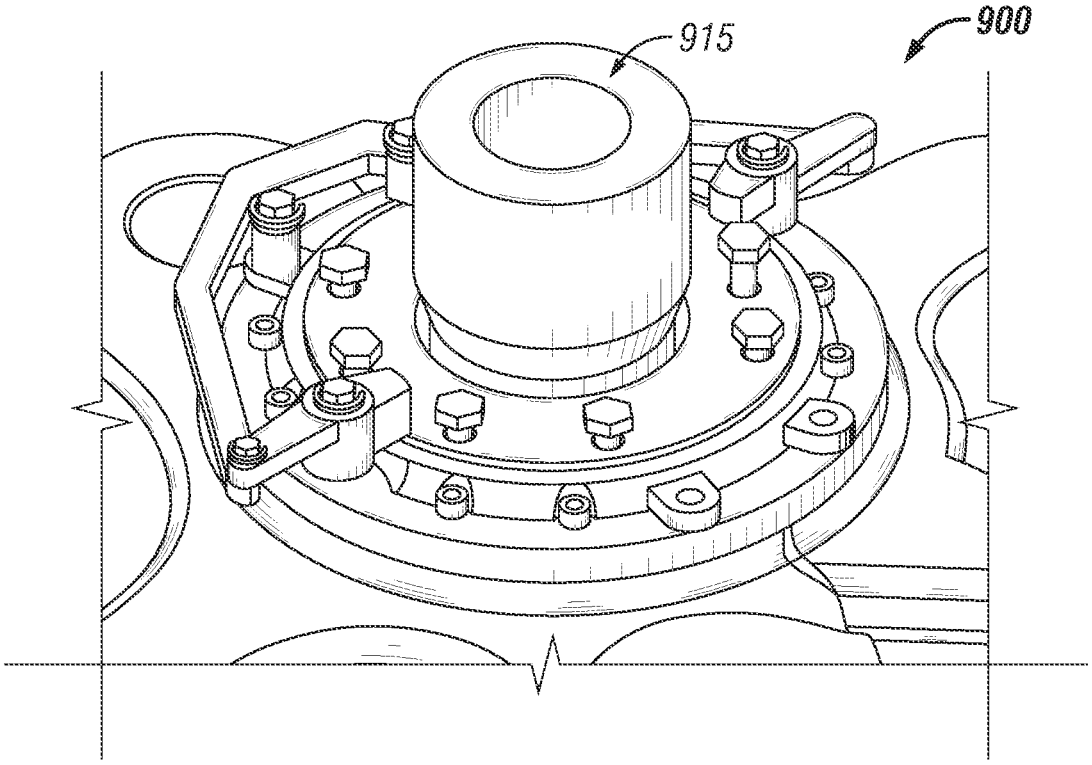
FIG. 9C illustrates an upper, left side perspective view of the elevator grip system of FIGS. 9A-9B, showing the elevator grip system in a closed position around the pipe.
Figure 9D:
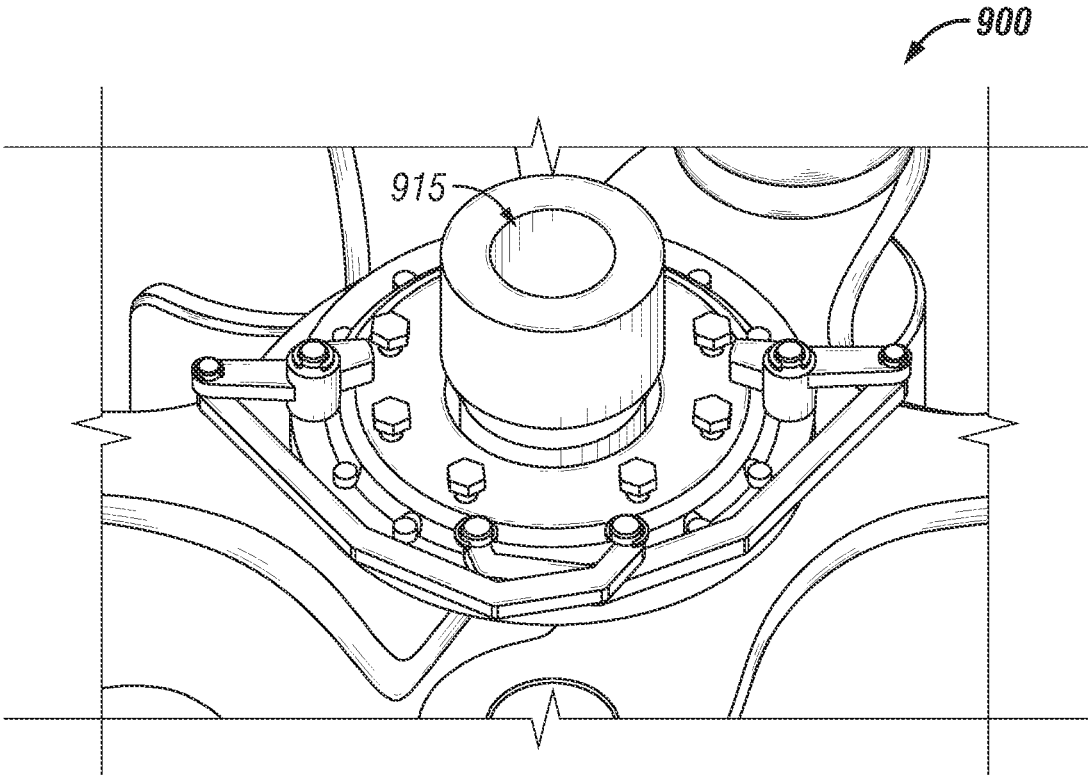
FIG. 9D illustrates an upper, rear perspective view of the elevator grip system of FIGS. 9A-9C, showing the elevator grip system in a closed position around the pipe.

FIG. 9A illustrates a front view of an elevator grip system 900, showing the elevator grip system 900 in an open position around a pipe 915; FIG. 9B illustrates an upper, rear perspective view of the elevator grip system 900 of FIG. 9A, showing the elevator grip system 900 in the open position around the pipe 915; FIG. 9C illustrates an upper, left side perspective view of the elevator grip system 900 of FIGS. 9A-9B, showing the elevator grip system 900 in a closed position around the pipe 915; and FIG. 9D illustrates an upper, rear perspective view of the elevator grip system 900 of FIGS. 9A-9C, showing the elevator grip system 900 in a closed position around the pipe 915.

Figure 10:
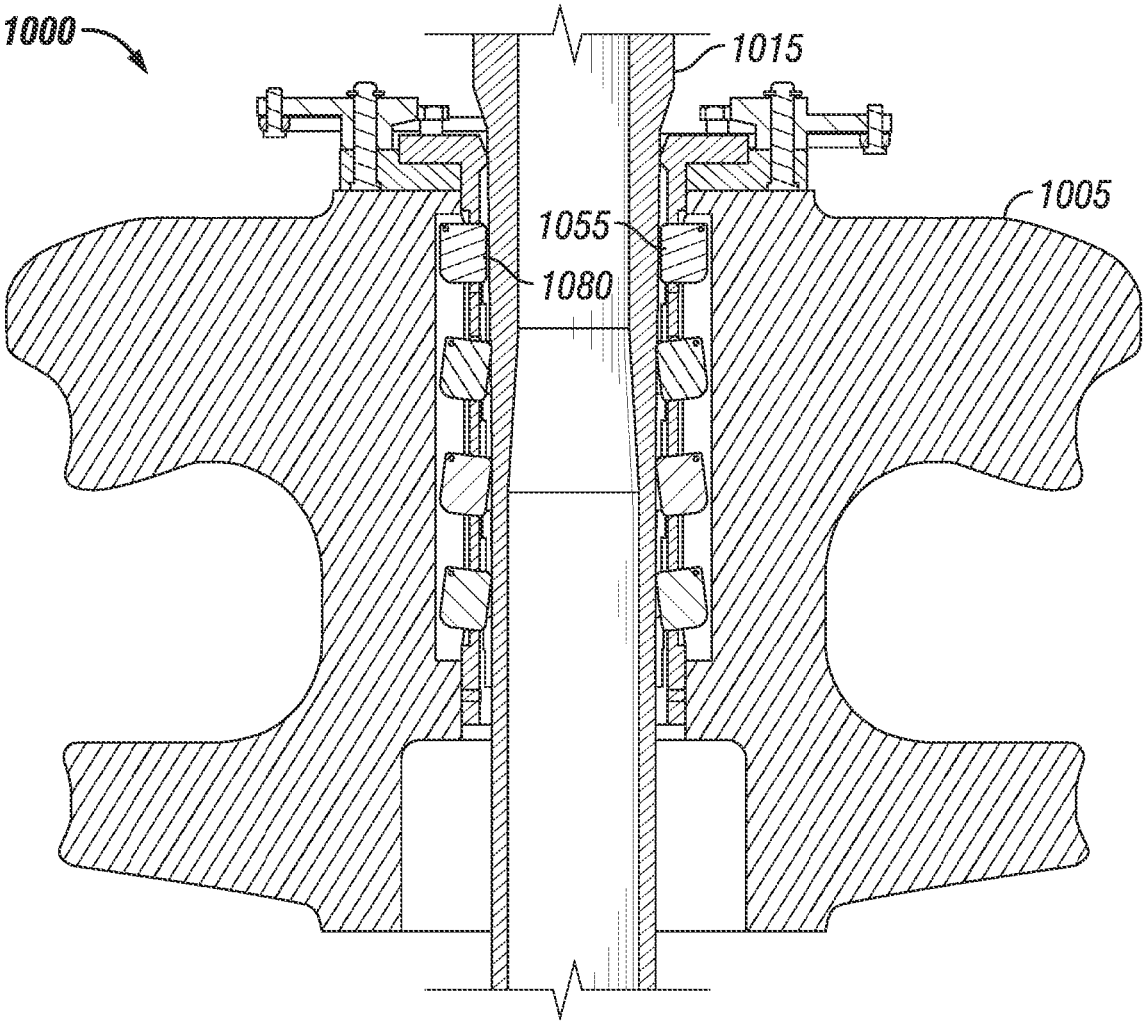
FIG. 10 illustrates a cross-sectional view of an elevator grip system, showing the elevator grip system in a closed position with locking dogs mechanically engaged around a non-uniform pipe.

FIG. 10 illustrates a cross-sectional view of an elevator grip system 1000, showing the elevator grip system 1000 in a closed position with locking dogs 1055, 1080 mechanically engaged around a non-uniform pipe 1015.

Handle for Elevator Body

In an embodiment, the elevator grip system 400, 500, 600 further comprises a handle 422, 622 to force the elevator body 405, 505, 605 to open and/or close.

In an embodiment, the actuation means 422, 622 may be any suitable handle to force the elevator body 405, 505, 605 to open and/or close. For example, a suitable handles includes, but is not limited to, an extension (e.g., ear), a protrusion (e.g., peg) and combinations thereof.

Method of Using Elevator Grip System

Figure 11A:
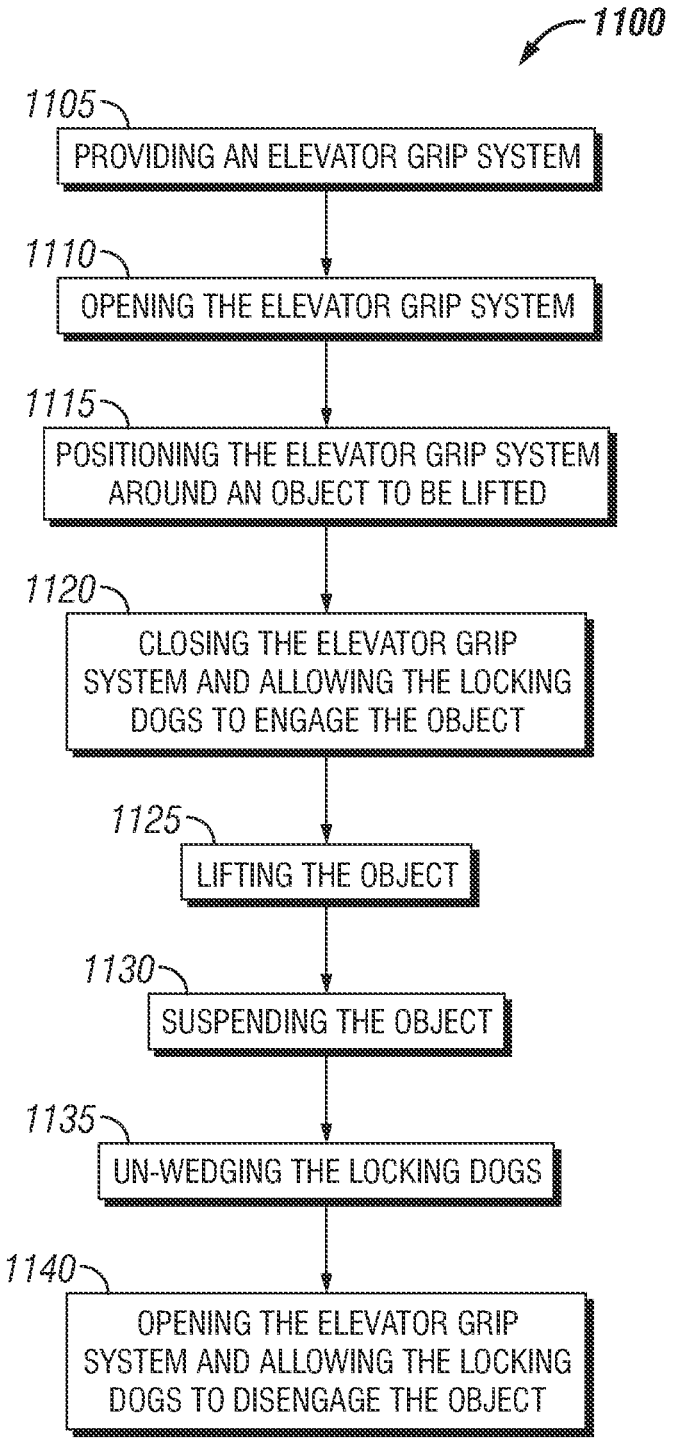
FIG. 11A illustrates a flow chart for a method of using an elevator grip system.
Figure 11B:
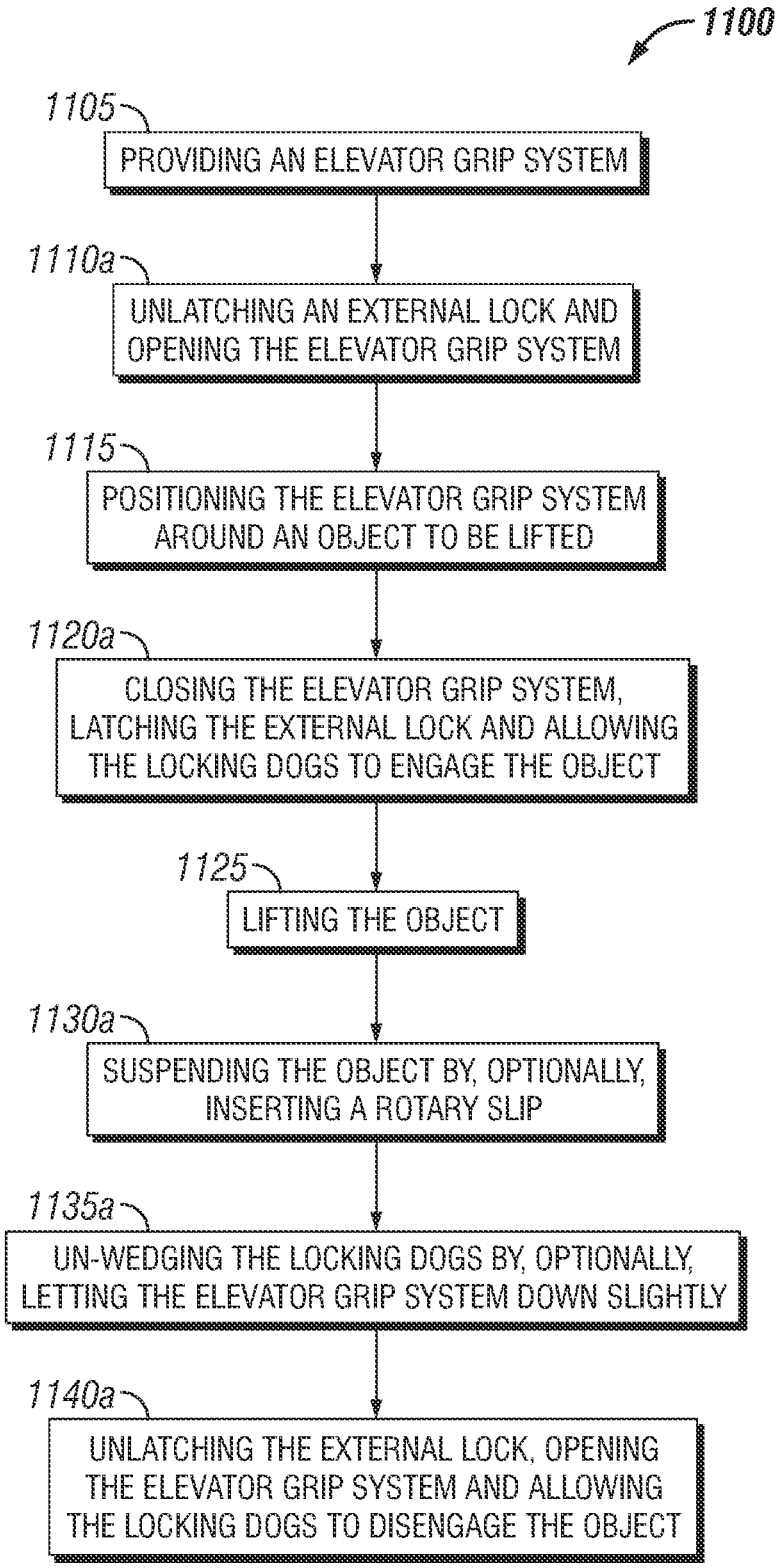
FIG. 11B illustrates optional steps for the method of FIG. 11A.

FIG. 11A illustrates a method of using an elevator grip system; and FIG. 11B illustrates optional steps for the method of FIG. 11A.

In an embodiment, a method of using an elevator grip system comprises (a) providing the elevator grip system as discussed above 1105; (b) opening the elevator grip system 1110; (c) positioning the open elevator grip system around an object to be lifted 1115; and (d) closing the elevator grip system and allowing the locking dogs to engage the object 1120.

In an embodiment, step (b) comprises, optionally, unlatching an external lock and opening the elevator grip system 1110*a*.

In an embodiment, step (d) comprises closing the elevator grip system, optionally, latching the external lock and allowing the locking dogs to engage the object 1120*a*.

In an embodiment, the method further comprises (e) lifting the object 1125.

In an embodiment, the method further comprises (f) suspending the object 1130.

In an embodiment, step (f) comprises suspending the object by, optionally, inserting a rotary slip 1130*a*.

In an embodiment, the method further comprises (g) un-wedging the locking dogs 1135.

In an embodiment, step (g) comprises un-wedging the locking dogs by, optionally, letting the elevator grip system down slightly 1135*a*.

In an embodiment, the method further comprises (h) opening the elevator grip system and allowing the locking dogs to disengage the object 1140.

In an embodiment, step (h) comprises, optionally, unlatching the external lock, opening the elevator grip system and allowing the locking dogs to disengage the object 1140*a*.

Exemplary Rotary Slip Grip System

Figure 13A:
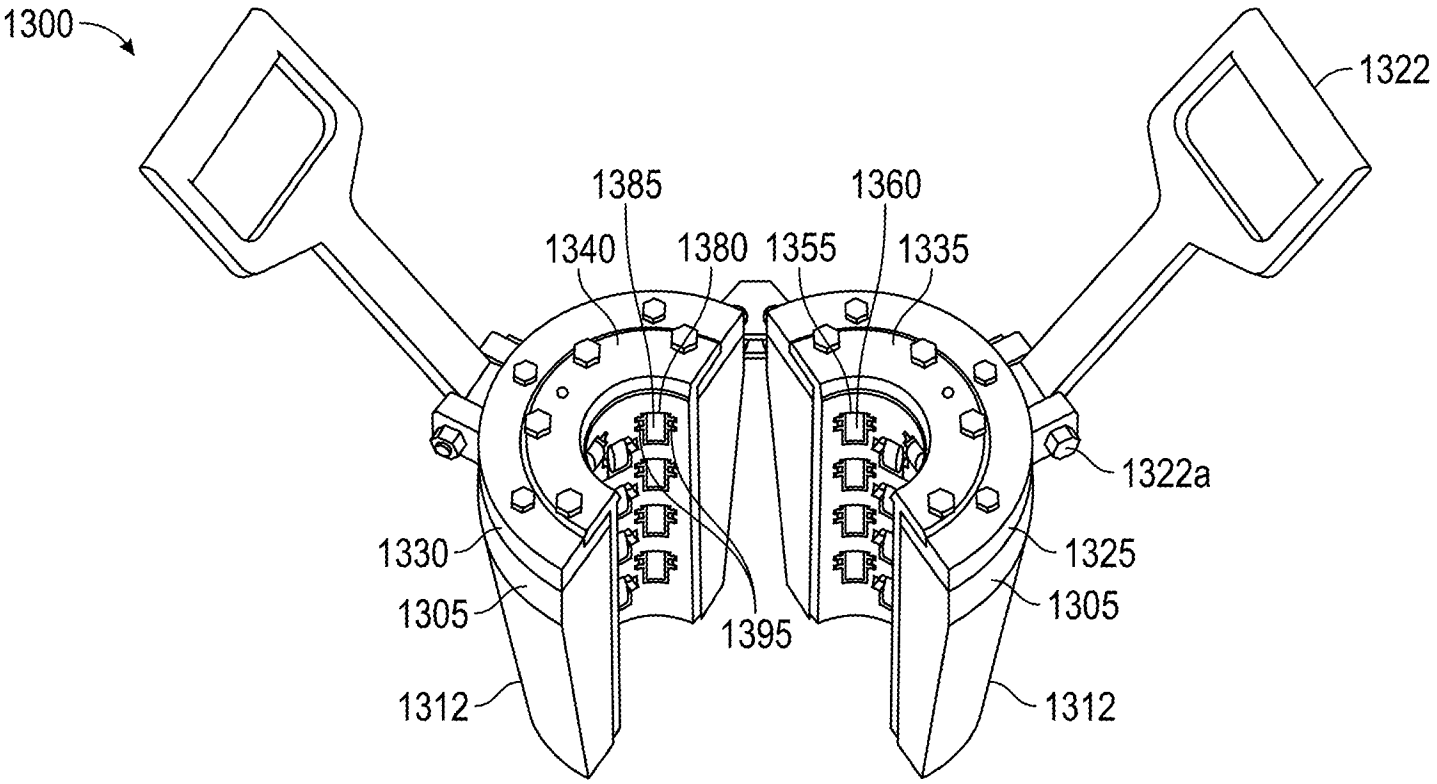
FIG. 13A illustrates an upper, front perspective view of a manual actuation rotary slip grip system, showing the manual actuation rotary slip grip system in the open position.
Figure 13B:
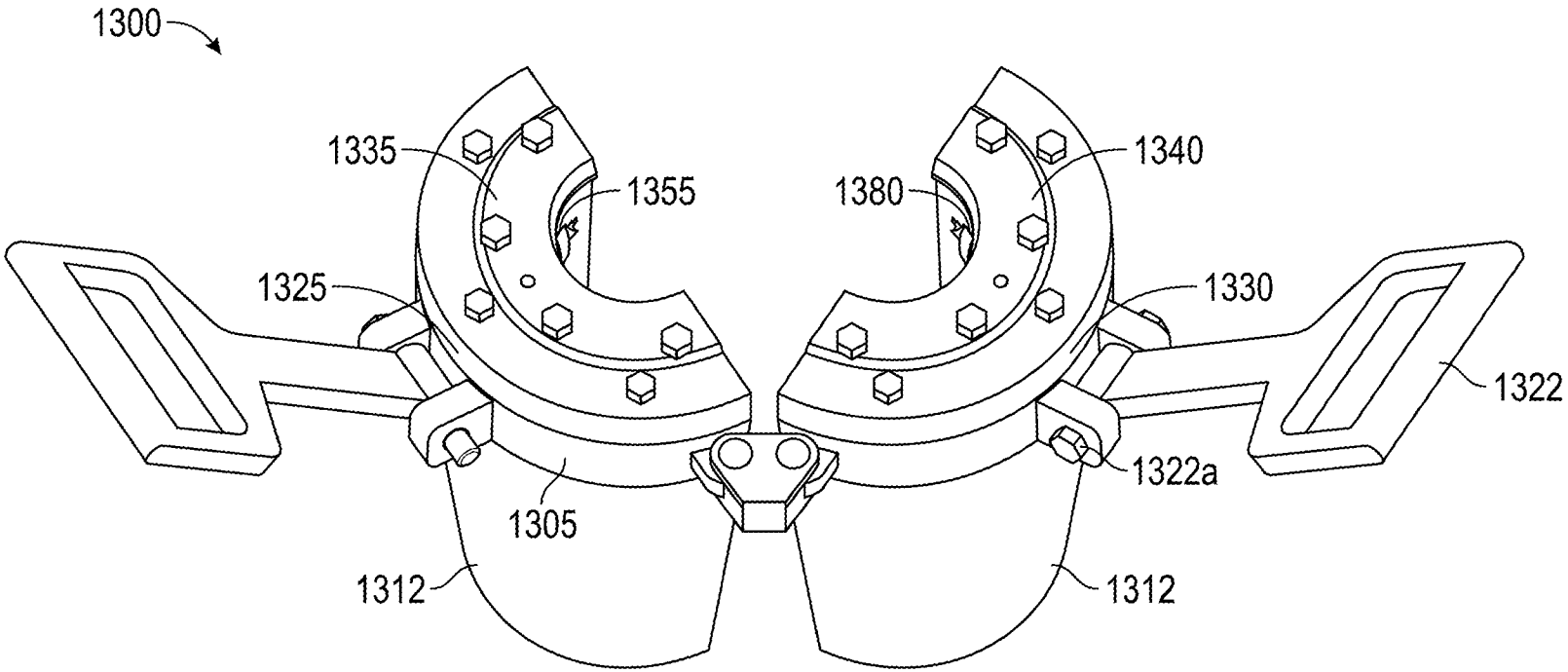
FIG. 13B illustrates an upper, rear perspective view of the manual actuation rotary slip grip system of FIG. 13A, showing the manual actuation rotary slip grip system in the open position.

FIG. 13A illustrates an upper, front perspective view of a manual actuation rotary slip grip system 1300, showing the manual actuation rotary slip grip system 1300 in the open position; and FIG. 13B illustrates an upper, rear perspective view of the manual actuation rotary slip grip system 1300 of FIG. 13A, showing the manual actuation rotary slip grip system 1300 in the open position.

Figure 14:
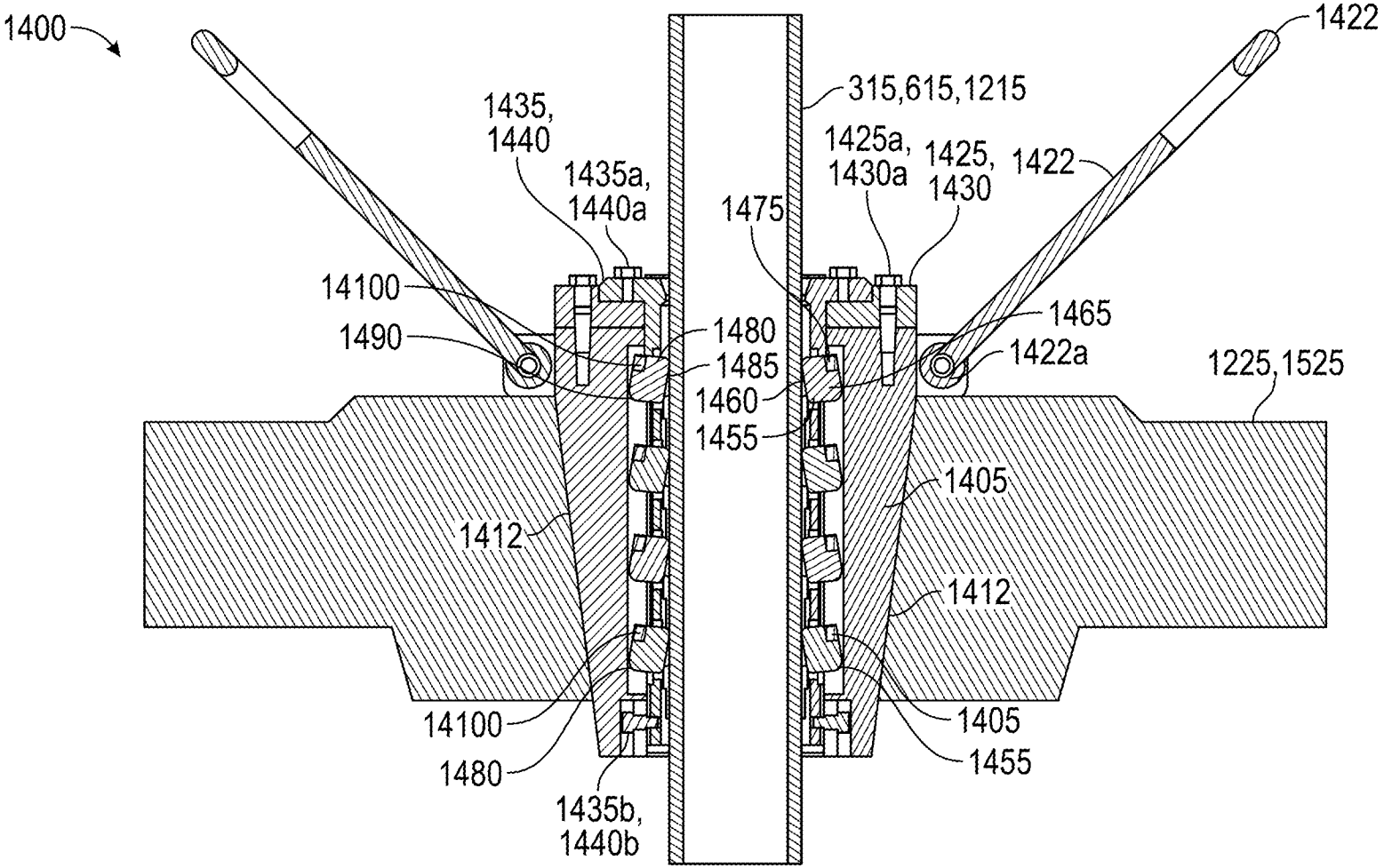
FIG. 14 illustrates a cross-sectional view of a manual actuation rotary slip grip system, showing the manual actuation rotary slip grip system in a closed position around a pipe.

FIG. 14 illustrates a cross-sectional view of a manual actuation rotary slip grip system 1400, showing the manual actuation rotary slip grip system 1400 in a closed position around a pipe.

Figure 15:
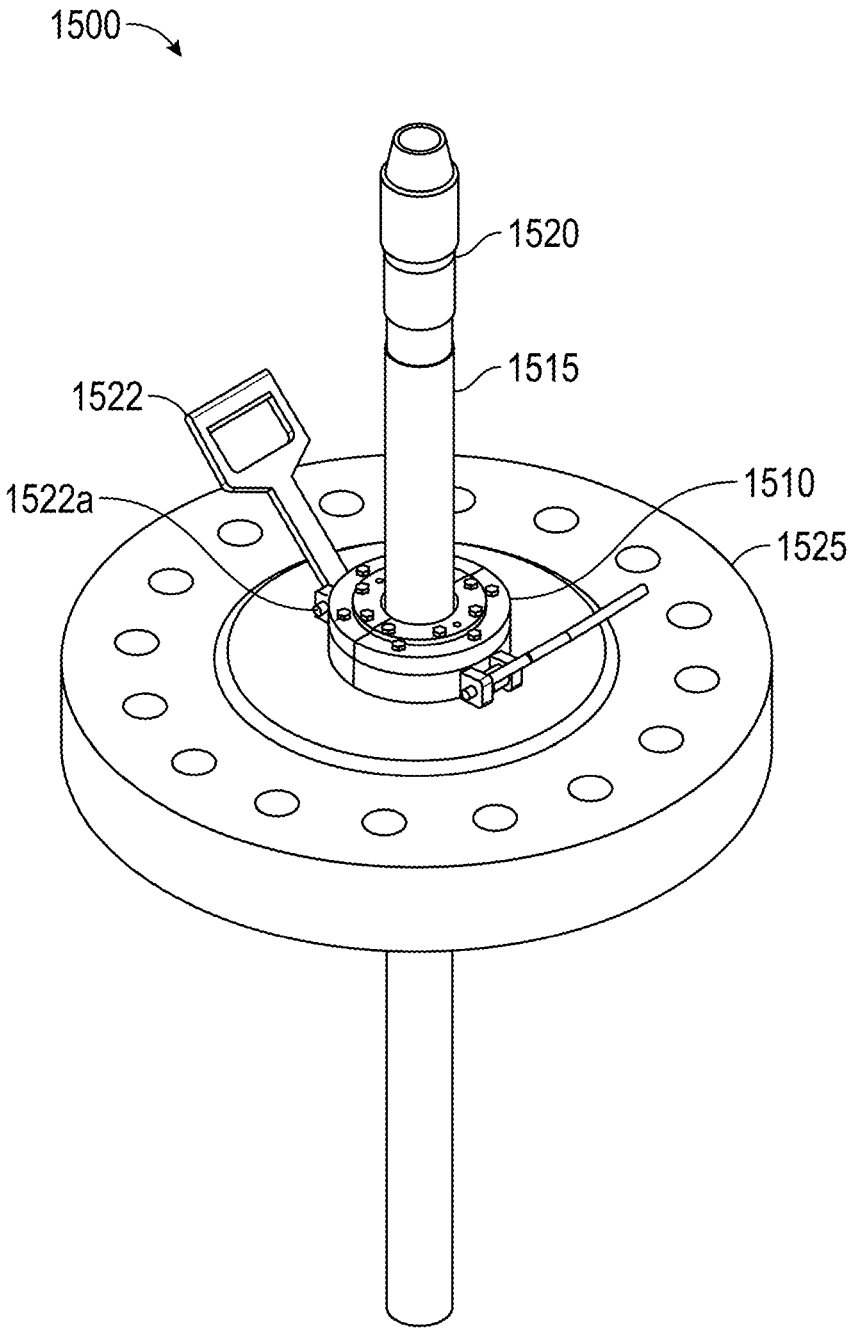
FIG. 15 illustrates an upper, right perspective view of a manual actuation rotary slip grip system as used on a drilling rig floor, showing the manual actuation rotary slip grip system in the closed position around a pipe.

FIG. 15 illustrates an upper, right perspective view of a manual actuation rotary slip grip system as used on a drilling rig floor 1500, showing the manual actuation rotary slip grip system 1510 in the closed position around a pipe 1515 having a shoulder 1520.

As shown in FIG. 15, the rotary slip grip system 1510 rests on the rig floor 1525 when the rotary slip grip system 1510 is in a closed position around the pipe 1515, suspending the pipe 1515.

Figure 17A:
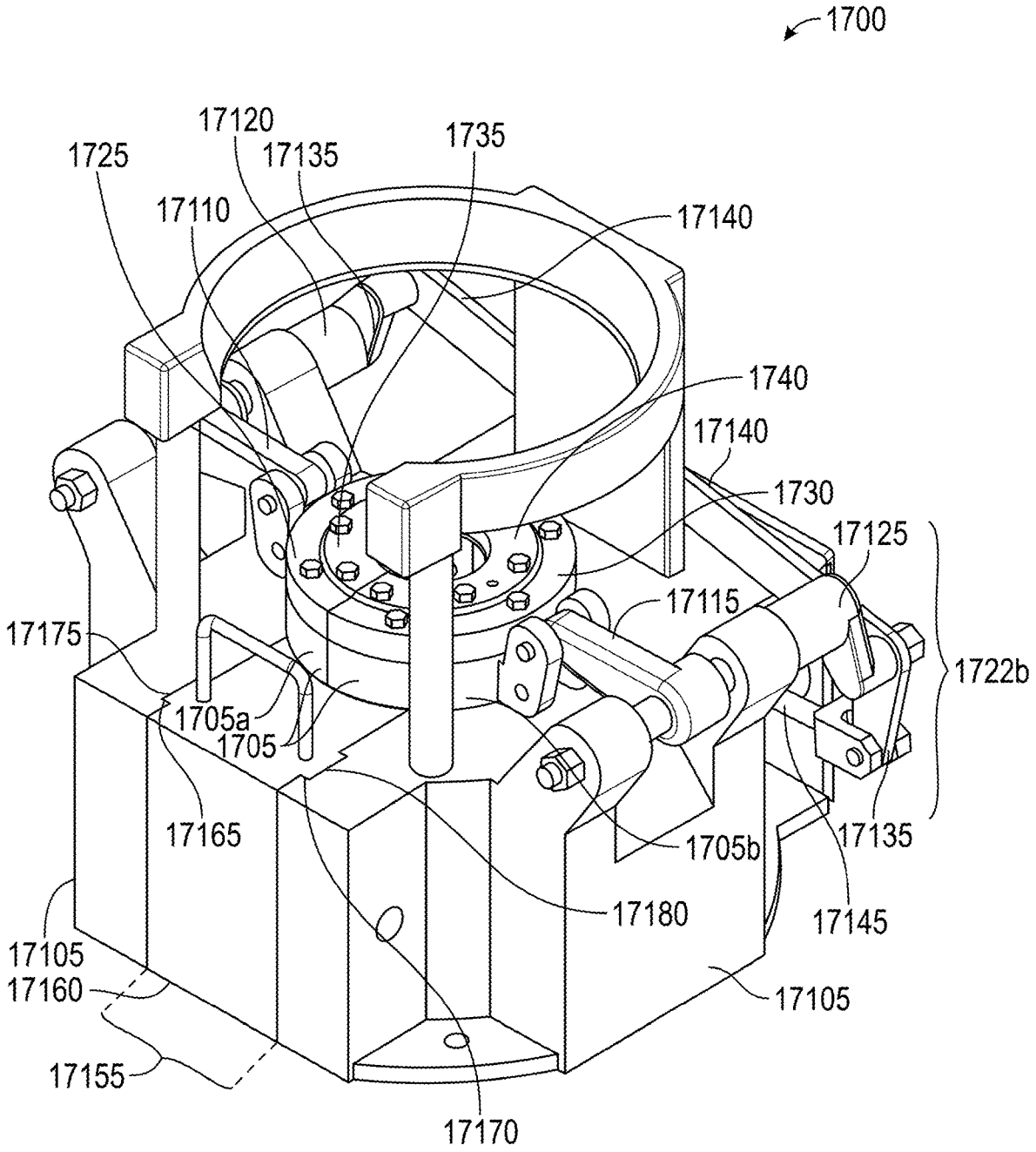
FIG. 17A illustrates an upper, right perspective view of an actuation rotary slip grip system, showing an actuation system for a rotary slip grip system in the closed position.
Figure 17B:
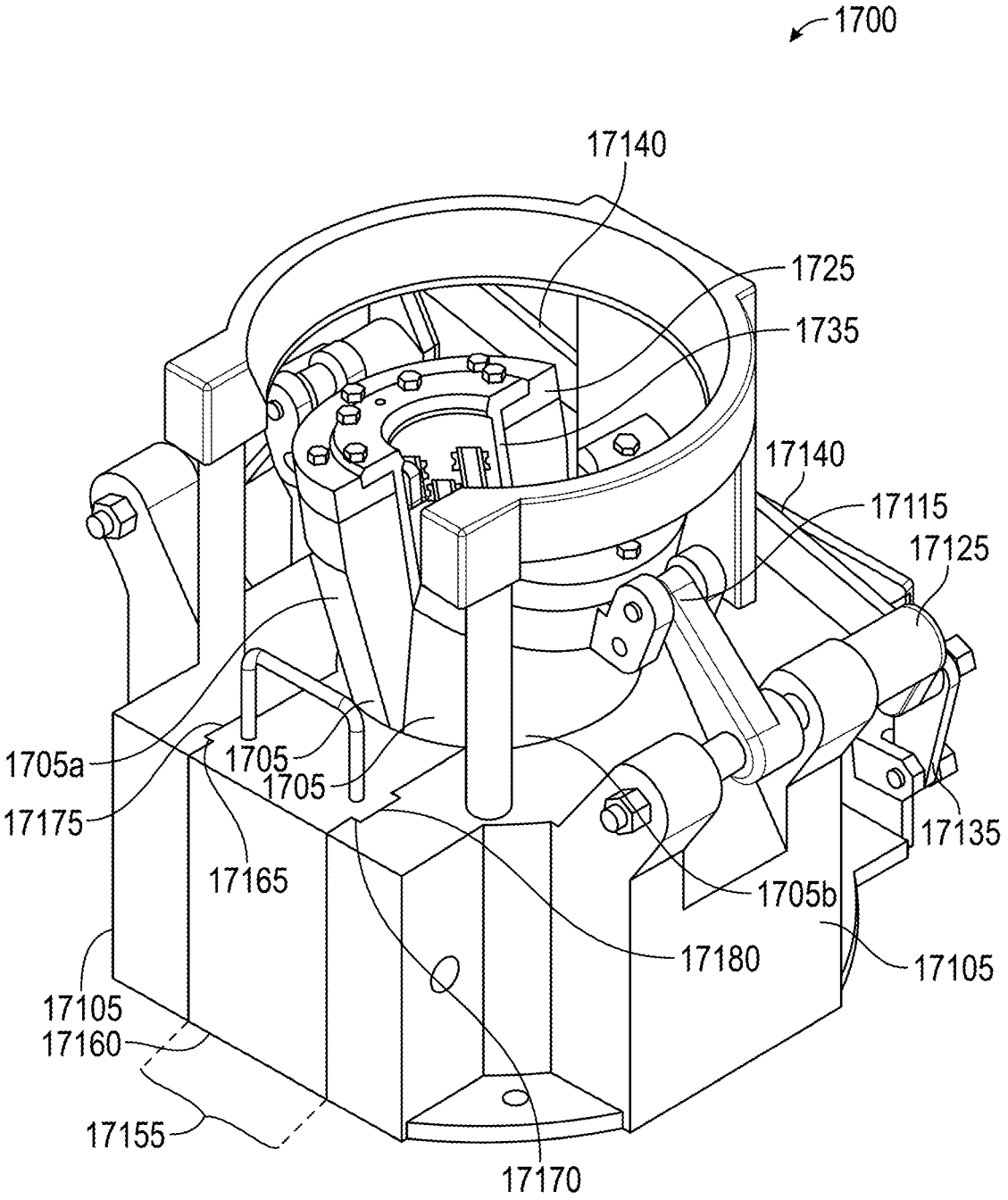
FIG. 17B illustrates an upper, right perspective view of the actuation rotary slip grip system of FIG. 17A, showing the actuation system for the rotary slip grip system in the open position.

FIG. 17A illustrates an upper, right perspective view of a pneumatic (e.g., compressed gas) actuation rotary slip grip system 1700, showing the pneumatic actuation rotary slip grip system 1700 in the closed position; and FIG. 17B illustrates an upper, right perspective view of the pneumatic actuation slip grip system 1700 of FIG. 17A, showing the pneumatic actuation slip grip system 1700 in the open position.

Figure 18:
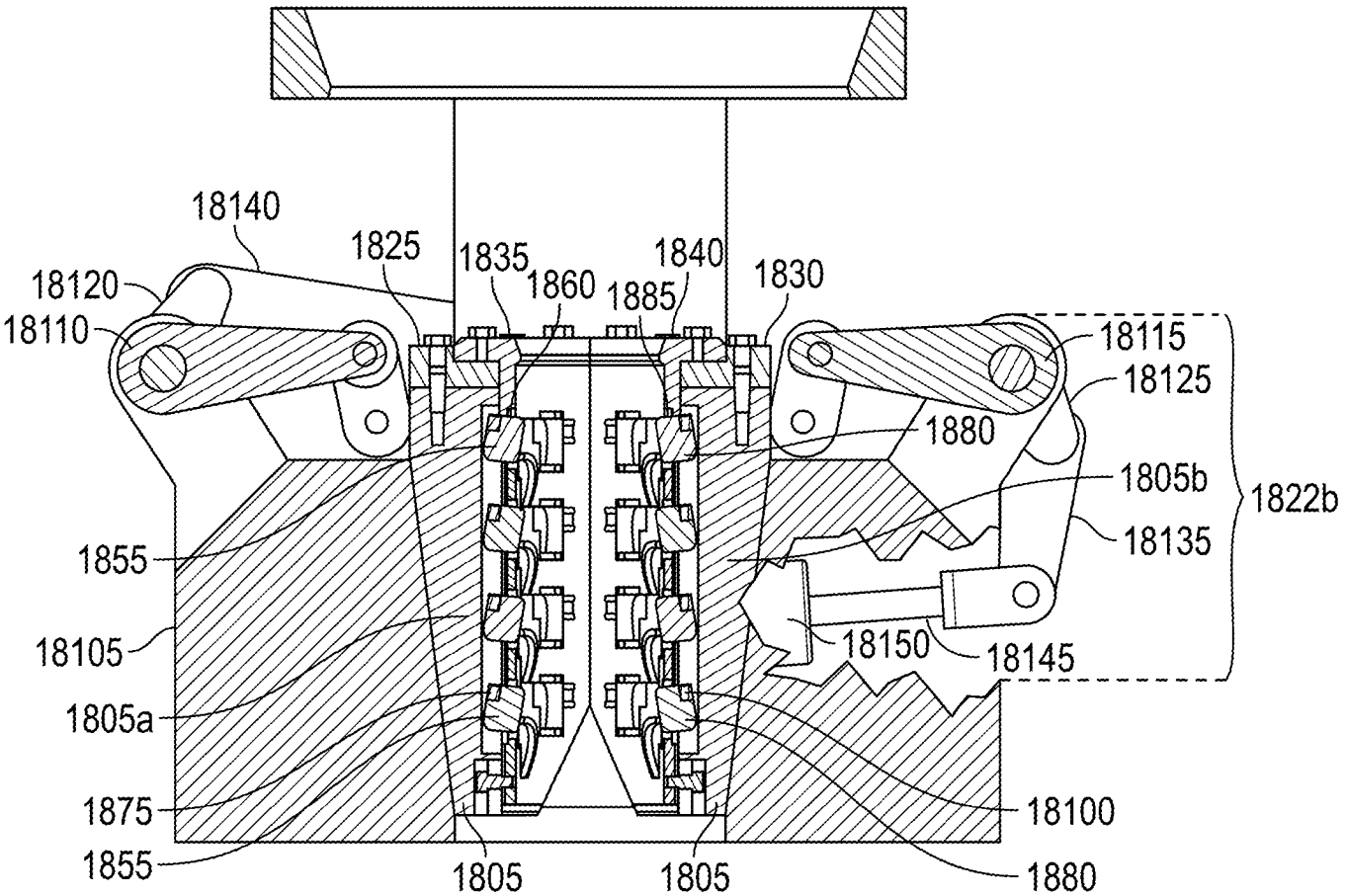
FIG. 18 illustrates a cross-sectional view of the actuation rotary slip grip system in FIGS. 17A-17C, showing the actuation system for the rotary slip grip system in the closed position.

FIG. 18 illustrates a cross-sectional view of the pneumatic actuation slip grip system 1800, showing the pneumatic actuation slip grip system 1800 in the closed position.

Cage Spacer

In an embodiment, the cage spacer 1325, 1330, 1425, 1430, 1825, 1830 elevates the dog cage 1335, 1340, 1435, 1440, 1835, 1840 from an assembly position to an operational position.

In an embodiment, the cage spacer 1325, 1330, 1425, 1430, 1825, 1830 may be attached to the slip body 1305, 1405, 1805 via a fastener 1425*a*, 1430*a*, 1825*a*, 1830*a*.

In an embodiment, the cage spacer 1325, 1330, 1425, 1430, 1825, 1830 may be any suitable shape. For example, a suitable shape includes, but is not limited to, a half-ring shape, a ring shape, or combinations or variations thereof.

In an embodiment, the cage spacer 1325, 1330, 1425, 1430, 1825, 1830 may have a half-ring or ring shape. In an embodiment, the half-ring or ring shape may have a central, upper lip to retain, for example the dog cage 1335, 1340, 1435, 1440, 1835, 1840. See e.g., FIG. 6A: 635, 640.

In an embodiment, the cage spacer 1325, 1330, 1425, 1430, 1825, 1830 may be constructed of any suitable material. For example, a suitable material includes, but is not limited to, any alloy steel. In an embodiment, the cage spacer 1325, 1330, 1425, 1430, 1825, 1830 may be constructed of an alloy steel. In an embodiment, the cage spacer 1325, 1330, 1425, 1430, 1825, 1830 may be constructed of an American Iron and Steel Institute (AISI) 4000 Series alloy steel or equivalent material.

Dog Cage

In an embodiment, the dog cage 1335, 1340, 1435, 1440, 1835, 1840 may be attached to the slip body 1305, 1405, 1805 via a first fastener 1435*a*, 1440*a*, 1835*a*, 1840*a* and a spacer on top and via a second fastener 1435*b*, 1440*b*, 1835*b*, 1840*b* through a vertical slotted port on a lower interior bore of the slip body 1305, 1305, 1805. In an embodiment, the first fasteners and the second fasteners act as slide shafts. In an embodiment, the dog cage 1335, 1340, 1435, 1440, 1835, 1840 may be affixed to the slip body 1305, 1405, 1805 by tightening the each of first fasteners to the slip body 1305, 1405, 1805 against its respective spacer.

In an embodiment, the dog cage 1335, 1340, 1435, 1440, 1835, 1840 may be a means of containing and properly seating each of the plurality of locking dogs 1355, 1380, 1455, 1480, 1855, 1880 retracting each of the plurality of locking dogs 1355, 1380, 1455, 1480, 1855, 1880 from engagement, as well as allowing each of the plurality of locking dogs 1355, 1380, 1455, 1480, 1855, 1880 to be inserted and removed from the slip body 1305, 1405, 1805.

In an embodiment, the dog cage 1335, 1340, 1435, 1440, 1835, 1840 may have two primary positions which are dictated by the cage spacer 1325, 1330, 1425, 1430, 1825, 1830. Without the cage spacer 1325, 1330, 1425, 1430, 1825, 1830 installed, the dog cage 1335, 1340, 1435, 1440, 1835, 1840 may be inserted vertically into the slip body 1305, 1405, 1805, aligning the plurality of openings in the dog cage 1335, 1340, 1435, 1440, 1835, 1840 with the plurality of seats in the slip body 1305, 1405, 1805 so that the plurality of locking dogs 1355, 1380, 1455, 1480, 1855, 1880 may be inserted into their seats. When the cage spacer 1325, 1330, 1425, 1430, 1825, 1830 is installed, the plurality of openings in the dog cage 1335, 1340, 1435, 1440, 1835, 1840 cannot be aligned with the plurality of seats in the slip body 1305, 1405, 1805, containing each of the plurality of locking dogs 1355, 1380, 1455, 1480, 1855, 1880 in its seat.

In an embodiment, the dog cage 1335, 1340, 1435, 1440, 1835, 1840 holds each of the plurality of locking dogs 1355, 1380, 1455, 1480, 1835, 1840 in each of their plurality of seats in the slip body 1305, 1405, 1805.

In an embodiment, the dog cage 1335, 1340, 1435, 1440, 1835, 1840 guides the plurality of locking dogs 1355, 1380, 1455, 1480, 1855, 1880 to engage an object 615, 1215 such as a pipe when the rotary slip grip system 1300, 1400, 1800 is in a closed position. See e.g., FIGS. 6 & 12. In an embodiment, the dog cage 1335, 1340, 1435, 1440, 1835, 1840 guides the plurality of locking dogs 1355, 1380, 1455, 1480 to disengage the object 615, 1215 such as the pipe when the rotary slip grip system 1300, 1400, 1800 is in the open position.

In an embodiment, the object 615, 1215 may be any suitable object to be lifted or suspended. See e.g., FIGS. 6 & 12. For example, a suitable object 615, 1215, includes, but is not limited to an object with a shoulder, an object having little to no shoulder, an object having an irregular exterior surface, or combinations thereof. In an embodiment, the object 615, 1215 may be a pipe having a shoulder. In an embodiment, the object 615, 1215 may be a pipe having little to no shoulder. In an embodiment, the object 615, 1215 may have an irregular exterior surface.

In an embodiment, the dog cage 1335, 1340, 1435, 1440, 1835, 1840 may be any suitable shape. For example, a suitable shape includes, but is not limited to, a half-cylinder shape, a cylinder shape, or combinations or variations thereof.

In an embodiment, the dog cage 1335, 1340, 1435, 1440, 1835, 1840 may have a half-cylinder or cylinder shape. In an embodiment, the half-cylinder or cylinder shape may have an upper lip to mount the dog cage 1335, 1340, 1435, 1440, 1835, 1840 to, for example, the slip body 1305, 1405, 1805.

In an embodiment, the dog cage 1335, 1340, 1435, 1440, 1835, 1840 may have a plurality of openings shaped so that the plurality of locking dogs 1355, 1380, 1455, 1480, 1835, 1840 may engage an object 615, 1215 such as a pipe through the plurality of openings in the dog cage 1335, 1340, 1435, 1440, 1835, 1840 and may disengage the object 615, 1215 by retracting through the plurality of openings. See e.g., FIGS. 6 & 12.

In an embodiment, each of the plurality of openings may be any suitable shape. For example, a suitable shape includes, but is not limited to, an inverted "T" shape, a "T" shape or any other shape such that a front surface 1360, 1385, 1460, 1485, 1860, 1885 of each of the plurality of locking dogs 1355, 1380, 1455, 1480, 1855, 1880 or a portion of each of the plurality of locking dogs 1355, 1380, 1455, 1480, 1855, 1880 may be disposed through each of the plurality of openings to engage an object 615, 1215 such as a pipe. See e.g., FIGS. 6 & 12.

In an embodiment, the dog cage 1335, 1340, 1435, 1440, 1835, 1840 may be made of any suitable material. For example, a suitable material includes, but is not limited to, any alloy steel. In an embodiment, the dog cage 1335, 1340, 1435, 1440, 1835, 1840 may be constructed of an alloy steel. In an embodiment, the dog cage 1335, 1340, 1435, 1440, 1835, 1840 may be constructed of an AISI 4000 Series alloy steel or equivalent material.

Locking Dogs

In an embodiment, the locking dogs 1355, 1380, 1455, 1480, 1855, 1880 engage an object 615, 1215 such as a pipe, and wedge and hold the object 615, 1215 to be lifted or suspended. See e.g., FIGS. 6A-6C & 12.

In an embodiment, the locking dogs 1355, 1380, 1455, 1480, 1855, 1880 may be any suitable shape. For example, a suitable shape includes, but is not limited to, a cubic shape, a cuboid shape, a cylinder shape, a square pyramid shape, a trapezoidal prism shape, a triangular prism shape, or combinations or variations thereof. In an embodiment, the locking dogs 1355, 1380, 1455, 1480, 1855, 1880 may have a cuboid shape. See e.g., FIGS. 6A & 6C: 655, 680.

In an embodiment, each of the plurality of locking dogs 1355, 1380, 1455, 1480, 1855, 1880 may have a front surface 1360, 1460, 1485, 1860, 1885 and a back surface 1365, 1465, 1490, 1865, 1890. See e.g., FIG. 6C: 660, 685, 665, 690. In an embodiment, the front surface 1360, 1460, 1485, 1860, 1885 may be abrasive.

In an embodiment, each of the plurality of locking dogs 1355, 1380, 1455, 1480, 1855, 1880 may have an extension 1370, 1395, 1870, 1895 on each side. See e.g., FIG. 6C: 670, 695. In an embodiment, each of the plurality of locking dogs 1355, 1380, 1455, 1480, 1855, 1880 may have a cylindrical extension 1370, 1395, 1870, 1895 on each side. Id.

In an embodiment, each of the plurality of locking dogs 1355, 1380, 1455, 1480, 1855, 1880 may be made of any suitable material. For example, a suitable material includes, but is not limited to, any alloy steel, carburizing alloy steel or tool steel. In an embodiment, each of the plurality of locking dogs 1355, 1380, 1455, 1480, 1855, 1880 may be constructed of an alloy steel. In an embodiment, each of the plurality of locking dogs 1355, 1380, 1455, 1480, 1855, 1880 may be constructed of a carburizing alloy steel. In an embodiment, each of the plurality of locking dogs 1355, 1380, 1455, 1480, 1855, 1880 may be constructed of an AISI 8620 carburizing alloy steel material or equivalent.

In an embodiment, each of the plurality of locking dogs 1355, 1380, 1455, 1480, 1855, 1880 may have a hardened coating to reduce wear of the holding surfaces. For example, a suitable hardened coating includes, but is not limited to, any Carbide coating or equivalent coating. In an embodiment, each of the plurality of locking dogs 1355, 1380, 1455, 1480, 1855, 1880 may have a Carbide coating with about 6% Cobalt binder or equivalent material.

Actuation Means for Locking Dogs

In an embodiment, the rotary slip grip system 1300, 1400, 1800 further comprises an actuation means to force the locking dogs 1355, 1380, 1455, 1480, 1855, 1880 to engage an object 315, 615, 1215 and to hold tension on the object 315, 615, 1215 to be lifted or suspended. See e.g., FIGS. 3, 6A-6C & 12.

In an embodiment, the actuation means may be any suitable actuation means to force the locking dogs 1355, 1380, 1455, 1480, 1855, 1880 to engage the object 315, 615, 1215 such as a pipe. See e.g., FIGS. 3, 6A-6C & 12. For example, a suitable actuation means includes, but is not limited to, hydraulic actuation, manual actuation, mechanical actuation, pneumatic actuation, or combinations thereof.

In an embodiment, the actuation means may be manual actuation to force the locking dogs 1355, 1380, 1455, 1480, 1855, 1880 to engage an object 315, 615, 1215 and to hold tension on the object 315, 615, 1215 to be lifted or suspended. See e.g., FIGS. 3, 6A-6C & 12.

In an embodiment, the actuation means may be mechanical actuation (e.g., a compression spring 1475, 14100, 1875, 18100) to force the locking dogs 1355, 1380, 1455, 1480, 1855, 1880 to engage an object 315, 615, 1215 and to hold tension on the object 315, 615, 1215 to be lifted or suspended. See e.g., FIGS. 3, 6A-6C & 12.

In an embodiment, the actuation means may be pneumatic actuation (e.g., compressed gas) to force the locking dogs 1355, 1380, 1455, 1480, 1855, 1880 to engage an object 315, 615, 1215 and to hold tension on the object 315, 615, 1215 to be lifted or suspended. See e.g., FIGS. 3, 6A-6C & 12.

In an embodiment, the actuation means may be hydraulic actuation (e.g., hydraulic fluid) to force the locking dogs 1355, 1380, 1455, 1480, 1855, 1880 to engage an object 315, 615, 1215 and to hold tension on the object 315, 615, 1215 to be lifted or suspended. See e.g., FIGS. 3, 6A-6C & 12.

Compression Springs for Locking Dogs

In an embodiment, the rotary slip grip system 1300, 1400, 1800 further comprises a compression spring 1475, 14100, 1875, 18100 disposed between each of the plurality of locking dogs 1355, 1380, 1455, 1480, 1855, 1880 and the slip body 1305, 1405, 1805. See e.g., FIG. 6C: 675, 6100. In an embodiment, the rotary slip grip system 1300, 1400, 1800 further comprises a compression spring 1475, 14100, 1875, 18100 disposed between each of the plurality of locking dogs 1355, 1380, 1455, 1480, 1855, 1880 and each of the plurality of seats in the slip body 1305, 1405, 1805.

In an embodiment, each of the plurality of locking dogs 1355, 1380, 1455, 1480, 1855, 1880 comprises a compression spring 1475, 14100, 1875, 18100 having a first end and a second end. See e.g., FIG. 6C: 675, 6100. In an embodiment, each of the plurality of locking dogs 1355, 1380, 1455, 1480, 1855, 1880 comprises a compression spring 1475, 14100, 1875, 18100 having a first end and a second end, wherein the first end of the compression spring 1475, 14100, 1875, 18100 is attached to the back surface 1465, 1490, 1865, 1890 of the locking dogs 1355, 1380, 1455, 1480, 1855, 1880.

In an embodiment, the compression springs 1475, 14100, 1875, 18100 force the locking dogs 1355, 1380, 1455, 1480, 1855, 1880 to engage an object 315, 615, 1215 and to hold tension on the object 315, 615, 1215 to be lifted or suspended. See e.g., FIGS. 3, 6A-6C & 12.

In an embodiment, the compression spring 1475, 14100, 1875, 18100 may be any suitable spring.

In an embodiment, the compression spring 1475, 14100, 1875, 18100 may be constructed of any suitable material. For example, a suitable material includes, but is not limited to, any spring steel.

Actuation Means for Slip Body

In an embodiment, the rotary slip grip system 1200, 1300, 1400, 1700, 1800 further comprises an actuation means to lift the slip body 1205, 1305, 1405, 1705, 1805 from a bore of a drilling rig floor.

In an embodiment, the actuation means may be any suitable actuation means to lift the slip body 1205, 1305, 1405, 1705, 1805 from the bore of the drilling rig floor. For example, a suitable actuation means includes, but is not limited to, hydraulic actuation, mechanical actuation, pneumatic actuation, or combinations thereof.

In an embodiment, the actuation means may be mechanical actuation (e.g., compression spring) to lift the slip body 1205, 1305, 1405, 1705, 1805 from the bore of the drilling rig floor.

In an embodiment, the actuation means may be pneumatic actuation (e.g., compressed gas) to lift the slip body 1705 1805 from the bore of the drilling rig floor.

In an embodiment, the actuation means may be hydraulic actuation (e.g., hydraulic fluid) to lift the slip body 1705, 1805 from the bore of the drilling rig floor.

Exemplary Pneumatic Actuation System for Slip Body

FIG. 17A illustrates an upper, right perspective view of an actuation rotary slip grip system 1700*a*, showing an actuation system 1722*b* for the rotary slip grip system 1700 in the closed position; FIG. 17B illustrates an upper, right perspective view of the actuation rotary slip grip system 1700*a* of FIG. 17A, showing the actuation system 1722*b* for a rotary slip grip system 1700 in the open position; and FIG. 17C illustrates a detailed view of the actuation rotary slip grip system 1700*a* of FIGS. 17A-17B, showing an actuation body 17105 for the actuation system 1722*b*.

Figure 17C:
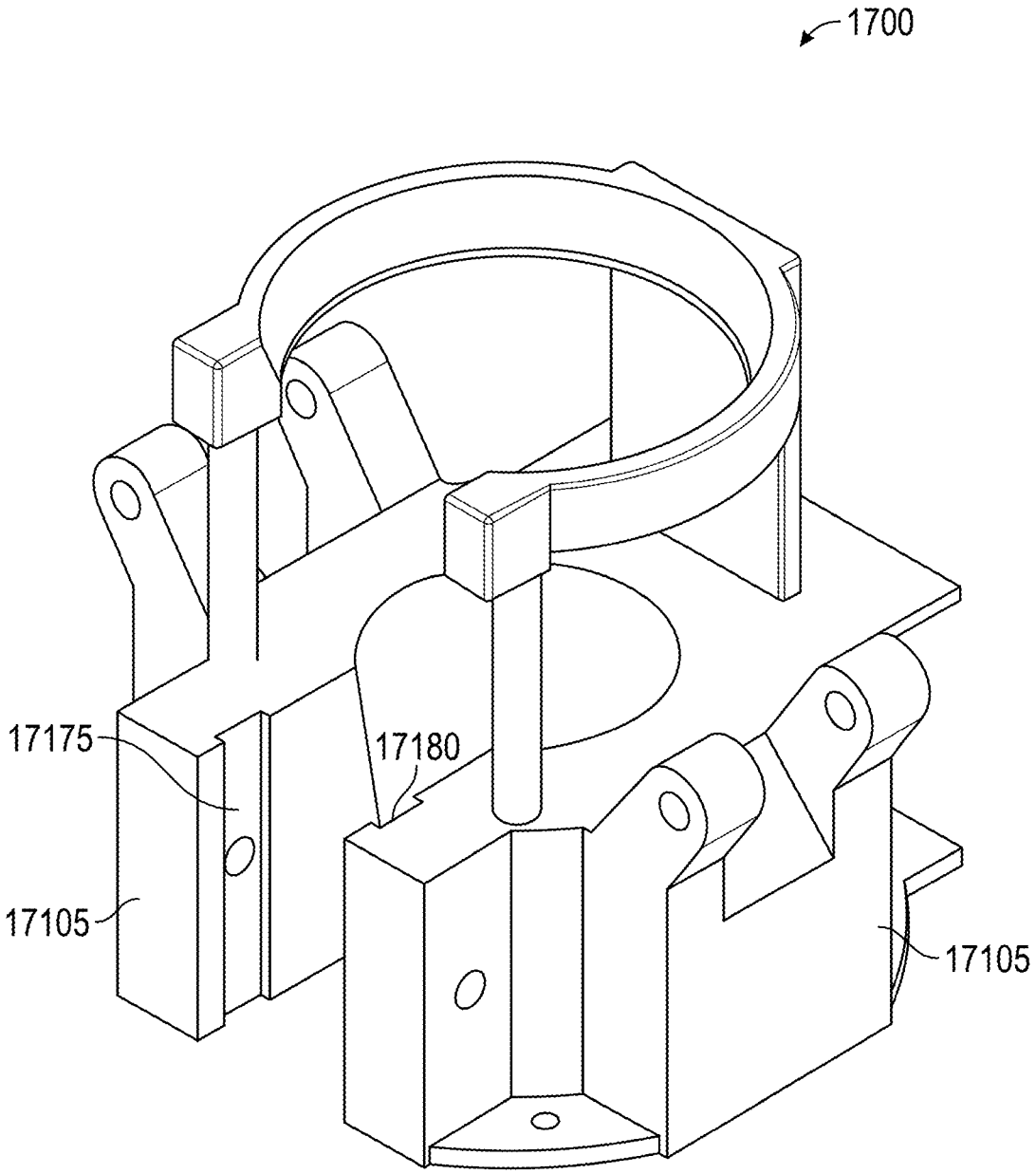
FIG. 17C illustrates a detailed view of the actuation rotary slip grip system of FIGS. 17A-17B, showing an actuation body for the actuation system.

FIG. 18 illustrates a cross-sectional view of the actuation rotary slip grip system 1800*a* of FIGS. 17A-17C, showing the actuation system 1822*b* for the rotary slip grip system 1800 in the closed position.

As shown in in FIGS. 17-18, the actuation rotary slip grip system 1700, 1800 further comprises a pneumatic actuation system 1722*b*, 1822*b*. In an embodiment, the actuation rotary slip grip system 1700, 1800 further comprises a pneumatic actuation system 1722*b*, 1822*b* to lift the slip body 1705, 1805 from a bore of a drilling rig floor.

Actuation Body

In an embodiment, the pneumatic actuation system 1722*b*, 1822*b* comprises an actuation body 17105, 18105.

In an embodiment, the actuation body 17105, 18105 may be any suitable shape. For example, a suitable shape includes, but is not limited to, a cylinder shape, a cubic shape, a cuboid shape, a hexagonal prism shape, a pentagonal prism shape, a triangle prism shape, or combinations thereof. See e.g., FIG. 17C.

In an embodiment, the actuation body 17105, 18105 may have a cylinder shape, a cubic shape, a cuboid shape, a hexagonal prism shape, a pentagonal prism shape, or a triangle prism shape. In an embodiment, the cylinder, cubic, cuboid, hexagonal prism, pentagonal prism shape, or a triangle prism shape may have a cutout or an opening to permit, for example, insertion of the object 315, 615, 1215 such as a pipe.

In an embodiment, the actuation body 17105, 18105 may have a cylinder shape, a cubic shape, a cuboid shape, a hexagonal prism shape, a pentagonal prism shape, or a triangle prism shape. In an embodiment, the cylinder, cubic, cuboid, hexagonal prism, pentagonal prism shape, or a triangle prism shape may have an extension to movably attach and support, for example, a lift arm 17110, 17115, 18110, 18115, a cam shaft 17120, 17125, 18120, 18125, a first drive arm 17130, a second drive arm 17135, 18135, a link 17140, 18140, and/or a cylinder rod 17145, 18145. See e.g., FIGS. 17-18.

In an embodiment, the actuation body 17105, 18105 may have a cylinder shape, a cubic shape, a cuboid shape, a hexagonal prism shape, a pentagonal prism shape, or a triangle prism shape. In an embodiment, the cylinder, cubic, cuboid, hexagonal prism, pentagonal prism shape, or a triangle prism shape may have a first extension and a second extension to movably attach and support, for example, a lift arm 17110, 17115, 18110, 18115, a cam shaft 17120, 17125, 18120, 18125, a drive arm 17130, 17135, 18135, a link 17140, 18140 and/or a cylinder rod 17145, 18145. See e.g., FIGS. 17-18. In an embodiment, the first extension may be a pair of extensions: a first, first extension and a first, second extension; and the second extension may be a pair of extensions: a second, first extension and a second, second extension. Id.

In an embodiment, the actuation body 17105, 18105 may have a cylinder shape, a cubic shape, a cuboid shape, a hexagonal prism shape, a pentagonal prism shape, or a triangle prism shape. In an embodiment, the cylinder, cubic, horseshoe or ring shape may have a guard. See e.g., FIGS. 17-18. In an embodiment, the guard may be any suitable shape. For example, a suitable shape includes, but is not limited to, a cylinder shape, a cubic shape, a cuboid shape, a hexagonal prism shape, a pentagonal prism shape, a triangle prism shape, or combinations thereof. In an embodiment, an upper surface of the actuation body 17105, 18105 fixedly attaches and supports the guard.

In an embodiment, the actuation body 17105, 18105 may be constructed of any suitable material. For example, a suitable material includes, but is not limited to, any alloy steel. In an embodiment, the actuation body 17105, 18105 may be constructed of an alloy steel. In an embodiment, the actuation body 17105, 18105 may be constructed of an American Iron and Steel Institute (AISI) 4000 Series alloy steel or equivalent material.

Lift Arm

In an embodiment, the pneumatic actuation system 1722*b*, 1822*b* comprises a first lift arm 17110, 18110 having a first end and a second end, and a second lift arm 17115, 18115 having a first end and a second end.

In an embodiment, the first lift arm 17110, 18110 may be movably attached to the actuation body 17105, 18105 and the first slip body 1705*a*, 1805*a*; and the second lift arm 17115, 18115 may be movably attached to the actuation body 17105, 1805 and the second slip body 1705*b*, 1805*b*.

In an embodiment, the first end of first lift arm 17110, 18110 may be movably attached to the first, first extension of the actuation body 17105, 18105 and/or the first, second; extension of the actuation body 17105, 18105 and the second end of the first lift arm 17110, 18110 may be movably attached to the first slip body 1705*a*, 1805*a*. See e.g., FIG. 17-18.

In an embodiment, the first end of the second lift arm 17115, 18115 may be movably attached to the first, second extension of the actuation body 17105, 1805 and/or the second, second extension of the actuation body 17105, 18105, and the second end of the second lift arm 17115, 18115 may be movably attached to the second slip body 1705*b*, 1805*b*.

In an embodiment, the first lift arm 17110, 18110 and the second lift arm 17115, 18115 may be any suitable shape. For example, a suitable shape includes, but is not limited to, a cylinder shape, a cubic shape, a cuboid shape, a hexagonal prism shape, a pentagonal prism shape, a triangular prism shape, or combinations thereof. See e.g., FIGS. 17-18.

In an embodiment, the first lift arm 17110, 18110 and the second lift arm 17115, 18115 may be constructed of any suitable material. For example, a suitable material includes, but is not limited to, any alloy steel. In an embodiment, the first lift arm 17110, 18110 and the second lift arm 17115, 18115 may be constructed of an alloy steel. In an embodiment, the first lift arm 17110, 18110 and the second lift arm 17115, 18115 may be constructed of an American Iron and Steel Institute (AISI) 4000 Series alloy steel or equivalent material.

Cam Shaft

In an embodiment, the pneumatic actuation system 1722*b*, 1822*b* comprises a first cam shaft 17120, 18120 having a first end and a second end, and a second cam shaft 17125, 18125 having a first end and a second end.

In an embodiment, the first cam shaft 17120, 18120 may be movably attached to the actuation body 17105, 18105 and/or the first drive arm 17130; and the second cam shaft 17125, 18125 may be movably attached to the actuation body 17105, 1805 and/or the second drive arm 17135, 18135.

In an embodiment, the first end of the first cam shaft 17120, 18120 may be movably attached to the first, second extension of the actuation body 17105, 18105; and first end of the second cam shaft 17125, 18125 may be movably attached to the second, second extension of the actuation body 17105, 1805.

In an embodiment, the second end of the second cam shaft 17125, 18125 may be movably attached to the first end of the first drive arm 17130; and the second end of the second cam shaft 17125, 18125 may be movably attached to the first end of the second drive arm 17135, 18135.

In an embodiment, the first cam shaft 17120, 18120 and the second cam shaft 17125, 18125 may be any suitable shape. For example, a suitable shape includes, but is not limited to, a cylinder shape, a cubic shape, a cuboid shape, a hexagonal prism shape, a pentagonal prism shape, a triangular prism shape, or combinations thereof. See e.g., FIGS. 17-18.

In an embodiment, the first cam shaft 17120, 18120 and the second cam shaft 17125, 18125 may be constructed of any suitable material. For example, a suitable material includes, but is not limited to, any alloy steel. In an embodiment, the first cam shaft 17120, 18120 and the second cam shaft 17125, 18125 may be constructed of an alloy steel. In an embodiment, the first cam shaft 17120, 18120 and the second cam shaft 17125, 18125 may be constructed of an American Iron and Steel Institute (AISI) 4000 Series alloy steel or equivalent material.

Drive Arm

In an embodiment, the pneumatic actuation system 1722*b*, 1822*b* comprises a first drive arm 17130 having a first end and a second end, and a second drive arm 17135, 18135 having a first end and a second end.

In an embodiment, the first drive arm 17130 may be movably attached to the first cam shaft 17120, 18120 and/or the link 17140, 18140; and the second drive arm 17135, 18135 may be movably attached to the second cam shaft 17125, 18125 and/or the cylinder rod 17145, 18145.

In an embodiment, the first end of the first drive arm 17130 may be movably attached to the second end of the first cam shaft 17120, 18120; and the first end of the second drive arm 17135, 18135 may be movably attached to the second end of the second cam shaft 17125, 18125.

In an embodiment, the second end of the first drive arm 17130 may be movably attached to a first end of a link 17140, 18140; and the second end of the second drive arm 17135, 18135 may be movably attached to a cylinder rod 17145, 18145.

In an embodiment, the second end of the first drive arm 17130 may be fixedly attached to the first end of the second drive arm 17135, 18135. In an embodiment, the second end of the first drive arm 17130 may be connected to the first end of the second drive arm 17135, 18135 such that the first drive arm 17130 and the second drive arm 17135, 18135 are a single component.

In an embodiment, the first drive arm 17130 and the second drive arm 17135, 18135 may be any suitable shape. For example, a suitable shape includes, but is not limited to, a cylinder shape, a cubic shape, a cuboid shape, a hexagonal prism shape, a pentagonal prism shape, a triangular prism shape, or combinations thereof. See e.g., FIGS. 17-18.

In an embodiment, the first drive arm 17130 and the second drive arm 17135, 18135 may be constructed of any suitable material. For example, a suitable material includes, but is not limited to, any alloy steel. In an embodiment, the first drive arm 17130 and the second drive arm 17135, 18135 may be constructed of an alloy steel. In an embodiment, the first drive arm 17130 and the second drive arm 17135, 18135 may be constructed of an American Iron and Steel Institute (AISI) 4000 Series alloy steel or equivalent material.

Link

In an embodiment, the pneumatic actuation system 1722*b*, 1822*b* comprises a link 17140, 18140 having a first end and a second end.

In an embodiment, the link 17140, 18140 may be movably attached to the first drive arm 17130 and the second drive arm 17135, 18135.

In an embodiment, the first end of the link 17140, 18140 may be movably attached to the second end of the first drive arm 17130, and the second end of the link 17140, 18140 may be movably attached to the first end of the second drive arm 17135, 18135.

In an embodiment, the link 17140, 18140 may be any suitable shape. For example, a suitable shape includes, but is not limited to, a cylinder shape, a cubic shape, a cuboid shape, a hexagonal prism shape, a pentagonal prism shape, a triangular prism shape, or combinations thereof. See e.g., FIGS. 17-18.

In an embodiment, the link 17140, 18140 may be constructed of any suitable material. For example, a suitable material includes, but is not limited to, any alloy steel. In an embodiment, the link 17140, 18140 may be constructed of an alloy steel. In an embodiment, the link 17140, 18140 may be constructed of an American Iron and Steel Institute (AISI) 4000 Series alloy steel or equivalent material.

Cylinder Rod

In an embodiment, the pneumatic actuation system 1722*b*, 1822*b* comprises a cylinder rod 17145, 18145 having a first end and a second end.

In an embodiment, the cylinder rod 17145, 18145 may be movably attached to the second drive arm 17135, 18135.

In an embodiment, the second end of the cylinder rod 17145, 18145 may be movably attached to the second end of the second drive arm 17135, 18135.

In an embodiment, the cylinder 17145, 18145 may be any suitable shape. For example, a suitable shape includes, but is not limited to, a cylinder shape, a cuboid shape, a hexagonal prism shape, a pentagonal prism shape, a triangular prism shape, or combinations thereof. See e.g., FIGS. 17-18.

In an embodiment, the cylinder rod 17145, 18145 may be constructed of any suitable material. For example, a suitable material includes, but is not limited to, any alloy steel. In an embodiment, the cylinder rod 17145, 18145 may be constructed of an alloy steel. In an embodiment, the cylinder rod 17145, 18145 may be constructed of an American Iron and Steel Institute (AISI) 4000 Series alloy steel or equivalent material.

Cylinder

In an embodiment, the pneumatic actuation system 1722*b*, 1822*b* comprises a cylinder 18150 having a first end and a second end.

In an embodiment, the cylinder 18150 comprises a cylinder rod 17145. 18145.

In an embodiment, the cylinder 18150 may be any suitable cylinder capable of closing and/or opening the first slip body 1705*a*, 1805*a* and the second slip body 1705*b*, 18105*b*. For example, a suitable cylinder includes, but is not limited to, a hydraulic cylinder or a pneumatic cylinder.

Locking Means

In an embodiment, the pneumatic actuation system 1722*b*, 1822*b* further comprises a locking means 17155.

In an embodiment, the locking means 17155 may be any suitable locking means to keep the slip body 1205, 1305, 1405, 1705, 1805 in a closed position. For example, a suitable actuation means includes, but is not limited to, a mechanical lock. In an embodiment, the locking means 17155 is a mechanical lock. In an embodiment, the locking means 17155 comprises a lock 17160.

Lock

In an embodiment, the pneumatic actuation system 1722*b*, 1822*b* further comprises a lock 17160 comprising a first keyed extension 17165 and a second keyed extension 17170, wherein the actuation body 17105, 18105 comprises a first keyed groove 17175 and a second keyed groove 17180, the first keyed groove 17175 shaped to accept the first keyed extension 17165 and the second keyed groove 17180 shaped to accept the second keyed extension 17170.

In an embodiment, the lock 17160 may be any suitable shape to retain the cutout or opening of the actuation body 17105, 18105. For example, a suitable shape includes, but is not limited to, a partial cylinder shape, a partial cuboid shape, a partial hexagonal prism shape, a partial pentagonal prism shape, a partial triangular prism shape, or combinations thereof. See e.g., FIGS. 17-18.

In an embodiment, the lock 17160 may be constructed of any suitable material. For example, a suitable material includes, but is not limited to, any alloy steel. In an embodiment, the lock 17160 may be constructed of an alloy steel. In an embodiment, the lock 17160 may be constructed of an American Iron and Steel Institute (AISI) 4000 Series alloy steel or equivalent material.

Method of Using Rotary Slip Grip System

Figure 16A:
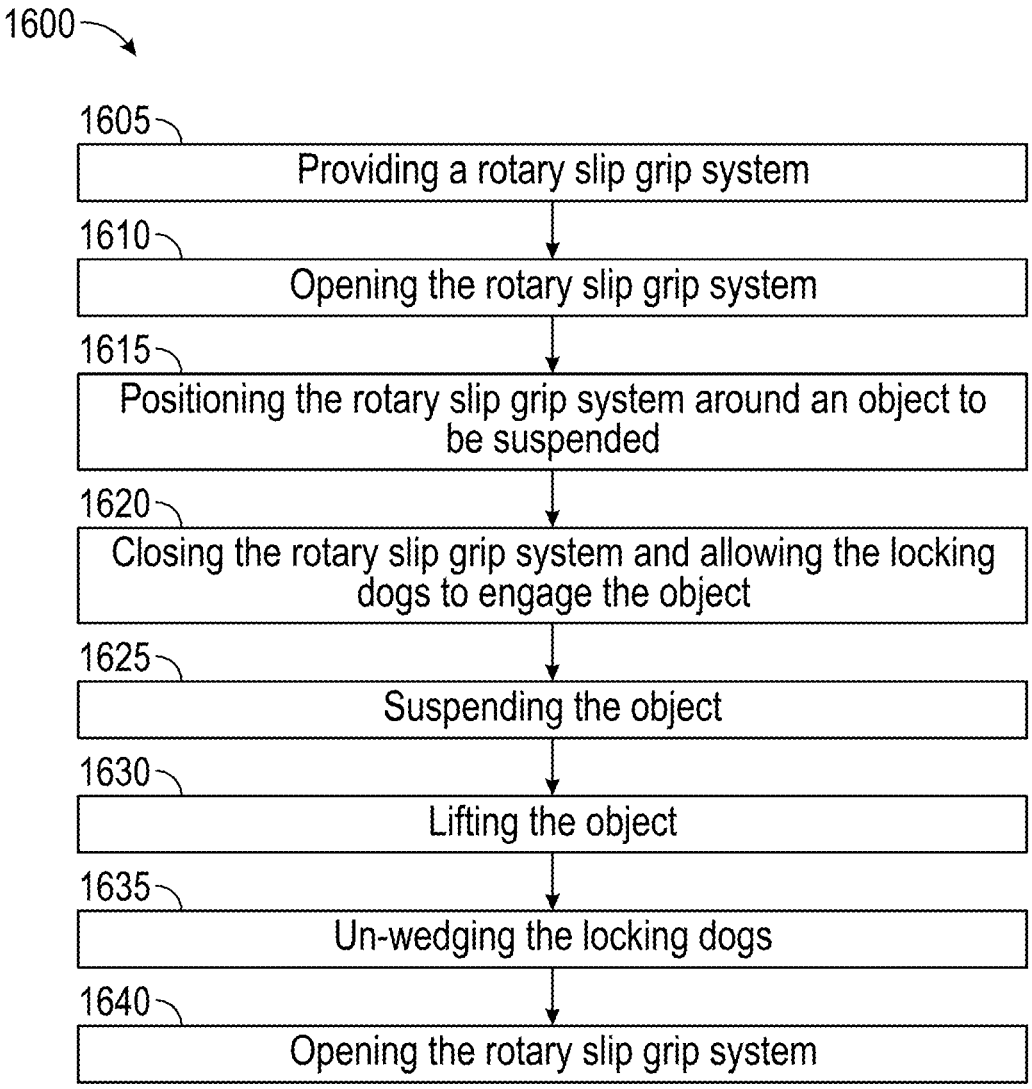
FIG. 16A illustrates a flow chart for a method of using a rotary slip grip system.
Figure 16B:
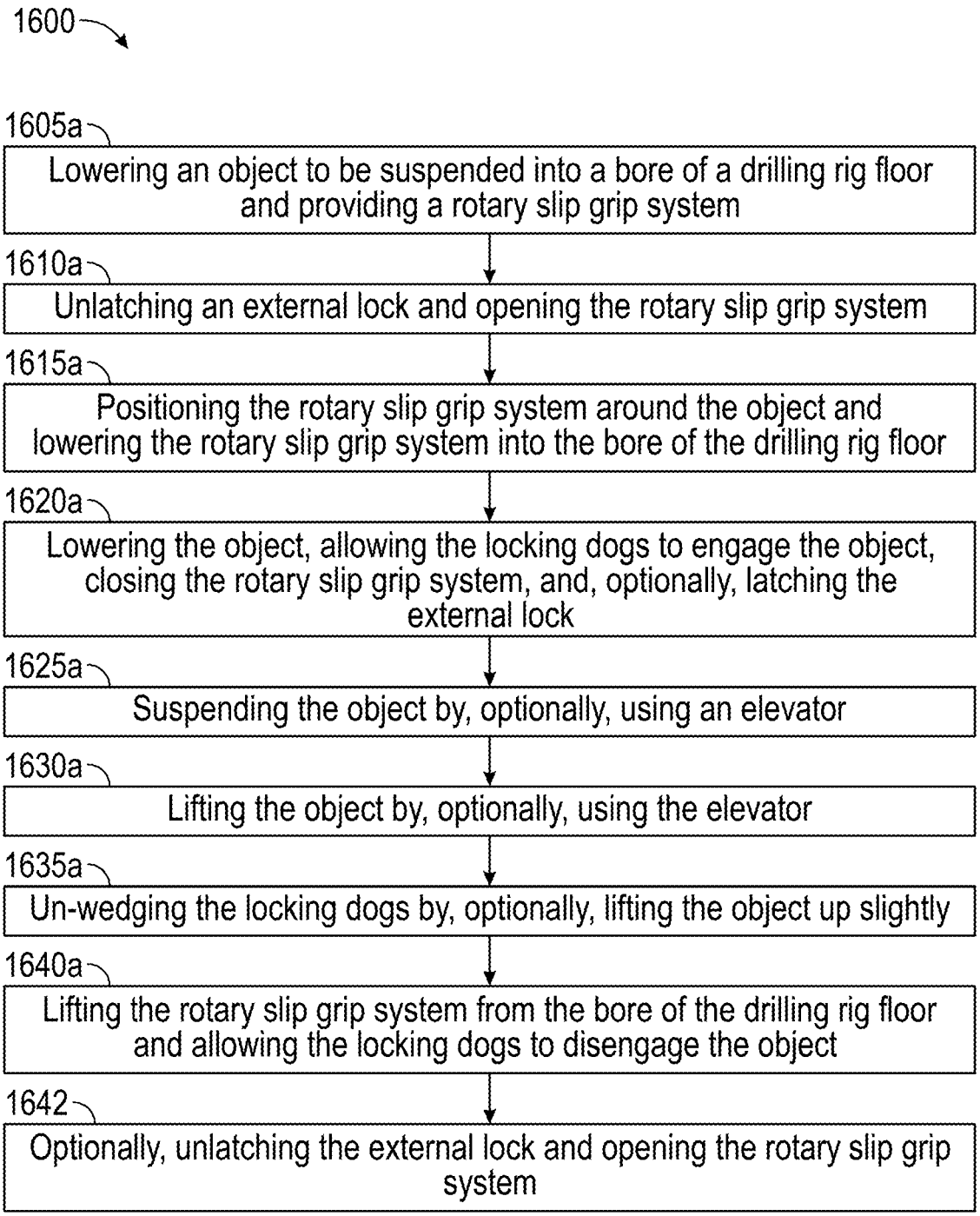
FIG. 16B illustrates optional steps for the method of FIG. 16A.

FIG. 16A illustrates a method of using a rotary slip grip system; and FIG. 16B illustrates optional steps for the method of FIG. 16A.

In an embodiment, a method of using a rotary slip grip system comprises (a) providing the rotary slip grip system as discussed above 1605; (b) opening the rotary slip grip system 1610; (c) positioning the open rotary slip grip system around an object to be suspended 1615; and (d) closing the rotary slip grip system and allowing the locking dogs to engage the object 1620.

In an embodiment, step (a) comprises lowering an object to be suspended into a bore of a drilling rig floor at or near a desired position, and providing the actuation rotary slip grip system as discussed above 1605*a*.

In an embodiment, step (b) comprises, optionally, unlatching an external lock and opening the rotary slip grip system 1610*a*.

In an embodiment, step (c) comprises positioning the open rotary slip grip around the object to be suspended, and lowering the rotary slip grip system into the bore of the drilling rig floor until seated around the object to be suspended 1615*a*.

In an embodiment, step (d) comprises lowering the object, allowing the locking dogs to engage the object, closing the rotary slip grip system, and, optionally, latching the external lock 1620*a*.

In an embodiment, the method further comprises (e) suspending the object 1625.

In an embodiment, step (e) comprises suspending the object by, optionally, using an elevator 1625*a*.

In an embodiment, the method further comprises (f) lifting the object 1630.

In an embodiment, step (f) comprises lifting the object by, optionally, using the elevator 1630*a*.

In an embodiment, the method further comprises (g) un-wedging the locking dogs 1635.

In an embodiment, step (g) comprises un-wedging the locking dogs by, optionally, lifting the object up slightly using an elevator 1635*a*.

In an embodiment, the method further comprises (h) lifting the rotary slip system from the bore of the drilling rig floor and allowing the locking dogs to disengage the object 1640.

In an embodiment, the method further comprises (h) lifting the rotary slip system from the bore of the drilling rig floor using an elevator and allowing the locking dogs to disengage the object 1640*a*.

In an embodiment, the method further comprises (i) opening the rotary slip grip system 1642.

In an embodiment, step (i) comprises, optionally, unlatching the external lock, opening the rotary slip grip system and opening the rotary slip grip system 1642*a*.

Method of Using Actuation Rotary Slip Grip System

Figure 19A:
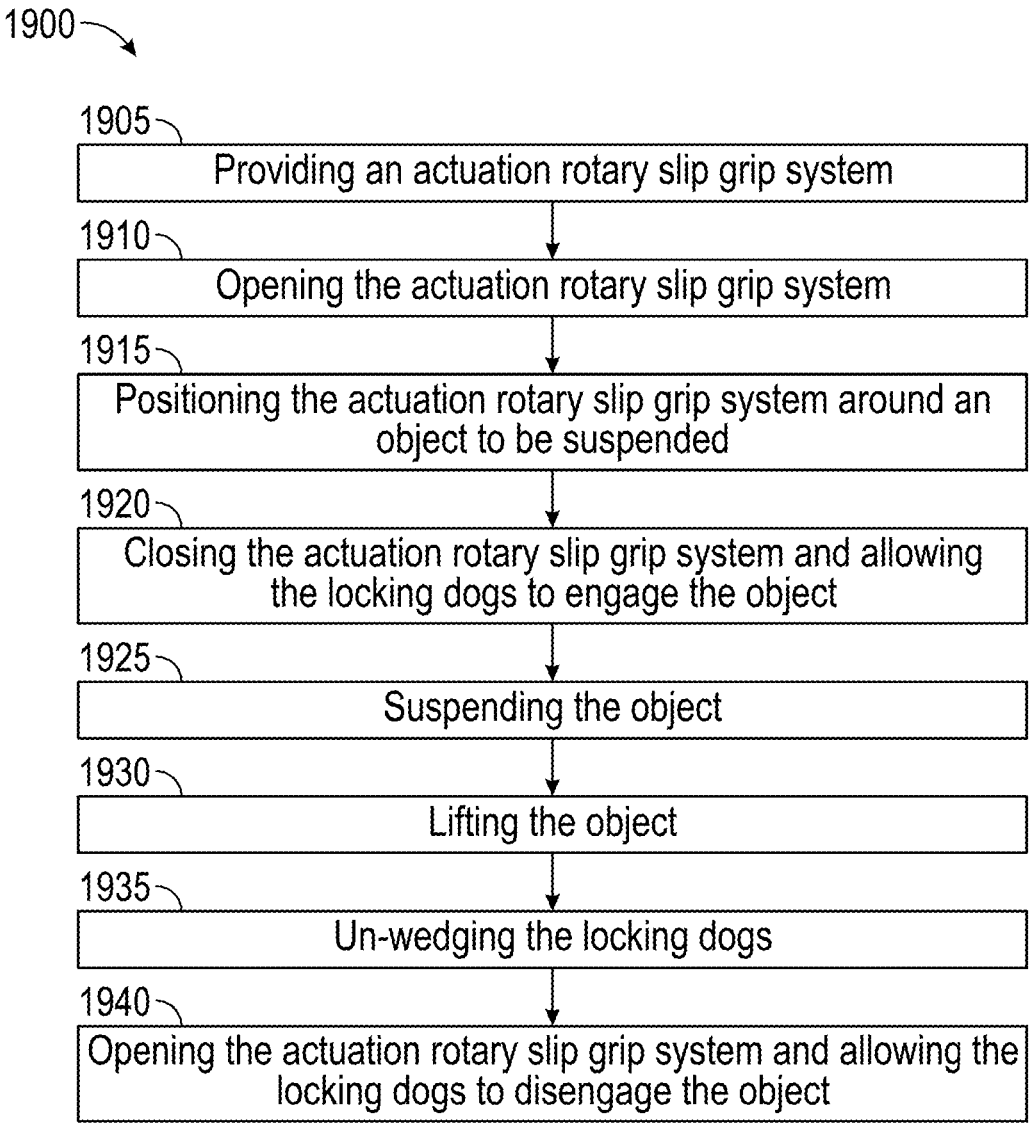
FIG. 19A illustrates a flow chart for a method of using an actuation rotary slip grip system.
Figure 19B:
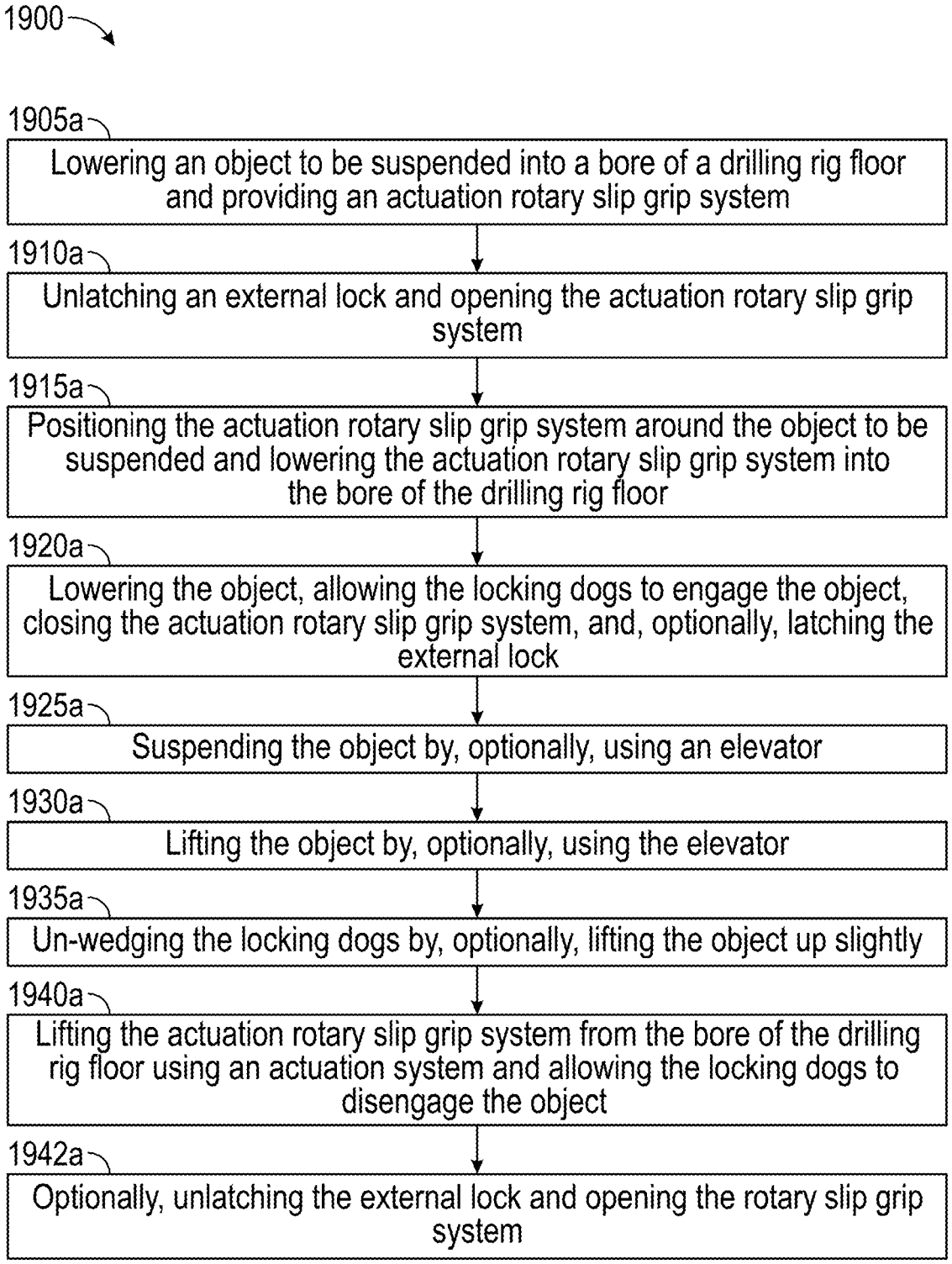
FIG. 19B illustrates optional steps for the method of FIG. 19A.

FIG. 19A illustrates a method of using an actuation rotary slip grip system; and FIG. 19B illustrates optional steps for the method of FIG. 19A.

In an embodiment, a method of using an actuation rotary slip grip system comprises (a) providing the actuation rotary slip grip system as discussed above 1905; (b) opening the rotary slip grip system 1910; (c) positioning the open rotary slip grip system around an object to be suspended 1915; and (d) closing the rotary slip grip system and allowing the locking dogs to engage the object 1920.

In an embodiment, step (a) comprises lowering an object to be suspended into a bore of a drilling rig floor at or near a desired position, and providing the actuation rotary slip grip system as discussed above 1905*a*.

In an embodiment, step (b) comprises, optionally, unlatching an external lock and opening the rotary slip grip system 1910*a*.

In an embodiment, step (c) comprises positioning the open rotary slip grip around the object to be suspended, and lowering the rotary slip into the bore of the drilling rig floor until seated around the object to be suspended 1915*a*.

In an embodiment, step (d) comprises lowering the object, allowing the locking dogs to engage the object, and closing the rotary slip grip system, optionally, latching the external lock 1920*a*.

In an embodiment, the method further comprises (e) suspending the object 1925.

In an embodiment, step (e) comprises suspending the object by, optionally, using an elevator 1925*a*.

In an embodiment, the method further comprises (f) lifting the object 1930.

In an embodiment, step (f) comprises lifting the object by, optionally, using the elevator 1930*a*.

In an embodiment, the method further comprises (g) un-wedging the locking dogs 1935.

In an embodiment, step (g) comprises un-wedging the locking dogs by, optionally, lifting the object up slightly using an elevator 1935*a*.

In an embodiment, the method further comprises (h) lifting the rotary slip system from the bore of the drilling rig floor and allow the locking dogs to disengage the object 1940.

In an embodiment, the method further comprises (h) lifting the rotary slip system from the bore of the drilling rig floor using an elevator and allowing the locking dogs to disengage the object 1940*a*.

In an embodiment, step (h) comprises lifting the rotary slip system from the bore of the drilling rig floor using an actuation system and allowing the locking dogs to disengage the object 1940*b*.

In an embodiment, the method further comprises (i) opening the rotary slip grip system 1942.

In an embodiment, step (i) comprises, optionally, unlatching the external lock, opening the rotary slip grip system and opening the rotary slip grip system 1942*a*.

In the foregoing description of certain embodiments, specific terminology has been resorted to for the sake of clarity. However, the disclosure is not intended to be limited to the specific terms so selected, and it is to be understood that each specific term includes other technical equivalents which operate in a similar manner to accomplish a similar technical purpose. Terms (e.g., "outer" and "inner," "upper" and "lower," "first" and "second," "internal" and "external," "above" and "below" and the like) are used as words of convenience to provide reference points and, as such, are not to be construed as limiting terms.

The embodiments set forth herein are presented to best explain the present invention and its practical application and to thereby enable those skilled in the art to make and utilize the invention. However, those skilled in the art will recognize that the foregoing description has been presented for the purpose of illustration and example only. The description as set forth is not intended to be exhaustive or to limit the invention to the precise form disclosed. Many modifications and variations are possible in light of the above teaching without departing from the spirit and scope of the following claims.

Also, the various embodiments described above may be implemented in conjunction with other embodiments, e.g., aspects of one embodiment may be combined with aspects of another embodiment to realize yet other embodiments. Further, each independent feature or component of any given assembly may constitute an additional embodiment.

Definitions

As used herein, the terms "a," "an," "the," and "said" mean one or more, unless the context dictates otherwise.

As used herein, the term "about" means the stated value plus or minus a margin of error plus or minus 10% if no method of measurement is indicated.

As used herein, the term "or" means "and/or" unless explicitly indicated to refer to alternatives only or if the alternatives are mutually exclusive.

As used herein, the terms "comprising," "comprises," and "comprise" are open-ended transition terms used to transition from a subject recited before the term to one or more elements recited after the term, where the element or elements listed after the transition term are not necessarily the only elements that make up the subject.

As used herein, the terms "containing," "contains," and "contain" have the same open-ended meaning as "comprising," "comprises," and "comprise," provided above.

As used herein, the terms "having," "has," and "have" have the same open-ended meaning as "comprising," "comprises," and "comprise," provided above.

As used herein, the terms "including," "includes," and "include" have the same open-ended meaning as "comprising," "comprises," and "comprise," provided above.

As used herein, the phrase "consisting of" is a closed transition term used to transition from a subject recited before the term to one or more material elements recited after the term, where the material element or elements listed after the transition term are the only material elements that make up the subject.

As used herein, the term "simultaneously" means occurring at the same time or about the same time, including concurrently.

INCORPORATION BY REFERENCE

All patents and patent applications, articles, reports, and other documents cited herein are fully incorporated by reference to the extent they are not inconsistent with this invention.

What is claimed is:

1. An elevator grip system, comprising:

(a) a cage spacer adaptably mountable to an upper surface of an elevator body;

(b) a dog cage having a plurality of openings, wherein the dog cage is movably attached to the elevator body and vertically positioned by the cage spacer; and (c) a plurality of locking dogs adaptably mountable to a plurality of seats in the elevator body, wherein each of the plurality of locking dogs has a front surface to engage an object and wherein the front surface of each of the plurality of locking dogs is disposed through each of the plurality of openings in the dog cage.

2. The elevator grip system of claim 1 further comprising a linking means having a first end and a second end, wherein the first end of the linking means is movably attached to the cage spacer and wherein the second end of the linking means is movably attached to the cage spacer.

3. The elevator grip system of claim 2, wherein the second end of the linking means is adapted to force the dog cage downward when the elevator grip system is in the closed position and wherein the second end of the linking means is shaped to extend over the dog cage when the elevator grip system is in the closed position.

4. The elevator grip system of claim 2, wherein one or more of the cage spacer, the dog cage, the linking means and the locking dogs are constructed of an alloy steel.

5. The elevator grip system of claim 2, wherein one or more of the cage spacer, the dog cage, the linking means and the plurality of locking dogs are constructed of an American Iron and Steel (AISI) 4000 Series alloy steel or equivalent material.

6. The elevator grip system of claim 1, wherein the cage spacer comprises a central, upper lip to prevent accumulation of debris.

7. The elevator grip system of claim 1, wherein the cage spacer comprises two half-rings adaptable mountable to the upper surface of the elevator body, wherein the two half-rings come together to form a ring shape when the elevator grip system is in a closed position.

8. The elevator grip system of claim 6, wherein each half-ring of the cage spacer comprises a central, upper lip to retain an upper lip of the dog cage when the elevator grip system is in the closed position.

9. The elevator grip system of claim 1, wherein the dog cage comprises two half-cylinders, wherein the two half-cylinders come together to form an open cylinder shape when the elevator grip system is in a closed position.

10. The elevator grip system of claim 1, wherein each of the plurality of openings are an inverted "T" shape, a rectangle shape, a square shape, a "T" shape or a combination thereof.

11. The elevator grip system of claim 1, wherein each of the plurality of openings are a "T" shape.

12. The elevator grip system of claim 1, wherein each of the plurality of locking dogs are a cubic shape, a cuboid shape, a cylinder shape, a square pyramid shape, a trapezoidal prism shape, a triangle prism shape or combinations thereof.

13. The elevator grip system of claim 1, wherein each of the plurality of locking dogs are a cuboid shape.

14. The elevator grip system of claim 1, wherein each of the plurality of locking dogs comprise an extension on each side.

15. The elevator grip system of claim 1, wherein each of the plurality of locking dogs comprise a cylindrical extension on each side.

16. The elevator grip system of claim 1, wherein elevator grip system further comprises a plurality of cage return springs disposed between the cage spacer and the dog cage.

17. The elevator grip system of claim 1, wherein the elevator grip system further comprises a compression spring disposed between each of the plurality of locking dogs and the elevator body.

18. The elevator grip system of claim 1, wherein the plurality of locking dogs is constructed of a carburizing alloy steel.

19. The elevator grip system of claim 1, wherein the plurality of locking dogs is constructed of an American Iron and Steel (AISI) 8620 carburizing alloy steel or equivalent material.

20. The elevator grip system of claim 1, wherein the plurality of locking dogs has a Carbide coating or equivalent coating.

21. The elevator grip system of claim 1, wherein the plurality of locking dogs has a Carbide coating with about 6% Cobalt binder or equivalent material.

22. The elevator grip system of claim 1, wherein the elevator grip system is capable of griping objects that have little to no shoulder and/or a variable exterior surface.

23. The elevator grip system of claim 1, wherein the elevator grip system is capable of griping pipe having an outer diameter from about 2⅞ inches to about 6⅝ inches.

24. The elevator grip system of claim 1, wherein the elevator grip system is capable of lifting about 175 tons.

25. The elevator grip system of claim 1, wherein the elevator grip system further comprises an actuation means to force the locking dogs to engage an object and to hold tension on the object to be lifted.

26. The elevator grip system of claim 25, wherein the actuation means is mechanical actuation.

27. The elevator grip system of claim 26, wherein the actuation means is mechanical actuation.

28. The elevator grip system of claim 24, wherein the elevator grip system further comprises an actuation means to force the locking dogs to engage an object and to hold tension on the object to be lifted.

29. An elevator grip system, comprising:

(a) a cage spacer fixedly attached to an elevator body;

(b) a dog cage having a plurality of openings, wherein the dog cage is movably attached to the elevator body and vertically positioned by the cage spacer;

(c) a push rod having a first end and a second end, wherein the first end of the push rod is movably attached to the cage spacer;

(d) a lever arm having a first end and a second end shaped to extend over the dog cage when the elevator grip system is in the closed position, wherein the second end of the push rod is movably attached to the first end of the lever arm and the second end of the lever arm is movably attached to the cage spacer and adapted to force the dog cage downward when the elevator grip system is in a closed position; and (e) a plurality of locking dogs adaptably mountable to a plurality of seats in the elevator body, wherein each of the locking dogs has a front surface to engage an object and wherein the front surface of each of the plurality of locking dogs is disposed through each of the plurality of openings in the dog cage.

30. The elevator grip system of claim 29, wherein the cage spacer comprises a central, upper lip to prevent accumulation of debris.

31. The elevator grip system of claim 29, wherein the cage spacer comprises two half-rings adaptable mountable to the upper surface of the elevator body, wherein the two half-rings come together to form a ring shape when the elevator grip system is in a closed position.

32. The elevator grip system of claim 31, wherein each half-ring of the cage spacer comprises a central, upper lip to retain an upper lip of the dog cage when the elevator grip system is in the closed position.

33. The elevator grip system of claim 29, wherein the dog cage comprises two half-cylinders with an upper lip and a lower opening.

34. The elevator grip system of claim 29, wherein each of the plurality of openings are an inverted "T" shape, a rectangle shape, a square shape, a "T" shape or a combination thereof.

35. The elevator grip system of claim 29, wherein each of the plurality of openings are a "T" shape.

36. The elevator grip system of claim 29, wherein each of the plurality of locking dogs are a cubic shape, a cuboid shape, a cylinder shape, a square pyramid shape, a trapezoidal prism shape, a triangle prism shape or combinations thereof.

37. The elevator grip system of claim 29, wherein each of the plurality of locking dogs are a cuboid shape.

38. The elevator grip system of claim 29, wherein each of the plurality of locking dogs comprise an extension on each side.

39. The elevator grip system of claim 29, wherein each of the plurality of locking dogs comprise a cylindrical extension on each side.

40. The elevator grip system of claim 29, wherein the elevator grip system further comprises a plurality of cage return springs disposed between the cage spacer and the dog cage.

41. The elevator grip system of claim 29, wherein the elevator grip system further comprises a compression spring disposed between each of the plurality of locking dogs and the elevator body.

42. The elevator grip system of claim 29, wherein one or more of the cage spacer, the dog cage, the linking means and the locking dogs are constructed of an alloy steel.

43. The elevator grip system of claim 29, wherein one or more of the cage spacer, the dog cage, the lever arm, the push rod and the plurality of locking dogs are constructed of an American Iron and Steel (AISI) 4000 Series alloy steel or equivalent material.

44. The elevator grip system of claim 29, wherein the plurality of locking dogs is constructed of a carburizing alloy steel.

45. The elevator grip system of claim 29, wherein the plurality of locking dogs is constructed of an American Iron and Steel (AISI) 8620 carburizing alloy steel or equivalent material.

46. The elevator grip system of claim 29, wherein the plurality of locking dogs has a Carbide coating or equivalent coating.

47. The elevator grip system of claim 29, wherein the plurality of locking dogs has a Carbide coating with about 6% Cobalt binder or equivalent material.

48. A method of using an elevator grip system, the method comprising:

(a) using the elevator grip system of claim 1;

(b) opening the elevator grip system;

(c) positioning the open elevator grip system around an object to be lifted; and (d) closing the elevator grip system and allowing the plurality of locking dogs to engage the object.

49. The method of claim 48, wherein step (b) comprises: unlatching an external lock and opening the elevator grip system.

50. The method of claim 48, wherein step (c) comprises: closing the elevator grip system, latching the external lock and allowing the plurality of locking dogs to engage the object.

51. The method of claim 50 further comprising (f) suspending the object.

52. The method of claim 48 further comprising (e) lifting the object.

53. The method of claim 52, wherein step (f) comprises suspending the object by inserting a rotary slip.

54. The method of claim 53, wherein step (g) comprises un-wedging the plurality of locking dogs by letting the elevator grip system down slightly.

55. The method of claim 53 further comprising (h) opening the elevator grip system and allowing the locking dogs to disengage the object to a retracted position.

56. The method of claim 52 further comprising (g) un-wedging the plurality of locking dogs.

57. The method of claim 48 further comprising:

(e) lifting the object;

(f) suspending the object;

(g) un-wedging the plurality of locking dogs; and (h) unlatching the external lock, opening the elevator grip system and allowing the plurality of locking dogs to disengage the object.

* * * * *